US007379679B2

(12) United States Patent
Taguchi et al.

(10) Patent No.: US 7,379,679 B2
(45) Date of Patent: May 27, 2008

(54) IMAGE FORMING APPARATUS AND METHOD WITH PLURAL DEVELOPERS EACH STORING TONER OF THE SAME COLOR

(75) Inventors: Keiichi Taguchi, Nagano-ken (JP); Yoichi Yamada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 306 days.

(21) Appl. No.: 11/152,845

(22) Filed: Jun. 13, 2005

(65) Prior Publication Data

US 2005/0276619 A1 Dec. 15, 2005

(30) Foreign Application Priority Data

Jun. 14, 2004 (JP) ..... 2004-175528
Jun. 14, 2004 (JP) ..... 2004-175529
Jun. 14, 2004 (JP) ..... 2004-175530
Mar. 16, 2005 (JP) ..... 2005-074691

(51) Int. Cl.
*G03G 15/08* (2006.01)

(52) U.S. Cl. ..... 399/27; 399/253; 399/254

(58) Field of Classification Search ..... 347/140; 399/27, 29, 30, 252–254
See application file for complete search history.

(56) References Cited

U.S. PATENT DOCUMENTS 5,523,832 A * 6/1996 Hamamichi et al. ..... 399/254
5,530,527 A * 6/1996 Fukasawa et al. ..... 399/254
6,385,408 B1 5/2002 Scheuer
6,397,021 B2 5/2002 Hayashi et al.
6,522,843 B2 2/2003 Yamada et al.
6,650,849 B2 11/2003 Shimura
2002/0015172 A1 2/2002 Sugita
2002/0063890 A1 5/2002 Hayashi et al.
2004/0037577 A1 2/2004 Shimura et al.

FOREIGN PATENT DOCUMENTS

JP 2001-242743 9/2001
JP 2001-356556 12/2001
JP 2002-059617 2/2002
JP 2002-116658 4/2002

(Continued)

*Primary Examiner*—Hoang Ngo
(74) *Attorney, Agent, or Firm*—Hogan & Hartson LLP

(57) ABSTRACT

In a case where there are developers belonging to Life Rank 1 representing a service life substantially as long as that of a fresh developer (Step S501), and the developers includes one which is ready to print (Step S502), it is determined that image formation can be performed without performing a preparatory operation (Step S506). In a case where there is no print-ready developer but a developer which requires an agitation operation of rotating a developing roller by a predetermined quantity (Step S503), the agitation operation is performed on the developer (Step S504) so as to make the developer in a print-ready state. In a case where the developer cannot be made print-ready by the agitation operation, a density control operation for adjusting operating conditions of an apparatus is performed (Step S505). Thus is obviated an unnecessary operation. The developer subjected to a predetermined print preparatory process is used in a printing operation so that an image of good quality may be formed. In a case where no Rank-1 developer is available but a Rank-2 developer, deteriorated to a degree, is available, the same procedure is taken.

43 Claims, 35 Drawing Sheets

FOREIGN PATENT DOCUMENTS

| | | |
|---|---|---|
| JP | 2002-169427 | 6/2002 |
| JP | 2002-244368 | 8/2002 |
| JP | 2002-351190 | 12/2002 |
| JP | 2003-098768 | 4/2003 |
| JP | 2003-215862 | 7/2003 |
| JP | 2003-215865 | 7/2003 |
| JP | 2003-228258 | 8/2003 |
| JP | 2003-241483 | 8/2003 |
| JP | 2004-005247 | 1/2004 |
| JP | 2004-061926 | 2/2004 |
| JP | 2004-109980 | 4/2004 |

* cited by examiner

FIG. 24

FIRST TABLE

| CASE No. | CURRENT CONDITIONS OF DEVELOPER | | | | DEVELOPER USED IN PREVIOUS OPERATION | | | |
|---|---|---|---|---|---|---|---|---|
| | 4Ka | 4Kb | 4Kc | 4Kd | 4Ka | 4Kb | 4Kc | 4Kd |
| 1 | O | O | O | O | 4Kb | 4Kc | 4Kd | 4Ka |
| 2 | O | O | O | — | 4Kb | 4Kc | 4Ka | 4Ka |
| 3 | O | O | — | O | 4Kb | 4Kd | 4Kd | 4Ka |
| 4 | O | O | — | — | 4Kc | 4Kc | 4Ka | 4Ka |
| 5 | O | — | O | O | 4Kc | 4Kc | 4Kd | 4Ka |
| 6 | O | — | O | — | 4Kc | 4Kc | 4Ka | 4Ka |
| 7 | O | — | — | O | 4Kd | 4Kd | 4Kd | 4Ka |
| 8 | O | — | — | — | 4Ka | 4Ka | 4Ka | 4Ka |
| 9 | — | O | O | O | 4Kb | 4Kc | 4Kd | 4Kb |
| 10 | — | O | O | — | 4Kb | 4Kc | 4Kb | 4Kb |
| 11 | — | O | — | O | 4Kb | 4Kd | 4Kd | 4Kb |
| 12 | — | O | — | — | 4Kb | 4Kb | 4Kb | 4Kb |
| 13 | — | — | O | O | 4Kc | 4Kc | 4Kd | 4Kc |
| 14 | — | — | O | — | 4Kc | 4Kc | 4Kc | 4Kc |
| 15 | — | — | — | O | 4Kd | 4Kd | 4Kd | 4Kd |

O : RANK-1 AND PRINT-READY CATEGORY

— : OTHER THAN THOSE ABOVE

FIG. 25

SECOND TABLE

| CASE No. | CURRENT CONDITIONS OF DEVELOPER | | | | DEVELOPER USED IN PREVIOUS OPERATION | | | |
|---|---|---|---|---|---|---|---|---|
| | 4Ka | 4Kb | 4Kc | 4Kd | 4Ka | 4Kb | 4Kc | 4Kd |
| 1 | O | O | O | O | 4Kb | 4Kc | 4Kd | 4Ka |
| 2 | O | O | O | — | 4Kb | 4Kc | 4Ka | 4Ka |
| 3 | O | O | — | O | 4Kb | 4Kd | 4Kd | 4Ka |
| 4 | O | O | — | — | 4Kc | 4Kc | 4Ka | 4Ka |
| 5 | O | — | O | O | 4Kc | 4Kc | 4Kd | 4Ka |
| 6 | O | — | O | — | 4Kc | 4Kc | 4Ka | 4Ka |
| 7 | O | — | — | O | 4Kd | 4Kd | 4Kd | 4Ka |
| 8 | O | — | — | — | 4Ka | 4Ka | 4Ka | 4Ka |
| 9 | — | O | O | O | 4Kb | 4Kc | 4Kd | 4Kb |
| 10 | — | O | O | — | 4Kb | 4Kc | 4Kb | 4Kb |
| 11 | — | O | — | O | 4Kb | 4Kd | 4Kd | 4Kb |
| 12 | — | O | — | — | 4Kb | 4Kb | 4Kb | 4Kb |
| 13 | — | — | O | O | 4Kc | 4Kc | 4Kd | 4Kc |
| 14 | — | — | O | — | 4Kc | 4Kc | 4Kc | 4Kc |
| 15 | — | — | — | O | 4Kd | 4Kd | 4Kd | 4Kd |

O : RANK-2 AND PRINT-READY CATEGORY
— : OTHER THAN THOSE ABOVE

FIG. 26

<table>
<tr><th rowspan="2">LIFE RANK</th><th colspan="3">CATEGORY</th></tr>
<tr><th>PRINT-READY</th><th>AGITATION REQUIRING</th><th>DENSITY-CONTROL REQUIRING</th></tr>
<tr><td>1</td><td rowspan="2">FIRST STATE</td><td colspan="2" rowspan="2">SECOND STATE</td></tr>
<tr><td>2</td></tr>
<tr><td>3</td><td colspan="3">THIRD STATE</td></tr>
</table>

IMAGE FORMING APPARATUS AND METHOD WITH PLURAL DEVELOPERS EACH STORING TONER OF THE SAME COLOR

CROSS REFERENCE TO RELATED APPLICATION

The disclosure of Japanese Patent Applications enumerated below including specifications, drawings and claims is incorporated herein by reference in its entirety:

No. 2004-175528 filed on Jun. 14, 2004;

No. 2004-175529 filed on Jun. 14, 2004;

No. 2004-175530 filed on Jun. 14, 2004; and

No. 2005-074691 filed on Mar. 16, 2005.

BACKGROUND OF THE INVENTION

1. Field of the Invention

The present invention relates to an image forming apparatus which includes a developing unit adapted for removal mounting of plural developing devices each storing a toner of the same color, and which performs a printing operation using the toner in the developing device mounted in the developing unit, as well as to an image forming method thereof.

2. Description of the Related Art

Conventionally, image forming apparatuses for forming images using a plurality of developer devices have been widely known in the art. For instance, Japanese Patent Application Laid-Open Gazette No. 2003-215862 discloses a color image forming apparatus equipped with a rotary developing unit having four developer devices radially arranged about a rotary shaft thereof This apparatus operates as follows. The rotary shaft of the developing unit is driven into rotation for selectively positioning one of the four developer devices at an opposed position to a latent image carrier such as a photosensitive member, so as to develop a latent image on the latent image carrier. The resultant image is transferred onto an intermediate transfer medium. The same developing and transferring processes as the above are repeated in cycles while switching from one developer device to another, whereby toner images of plural colors are superimposed on each other to form a color image.

In the image forming apparatuses of this type, a proposal has been made to mount a plurality of developing devices each storing a toner of the same color so as to use the apparatus as an image forming apparatus exclusive to monochromatic image formation. Japanese Patent Application Laid-Open Gazette No. 2002-351190, for example, discloses an image forming apparatus wherein plural developing devices each storing a toner of the same color are mounted in the developing unit. The apparatus forms monochromatic images using any one of the developing devices while switching from one developing device to another as needed.

In order to print an image with excellent quality using the toner in the developing device, a print preparatory process for bringing the developing device into a state usable for printing operation must be conducted prior to the printing operation. In the image forming apparatuses of this type, there is known a phenomenon, for example, that when an image forming operation is performed using a developing device left standstill for long, image density variations are encountered in an initial stage of the operation. Hence, it is necessary to carry out a process for eliminating this phenomenon whenever needed. For achieving a high image quality, the conditions of printing operation of the apparatus need be adjusted according to the characteristics of the developing device used.

In this connection, a variety of techniques for conducting favorable print preparatory processes have heretofore been proposed with respect to an image forming apparatus including one developing device and a color image forming apparatus including a plurality of developing devices individually storing toners of mutually different colors.

SUMMARY OF THE INVENTION

A preferred mode of the print preparatory process for the monochromatic image forming apparatus adapted to mount plural developers is not always the same as that for the image forming apparatus including only one developer or the color image forming apparatus. The reason is that such a monochromatic image forming apparatus has a special situation that the all of the plural developers need not always be in the state usable for printing operation. Unfortunately, however, adequate studies have not been made on the print preparatory process performed in the monochromatic image forming apparatus.

In view of the foregoing, an object of the invention is to provide a technique for conducting a favorable print preparatory process in the image forming apparatus including the developing unit adapted to mount plural developers each storing a toner of the same color, and in the image forming method thereof.

For achieving the above object, the invention is characterized in that a predetermined print preparatory process is performed on at least one developer so as to shift the device to the print-ready state in a case where there is no print-ready developer. The content of the print preparatory process is optimized based on a print request from external source, on a state of the developer or on an execution status of the warm-up operation of the fixing unit.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 24 is a diagram which shows the first table for selection of the developer;

FIG. 25 is a diagram which shows the second table for selection of the developer;

FIG. 26 is a chart which shows the correspondence between the terms used in the claims of the invention and the terms used in the sixth embodiment;

DETAILED DESCRIPTION OF THE PREFERRED EMBODIMENTS

The preferred embodiments of the image forming apparatus to which the invention is applied will be described hereinbelow. Since an arrangement and basic operations of the apparatus are common to the individual embodiments hereof, the arrangement of the apparatus is first described and then, specific operations of the individual embodiments will be described in turn.

(Arrangement of Apparatus)

Figure 1:
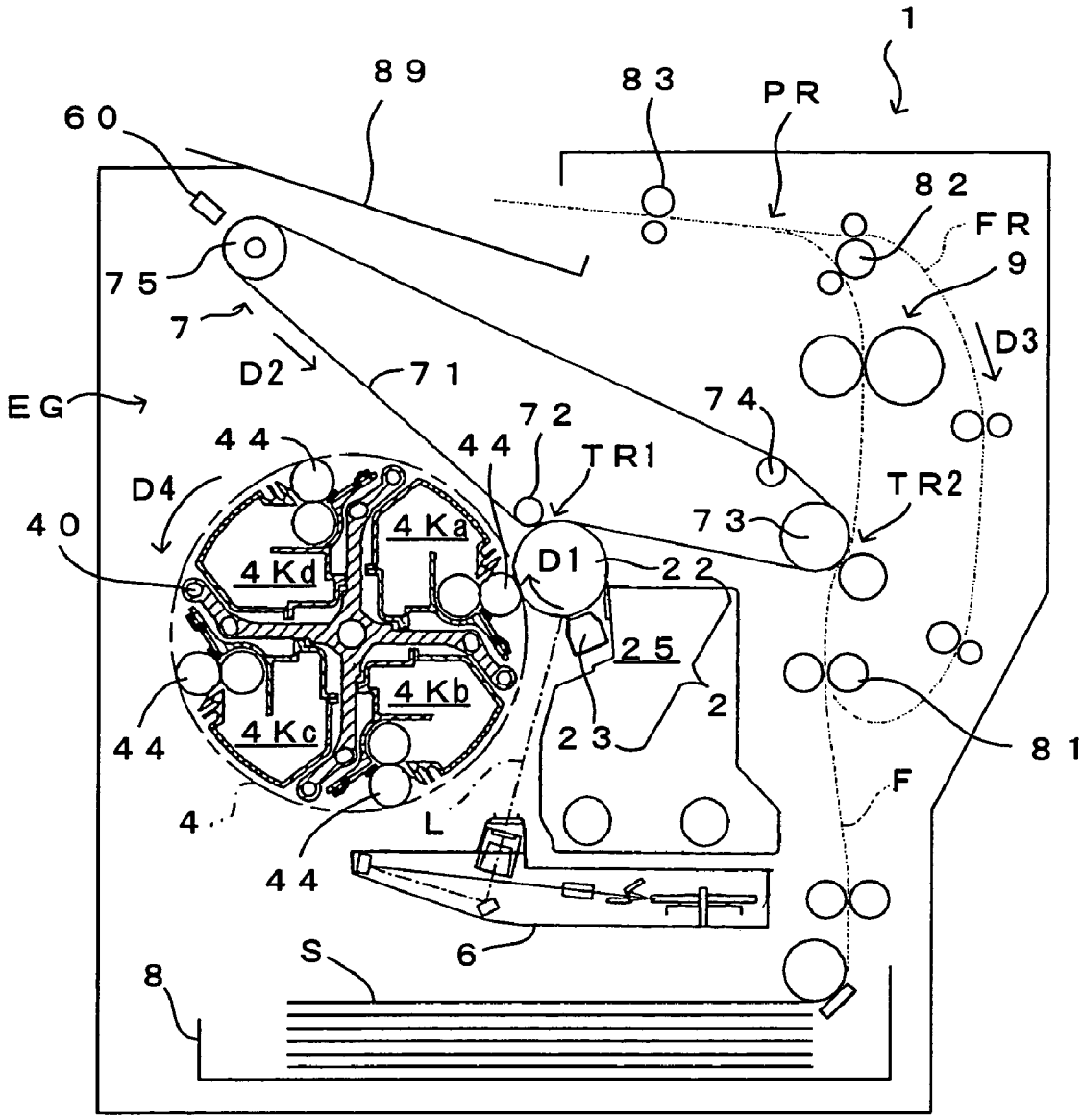
FIG. 1 is a diagram which shows an exemplary image forming apparatus to which the invention may preferably be applied.
Figure 2:
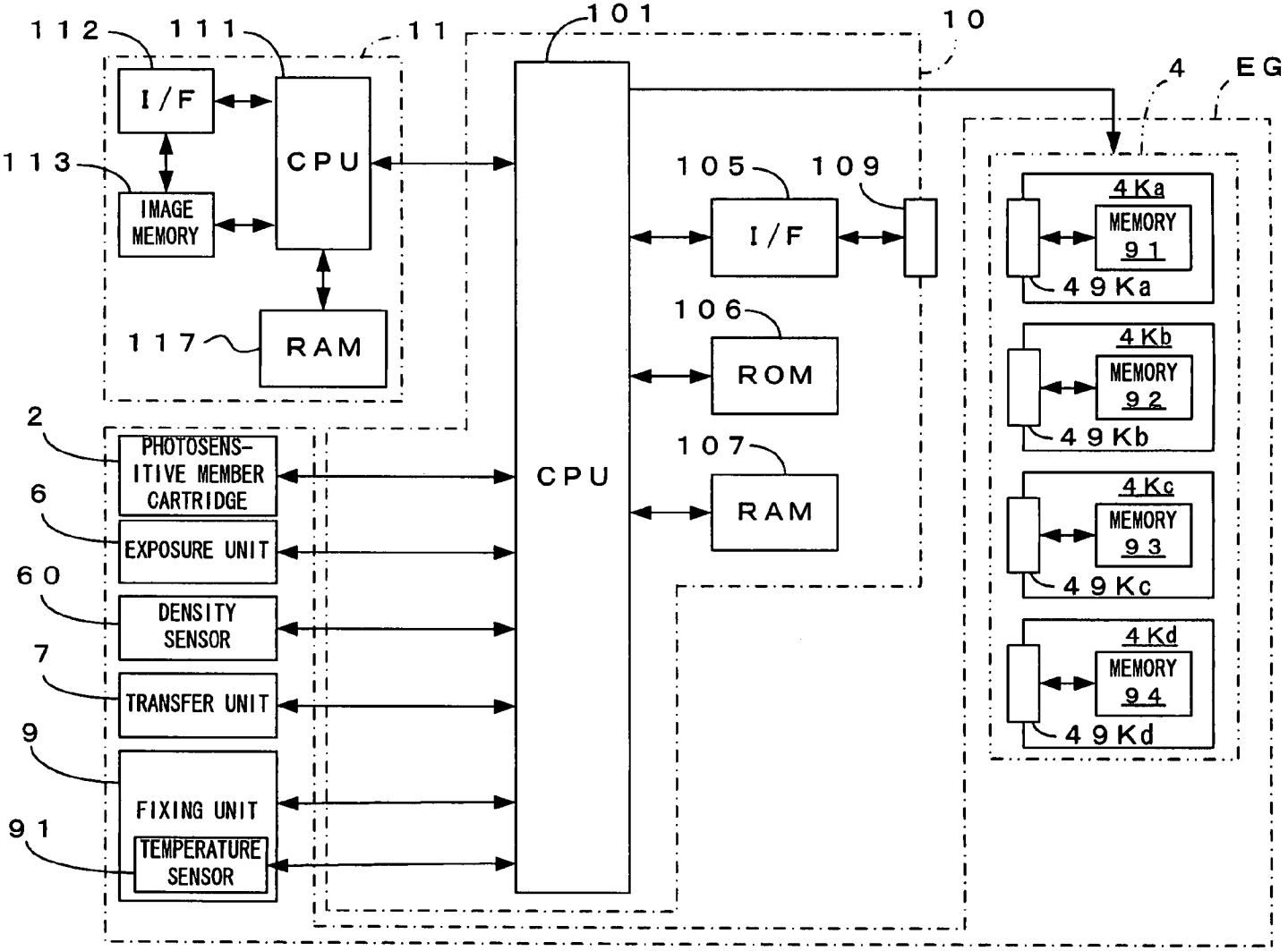
FIG. 2 is a block diagram which shows an electrical arrangement of the image forming apparatus of FIG. 1.

FIG.1 is a diagram which shows an exemplary image forming apparatus to which the invention may preferably be applied. FIG. 2 is a block diagram which shows an electrical arrangement of the image forming apparatus of FIG. 1. This apparatus 1 is an image forming apparatus having four developers mounted thereto and operative to form images, as will be described hereinlater. In a state where the developers storing toners of mutually different colors are mounted, the apparatus is capable of forming a full-color image using these developers and of forming a monochromatic image using one of the developers. In a state where the developers each storing a toner of the same color are mounted, the apparatus functions as an image forming apparatus dedicated to forming monochromatic images of the toner color. The following description is made on a case where the invention is applied to an image forming apparatus exclusive to monochromatic image formation, to which four developers each storing a black toner are mounted.

This image forming apparatus 1 operates as follows. When a print request is applied to a main controller 11 from an external apparatus such as a host computer, the main controller 11 sends a command to an engine controller 10. In response to the command, the engine controller 10 executes a printing operation by controlling individual parts of an engine EG, thereby forming, on a sheet S, a monochromatic image corresponding to an image signal applied from the external apparatus.

The engine EG is provided with a photosensitive member 22 which is rotatable in a direction D1 of an arrow in FIG. 1. A charger unit 23, a rotary developing unit 4 and a cleaner 25 are disposed around the photosensitive member 22 along the rotational direction D1 thereof. The charger unit 23 is applied with a predetermined charging bias for uniformly charging an outer peripheral surface of the photosensitive member 22 to a predetermined surface potential. The cleaner 25 operates to remove a remaining toner from the surface of the photosensitive member 22 after primary image transfer, and to collect the removed toner in a waste toner tank disposed therein. The photosensitive member 22, the charger unit 23 and the cleaner 25 integrally constitute a photosensitive member cartridge 2. The photosensitive member cartridge 2 as a unit is adapted to be removably mounted to a main body of the apparatus 1.

A light beam L from an exposure unit 6 is irradiated on the outer peripheral surface of the photosensitive member 22 thus charged by the charger unit 23. The exposure unit 6 irradiates the light beam L on the photosensitive member 22 according to the image signal applied from the external apparatus, thereby forming, on the photosensitive member 22, an electrostatic latent image corresponding to the image signal.

The electrostatic latent image thus formed is developed with toner by means of the developing unit 4. The developing unit 4 includes: a support frame 40 rotatable about a rotary shaft perpendicular to the drawing surface of FIG.1;

four developers 4Ka to 4Kd each designed as a cartridge removably mountable in the support frame 40 and each containing therein the black toner; and a rotary driver (not shown) for driving these components into unitary rotation. The developing unit 4 is controlled by the engine controller 10. Based on a control command from the engine controller 10, the developing unit is driven into rotation in a direction of D4 in FIG. 1. In the meantime, any one of the developers 4Ka to 4Kd is selectively positioned at a predetermined development position to be abutted against the photosensitive member 22 or to oppose the photosensitive member via a predetermined gap therebetween. Then, a developing roller 44 disposed in the developer thus positioned supplies the toner to the surface of the photosensitive member 22. Thus, the electrostatic latent image on the photosensitive member 22 is developed with the toner contained in the developer so positioned at the development position.

The toner image thus developed by the developing unit 4 is primarily transferred onto an intermediate transfer belt 71 of a transfer unit 7 at a primary transfer region TR1. The transfer unit 7 includes: the intermediate transfer belt 71 entrained about a plurality of rollers 72 to 75; and a driver driving the roller 73 into rotation thereby rotating the intermediate transfer belt 71 in a predetermined rotational direction D2. The transfer unit 7 transfers the black toner image formed on the photosensitive member 22 onto the intermediate transfer belt 71 and then, secondarily transfers the toner image onto a sheet S which is taken out from a cassette 8 on a per-sheet basis and transported along a transport path F to a secondary transfer region TR2.

In this process, timing of feeding the sheet S to the secondary transfer region TR2 is controlled so as to transfer the image on the intermediate transfer belt 71 onto the sheet S exactly at a predetermined position. Specifically, a gate roller 81 is provided on the transport path F at place upstream from the secondary transfer region TR2. The gate roller 81 is rotated as timed to the revolving movement of the intermediate transfer belt 71, whereby the sheet S is fed into the secondary transfer region TR2 in a predetermined timing.

The sheet S thus formed with the monochromatic image is transported to a fixing unit 9, where the toner image is fixed to the sheet S. The fixing unit 9 is provided with a temperature sensor 91, whereas a heater (not shown) is adjusted to a predetermined fixing temperature under control based on a detection result given by the sensor 91. The sheet S is further transported via a pre-discharge roller 82 and a discharge roller 83 to a discharge tray 89 disposed at a top side portion of the apparatus body. In a case where images are formed on the both sides of the sheet S, the rotation of the discharge roller 83 is reversed at the time when a trailing end of the sheet S having the image thus formed on one side thereof is transported to a reversal position PR downstream from the pre-discharge roller 82. Thus, the sheet S is transported along a reversal transport path FR in a direction of an arrow D3. Thereafter, the sheet S is loaded again on the transport path F at place upstream from the gate roller 81. At this time, the sheet S is positioned such that the opposite side from the side to which the image is previously transferred is pressed against the intermediate transfer belt 71 for image transfer in the secondary transfer region TR2. The images may be formed on the both sides of the sheet S in this manner.

Furthermore, a density sensor 60 is disposed in proximity of the roller 75. The density sensor 60 confronts a surface of the intermediate transfer belt 71 so as to measure, as needed, the density of the toner image formed on an outside surface of the intermediate transfer belt 71. Based on the measurement results, the apparatus adjusts the operating conditions of the individual parts thereof, the operating conditions affecting the image quality. The operating conditions include, for example, a developing bias applied to each developer, the intensity of the light beam L and the like.

The density sensor 60 employs, for example, a reflective photosensor for outputting a signal corresponding to an image density of a region of a given area defined on the intermediate transfer belt 71. A CPU 101 is adapted to detect image densities of individual parts of the toner image on the intermediate transfer belt 71 by periodically sampling the output signals from the density sensor 60 as revolvably moving the intermediate transfer belt 71.

As shown in FIG. 2, the developers 4Ka to 4Kd are provided with memories 91 to 94, respectively, each memory storing data related to the production lot and operation history of the developer, the residual quantity of toner contained therein, and the like. The developers 4Ka to 4Kd are further provided with wireless communication devices 49Ka, 49Kb, 49Kc, 49Kd, respectively. Whenever necessary, these communication devices selectively perform non-contact data communications with a wireless communication device 109 disposed in the apparatus body. Thus, data transmission/reception via an interface 105 is carried out between the CPU 101 and each of the memories 91 to 94, so that the CPU can manage a variety of information items, such as a consumable article, related to the developer of interest. The embodiment employs electromagnetic means such as a wireless communication device for carrying out the non-contact data transmission/reception. Alternatively, the apparatus body and the individual developers may be provided with connectors and the like so that a respective pair of corresponding connectors may be mechanically fitted with each other for carrying out data transmission/reception between them.

In FIG. 2, a reference numeral 113 represents an image memory disposed in the main controller 11 for storing an image supplied from the external apparatus, such as the host computer, via an interface 112. A reference numeral 117 represents a RAM for temporarily storing operation results given by a CPU 111 and other data. A reference numeral 106 represents a ROM for storing an operation program executed by the CPU 101, control data used for controlling the engine EG, and the like. A reference numeral 107 represents a RAM for temporarily storing operation results given by the CPU 101 and other data.

Prior to the printing operation, the apparatus of the aforementioned arrangement need to decide which of the four developers is used, by referring to a proper criterion. The reason is as follows. In the full-color image forming apparatus, a developer to be used is automatically decided according to a color of a toner image to be formed. In contrast, the apparatus exclusive to monochromatic image formation includes plural developers each storing the toner of the same color and hence, the same image may be formed using any of these developers.

Furthermore, there may be a case where it is required to perform a print preparatory process on each of the developers prior to the execution of the printing operation. For instance, the image forming apparatus of this type may encounter a phenomenon that if the apparatus is left standstill for long, periodical density variations occur on images formed in an initial stage of the image forming operation performed after the standstill period (this phenomenon is referred to as "shutdown-induced banding" herein). Such density variations result from the toner left carried on the developing roller for a long time. This trouble may be eliminated by rotating the developing roller in the developer through a number of revolutions before the developer is used for the printing operation. Hence, the apparatus is arranged to perform, as required, an operation of rotating the developing roller in each of the developers by a predetermined quantity (this operation is referred to as "agitation operation" herein). More specifically, a rest time between the end of device use in the last performed printing operation or print preparatory process, and the current point of time is determined for each of the developers. When the rest time reaches a predetermined value, a flag (agitation requiring flag) is set with respect to the developer of interest, the flag indicating the need for the agitation operation. This flag may be provided, for example, in a register of the CPU 101 or in a region of the RAM 107 disposed in the engine controller 10. As required, the flag may also be provided in the RAM 117 of the main controller 11. The same applies to a density control-requiring flag to be described hereinlater.

The rest time may be defined as an elapsed time between the stop of the drivable rotation of the developing roller 44 in the developer of interest and the current point of time. In a timing to be described hereinlater, the agitation operation is performed on the developer related to this agitation requiring flag thus set, so as to prevent the occurrence of the shutdown-induced banding. When the agitation operation is performed, the flag is reset.

As the developer is used longer, the deterioration thereof proceeds to vary the image density. Accordingly, there may be a case where the operating conditions of the individual parts of the apparatus need be changed when the image forming operation is performed using such a developer. In this apparatus, therefore, a flag (density-control requiring flag) indicating the need for an operation of controlling the image density to a predetermined density by readjusting the operating conditions is set with respect to the developer in question when information indicative of the service life of the above developer, or either of the residual toner quantity and the rotation time of the developing roller reaches a predetermined threshold value. In a timing to be described hereinlater, a density control operation is performed on the developer related to this density-control requiring flag thus set. Thus, the image density variations are suppressed. When the density control operation is performed, the flag is reset.

The aforesaid threshold value of the residual toner quantity or the developing-roller rotation time, which triggers the density control operation, is not necessarily one value. That is, when the residual toner quantity or the developing-roller rotation time reaches a certain threshold value so that the density control operation is performed, a succeeding threshold value is defined. When the residual toner quantity or the developing-roller rotation time reaches the succeeding threshold value, the density control operation is performed again. In this manner, a plural number of density control operations are repeated until one developer reaching the end of its useful life is dismounted from the apparatus. This enables the apparatus to maintain the image quality consistently as accommodating the time-varying characteristics of the developer.

Further, the developer may be arranged such that the information items indicative of the conditions of the developer, such as the residual toner quantity and developing-roller rotation time, are stored in a storage device provided therein (e.g., the non-volatile memory 91 provided in the developer 4Ka), whereas the CPU 101 reads out/writes such information items from/into the storage device whenever necessary. Thus, the information on each developer accompanies the developer itself Therefore, the conditions of every one of the developers may be managed properly even though some developer once dismounted is re-mounted to the apparatus or some developer used in another apparatus is mounted to this apparatus.

Thus, this image forming apparatus is adapted to form high quality images in a consistent manner by performing the print preparatory process prior to the printing operation whenever necessary. It is noted however that the contents of the print preparatory process are not always the same but may be subjected to change as needed when the process is carried out. Preferred modes of the print preparatory process vary depending upon the circumstances or upon user demands. Hence, any process that satisfies the need may be selected from the following embodiments and be carried out.

Basic Principles of First to Sixth Embodiments

Figure 3:
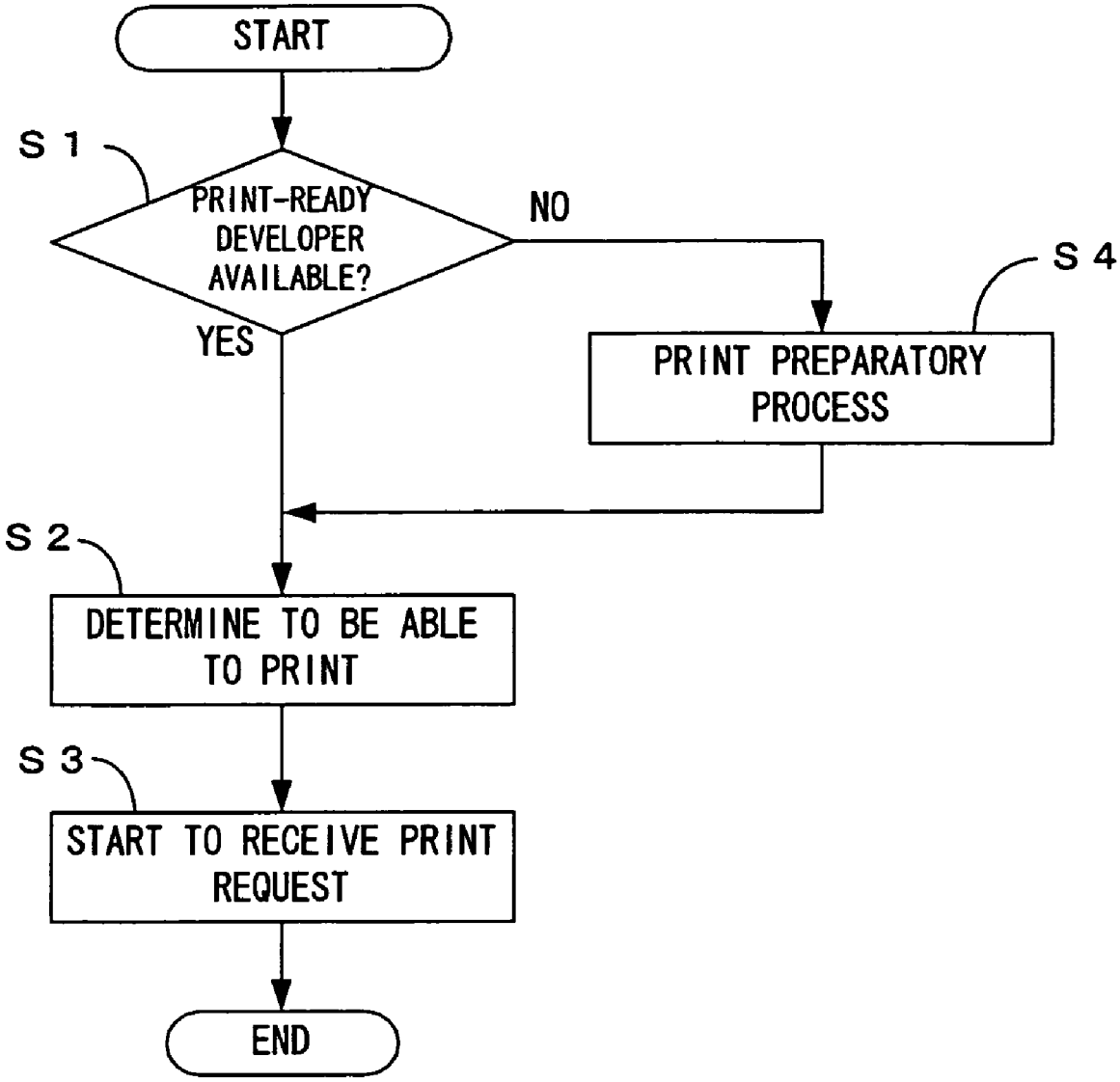
FIG. 3 is a chart which shows the basic principles of first to sixth embodiments hereof.

FIG. 3 is a chart which shows the basic principles of first to sixth embodiments hereof. According to these embodiments, each of the developers mounted in the developing unit 4 is checked at a proper time so as to determine whether the developer can be directly used in the printing operation or not (Step S1). It is noted here that "the developer which can be directly used in the printing operation (hereinafter, abbreviated as print-ready developer)" means one which has a residual toner quantity of more than a predetermined level and which is already subjected to the aforesaid agitation operation and the density control operation, thus no more requiring these operations to be performed prior to the printing operation (that is, both the agitation requiring flag and the density-control requiring flag are reset).

In a case where there is at least one print-ready developer, the apparatus is determined to be able to perform the printing operation (Step S2) and starts to receive a print request from external source (Step S3). Thus, an unnecessary print preparatory process can be omitted by immediately carrying out the printing operation when there is at least one print-ready developer. The deterioration of the apparatus and the consumption of the toner are accelerated if the aforesaid agitation operation or the density control operation is performed needlessly. However, the deterioration of the apparatus and the consumption of the toner may be decreased by omitting the unnecessary operation. Furthermore, the apparatus is capable of quickly performing the printing operation in response to the print request from external source, thus achieving a reduced first print time.

In a case where there is no print-ready developer, on the other hand, a predetermined print preparatory process is performed on at least one developer so as to shift the device to the print-ready state (Step S4). Subsequently, the print request from external source is received. The contents of the print preparatory process in this case may be as follows, for example.

First Embodiment

According to the print preparatory process (first print preparatory process) of the first embodiment, a predetermined one of the four developers mountable to the apparatus is defined as "priority developer". Then, a process is performed for shifting the priority developer to the print-ready state. The priority developer may be decided by, for example, selecting the first one to reach the development position when the developing unit 4 is rotated from a predetermined home position (HP). The description is made here by way of example where the developer 4Ka is decided as the priority developer.

Figure 4:
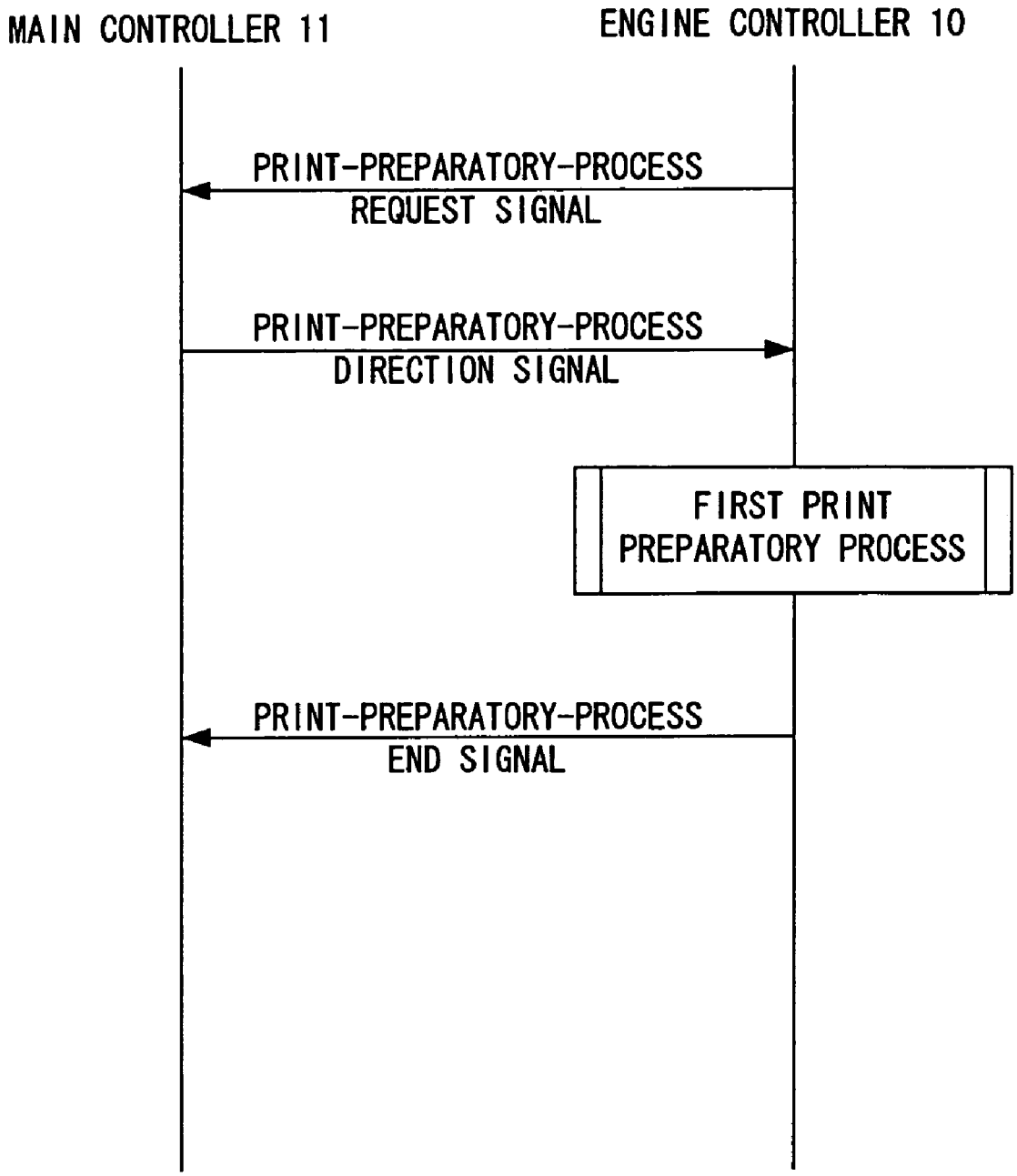
FIG. 4 is a chart which shows a timing of performing the first print preparatory process.

FIG. 4 is a chart which shows a timing of performing the first print preparatory process. In this embodiment, the engine controller 10 outputs a print-preparatory-process request signal, as shown in FIG. 4. The engine controller 10 outputs the print-preparatory-process request signal when at least one of the aforesaid agitation requiring flag and density-control requiring flag is set with respect to every one of the developers mounted in the developing unit 4. In other words, when none of the developers mounted in the developing unit 4 is the aforesaid "print-ready developer" any longer, the print-preparatory-process request signal is outputted from the engine controller 10. Receiving this signal, the main controller 11 outputs a print-preparatory-process direction signal to the engine controller 10. The content of the direction is to "perform the first print preparatory process on the priority developer". Receiving the print-preparatory-process direction signal, the engine controller 10 performs the first print preparatory process shown in FIG. 5 on the developer 4Ka based on the content of the direction.

Figure 5:
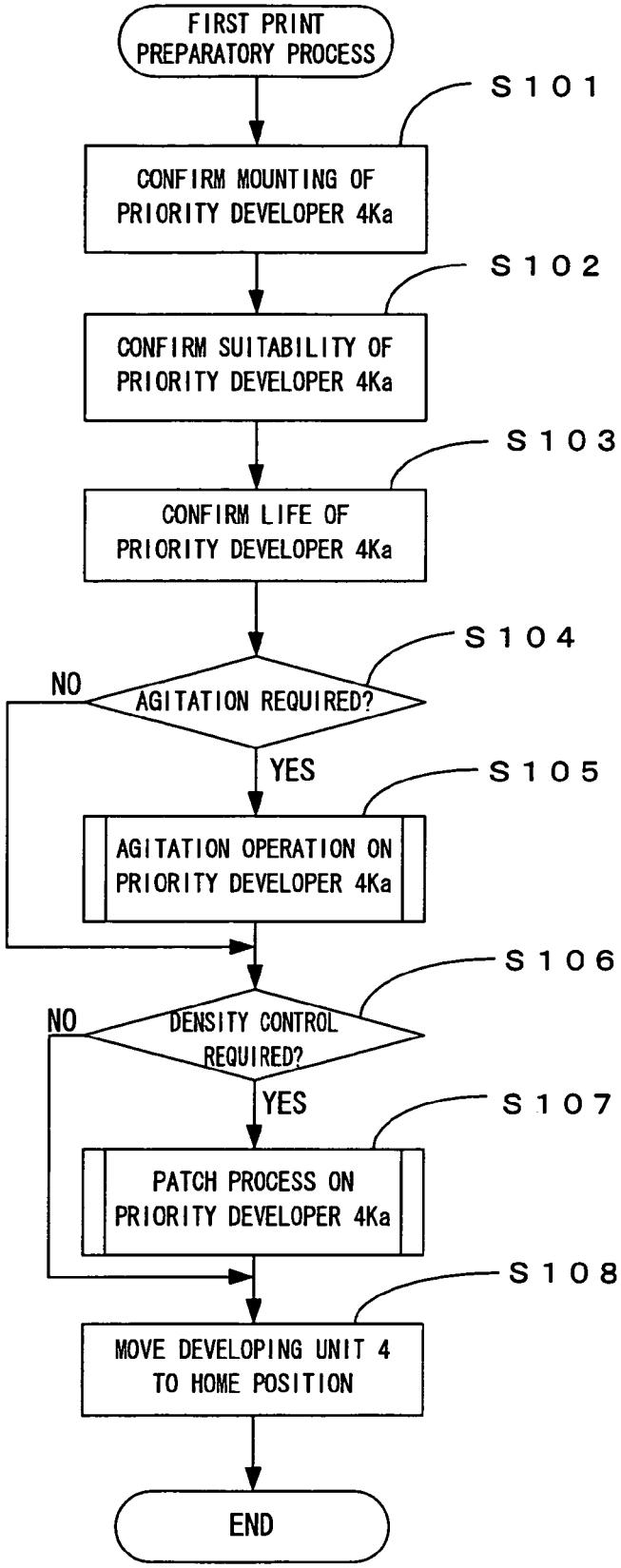
FIG. 5 is a flow chart which shows the steps of the first print preparatory process.

FIG. 5 is a flow chart which shows the steps of the first print preparatory process. In the first print preparatory process, an operation of confirming the mounting of the priority developer 4Ka is first performed (Step S101). The mounting confirmation operation is to make sure that the developer is assuredly mounted in the support frame 40 of the developing unit 4. Specifically, the confirmation operation is carried out by performing data transmission/reception between the CPU 101 and the memory mounted in the developer via wireless communications between the apparatus body and each developer. As a matter of course, the mounting confirmation may be made by a contact system using a limit switch or the like, instead of the non-contact system such as the wireless communications.

Subsequently, a suitability confirmation operation is performed on the developer (Step S102). This suitability confirmation operation is performed based on the information retrieved from the memory mounted in the developer for confirming that the developer mounted in the support frame 40 of the developing unit 4 contains the black toner therein. Although this apparatus is also capable of forming color images by using developers storing toners of the other colors than black, this embodiment uses the apparatus exclusively as the black monochromatic image forming apparatus. Therefore, the embodiment performs the suitability confirmation operation to prevent an inadvertent use of a yellow, cyan or magenta developer.

Next, a life confirmation operation is performed (Step 103). This life confirmation operation is to confirm that a required amount of toner for performing the printing operation remains in the developer mounted in the support frame 40 of the developing unit 4. By performing the life confirmation operation, defects such as density variations or thin spots are prevented from occurring on images formed by the printing operation.

Subsequently, whether the priority developer 4Ka requires the agitation operation or not is determined (Step S104). Whether or not the agitation operation is required may be determined based on whether or not the agitation requiring flag is set with respect to the developer of interest. If the agitation operation is required, the agitation operation shown in FIG. 6 is performed (Step S105).

Figure 6:
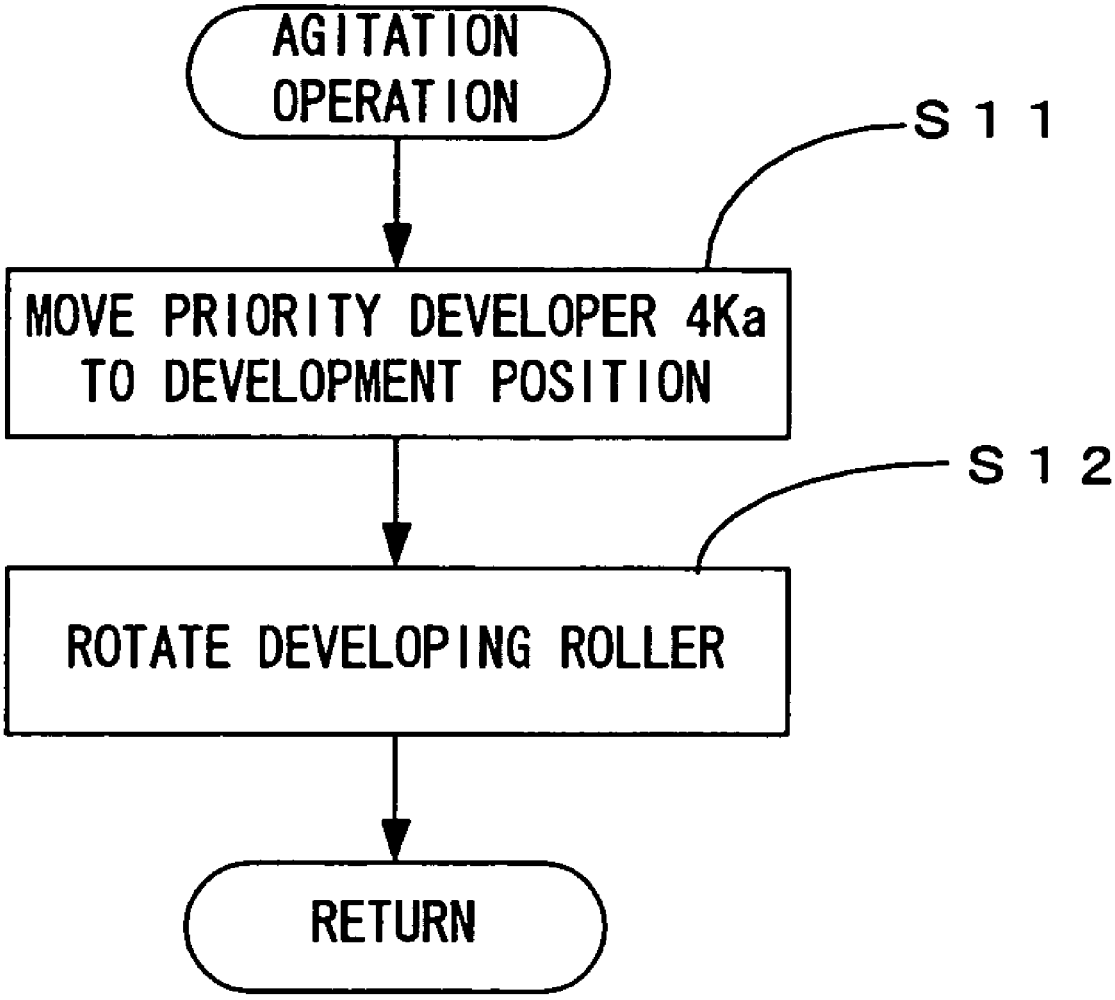
FIG. 6 is a flow chart which shows the steps of the agitation operation.

FIG. 6 is a flow chart which shows the steps of the agitation operation. In this agitation operation, the developer 4Ka as a subject of the operation is moved and positioned at the development position (Step S1). Thus, the developing roller 44 disposed in the developer 4Ka is mechanically connected with the rotary driver of the apparatus body. The rotary driver rotates the developing roller 44 through at least one revolution (Step S12), thereby refreshing a toner layer on the surface of the developing roller 44.

Figure 7:
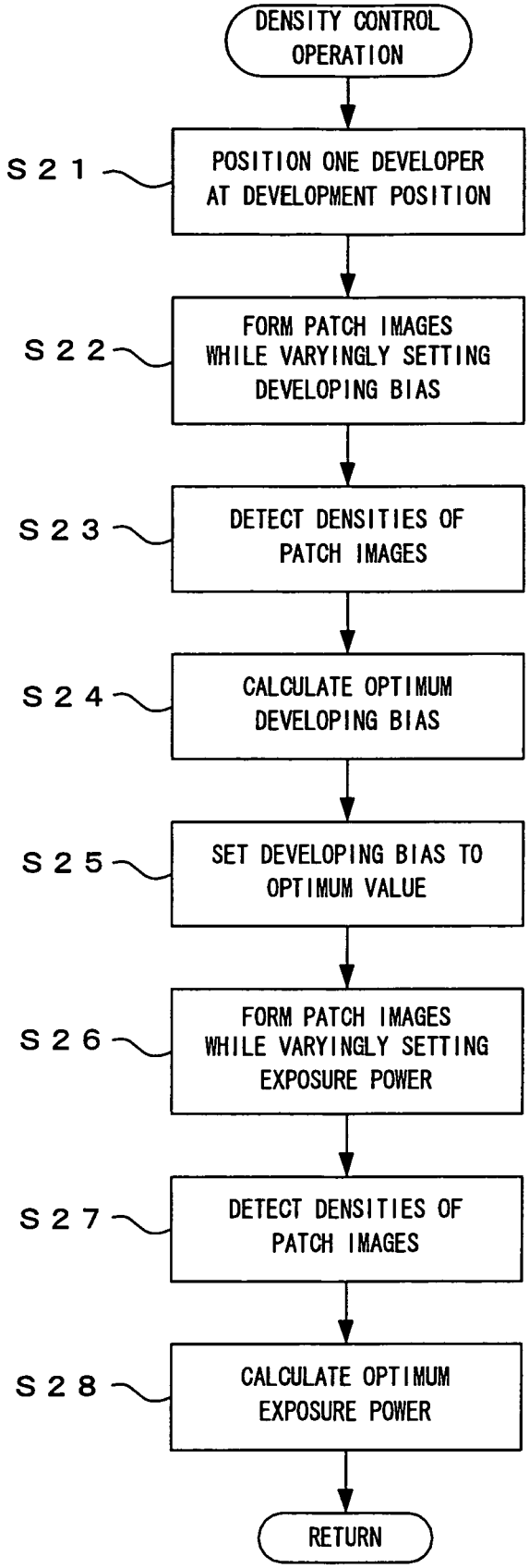
FIG. 7 is a flow chart showing the steps of the density control operation.

When the agitation operation is completed, or when the agitation operation is omitted, then determination is made as to whether the priority developer 4ka requires the density control operation or not (Step S106). Whether or not the device requires the density control operation may be determined based on whether or not the density-control requiring flag is set with respect to the developer of interest. If the density control operation is required, the density control operation shown in FIG. 7 is carried out (Step S107). Subsequently, the developing unit 4 is rotated to be returned to the home position (HP) and the process is terminated (Step S108).

FIG. 7 is a flow chart showing the steps of the density control operation. The density control operation is performed as follows for the purpose of maintaining a consistent quality of images formed by performing the image forming operation. Patch images are formed as setting the operation conditions of the individual parts of the apparatus in various ways. Densities of the patch images are detected so that the operation conditions may be adjusted based on the detection results. In this process, developing bias and exposure power of the light beam L out of the operation parameters deciding the operating conditions of the individual parts of the apparatus are adjusted, the developing bias and exposure power functioning as control factors affecting the image quality. There are also known may other various operation parameters functioning as the control factors, whereas a large number of techniques are known in the art, which pertain to the principles and methods of controlling the image quality based on these parameters. Since these techniques are also applicable to the embodiments hereof, a brief description is made here only on the flow of the process.

First, the developer as the subject of the operation is positioned at the development position opposite the photosensitive member 22 (Step S21). Subsequently, the developing bias applied to the developer of interest is varied in multiple steps while each of the patch images of a predetermined pattern, such as solid image, is formed at each of the bias values (Step S22). The densities of the patch images are detected by the density sensor 60 (Step S23). An optimum value of the developing bias, which permits the patch images to achieve a predetermined target density, is calculated based on the detection results (Step S24).

Subsequently, the exposure power is adjusted. The developing bias is set to the optimum value thus determined (Step S25). Half-toned images, as patch images, are formed as varying the exposure power in multiple steps (Step S26). The densities of the resultant patch images are detected by the density sensor 60 (Step S27). An optimum value of the exposure power, which permits the patch images to achieve the predetermined target density, is calculated based on the detection results (Step S28).

The priority developer 4Ka is shifted to the print-ready state by performing the first preparatory process arranged as described above. Subsequently, the engine controller 10 outputs to the main controller 11 a signal indicative of the completion of the print preparatory process, as shown in FIG. 4. When a print request from external source is applied thereafter, the main controller 11 can quickly form images by performing the printing operation in response to the request. In this process, the optimum values of the developing bias and exposure power related to the priority developer are determined and hence, the printing operation is carried out under the optimum operation conditions. Therefore, the image forming apparatus, to which the embodiment is applied, is adapted to form consistent images of a predetermined quality.

Furthermore, since only the priority developer is subjected to the process, the first print preparatory process may be completed in a short time. Even when the print request is applied to the main controller 11 just prior to the execution of the first print preparatory process or during the first print preparatory process, for example, wait time between the image formation and the output of the image (first print time) may be shortened. Thus, this embodiment of the invention is preferred in case of that the first print time must be shortened.

Second Embodiment

In a print preparatory process according to the second embodiment (second print preparatory process), operations for shifting all the developers mounted to the apparatus to the print-ready state are performed. Although such a process requires a relatively long period of time, all the developers are in the print-ready state when the process is completed. Hence, the process permits the apparatus to form a relatively large number of images uninterruptedly. That is, this embodiment is preferred when a large number of images are formed continuously.

Figure 8:
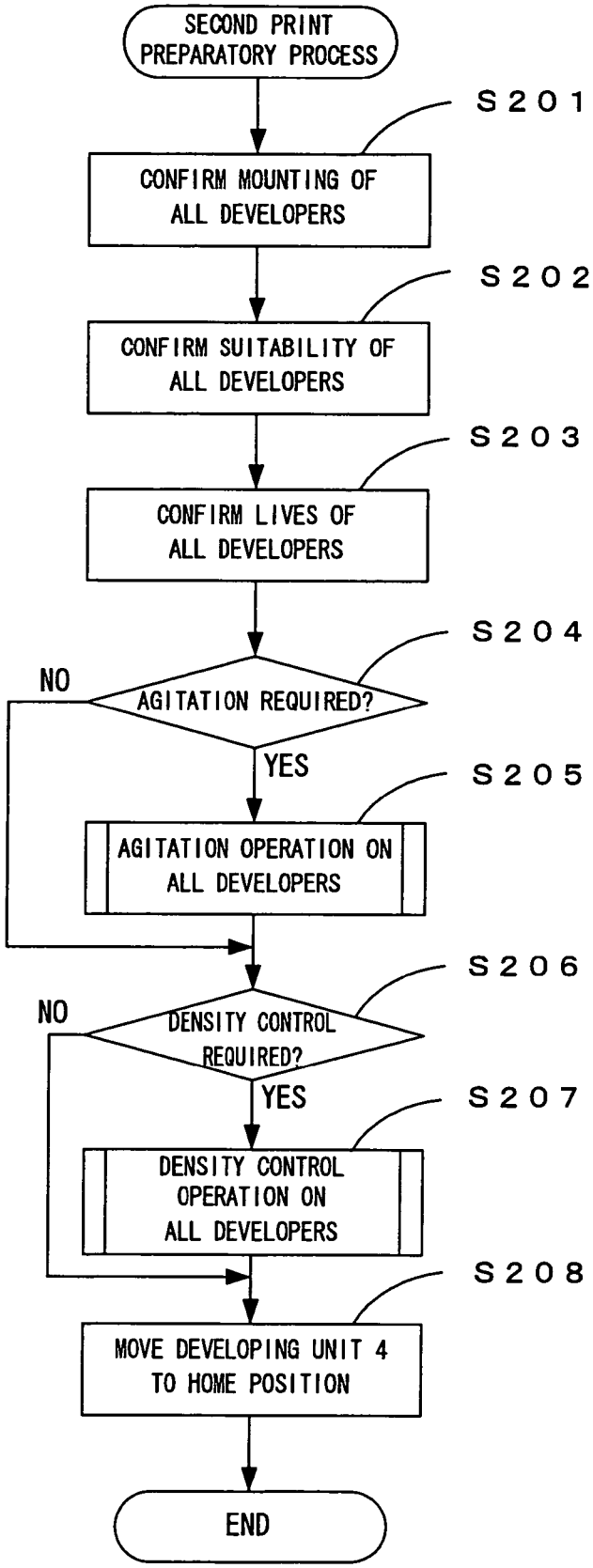
FIG. 8 is a flow chart which shows the steps of the second print preparatory process.

FIG. 8 is a flow chart which shows the steps of the second print preparatory process. A basic arrangement of the second print preparatory process (Step S201 to S208) is the same as that of the first print preparatory process (FIG. 5). However, only the priority developer is subjected to the first print preparatory process, whereas the second print preparatory process subjects all the developers to the mounting confirmation operation (Step S201), the suitability confirmation operation (Step S202), the life confirmation operation (Step S203), the agitation operation (Step S205) and the density control operation (Step S206).

Figure 9:
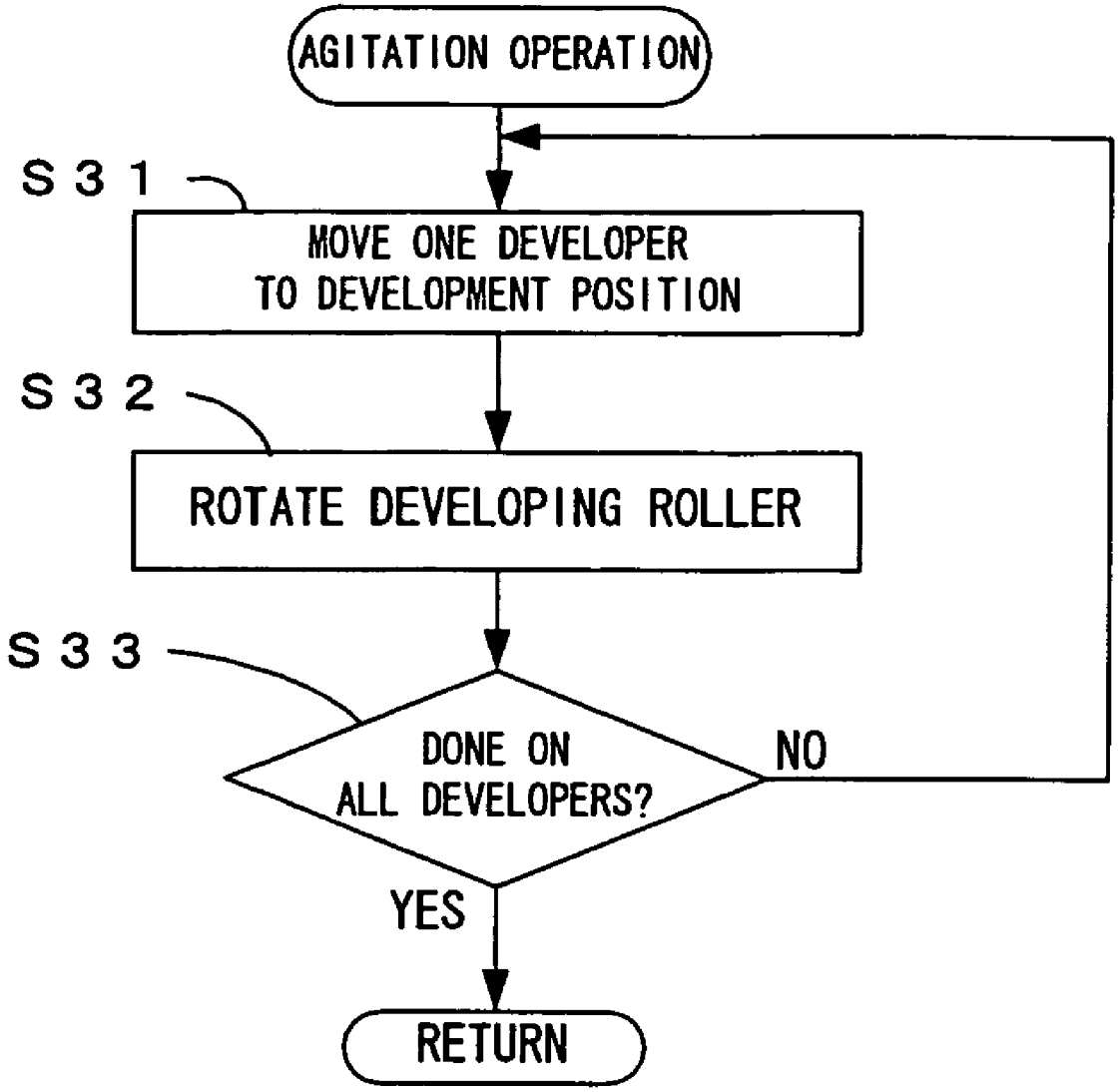
FIG. 9 is a flow chart which shows the steps of the agitation operation performed on plural developers.

FIG. 9 is a flow chart which shows the steps of the agitation operation performed on plural developers. In this agitation operation, one of the developers mounted in the developing unit 4 is moved and positioned at the development position (Step S31). Subsequently, the developing roller disposed in the developer positioned at the development position is rotated through at least on revolution (Step S32), thereby refreshing the toner layer on the surface of the developing roller 44. These steps are the same as those of the agitation operation of the aforementioned first embodiment. In a case where the plural developers are subjected to the operation, the above steps are repeated in cycles as making changeover of the developers till the operations on all the developers are completed (Step S33).

Figure 10:
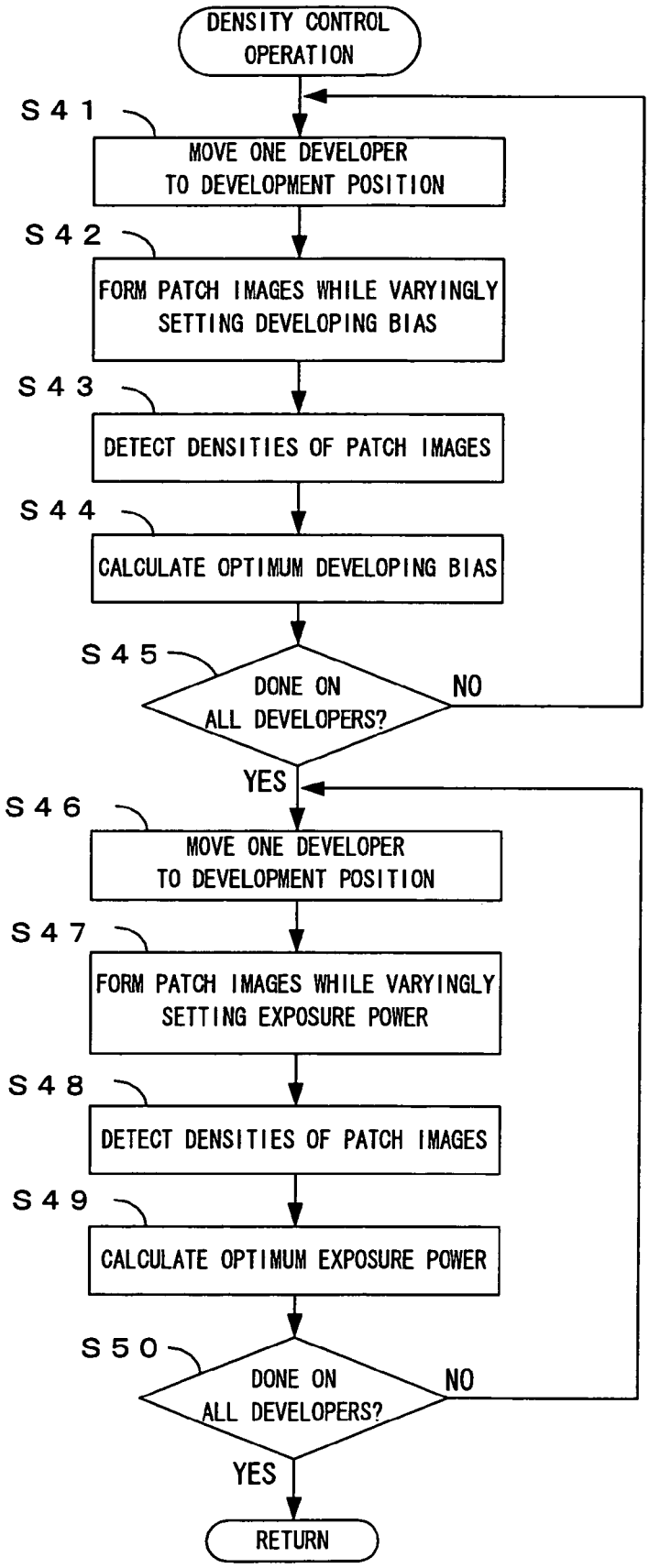
FIG. 10 is a flow chart which shows the steps of the density control operation performed on the plural developers.

FIG. 10 is a flow chart which shows the steps of the density control operation performed on the plural developers. In the density control operation in this case, one of the developers to be subjected to the operation is first positioned at the development position (Step S41). Subsequently, the developing bias applied to the developer of interest is varied in multiple steps while each of the patch images of a predetermined pattern, such as solid image, is formed at each of the bias values (Step S42). The densities of the patch images are detected by the density sensor 60 (Step S43). An optimum value of the developing bias, which permits the patch images to achieve a predetermined target density, is calculated based on the detection results (Step S44).

Before proceeding to the adjustment of the exposure power, the developing biases for the other developers are adjusted. Specifically, till completion of the adjustment of the developing biases for all the developers as the subjects of the process (Step S45), the adjustment of the developing bias is performed on the individual developers as shifting the respective developers to the development position in turn (more exactly, the changeover of the developers is possible when the patch image formation is completed). The reason is as follows. It is desirable that the patch images for exposure power adjustment are formed at the optimum developing bias. However, it takes a certain length of time to detect the densities of the patch images formed on the intermediate transfer belt 71 by means of the density sensor 60 and to calculate the optimum value of the developing bias. Hence, it is required to let the formation of the patch images for exposure power adjustment wait until the optimum developing bias is determined. This results in a lengthened process time. If the developing biases for the other developers are adjusted prior to the adjustment of the exposure power, such a wait time is eliminated so that the process time may be shortened.

Hence, the adjustment of the developing biases for all the developers as the subjects of the process is followed by the adjustment of the exposure power for the respective developers (Steps S46 to S50). When the patch images are formed (Step S47), the developing bias is set to the already determined optimum value.

At completion of the second print preparatory process thus arranged, the engine controller 10 outputs the print-preparatory-process end signal to the main controller 11, just as in the first embodiment. Subsequently, the main controller 11 is able to perform the printing operation in response to the print request from external source.

According to this embodiment as described above, the second print preparatory process is conducted for shifting all the developers mounted in the developing unit 4 into the print-ready state. Therefore, in a case where the print request is applied after completion of the second print preparatory process, the following advantage is offered. If during the printing operation using the developer 4Ka of the developers 4Ka to 4Kd mounted in the developing unit 4, the toner in the developer 4Ka runs short to continue the printing operation, for example, the developer may immediately be switched to the next developer 4Kb to continue the printing operation. Similarly, when the toner in the developer 4Kb runs short, the developer may be switched to the next developer 4Kc. Therefore, the image forming apparatus, to which the second embodiment is applied, is capable of producing a large volume of monochromatic prints efficiently.

Figure 11:
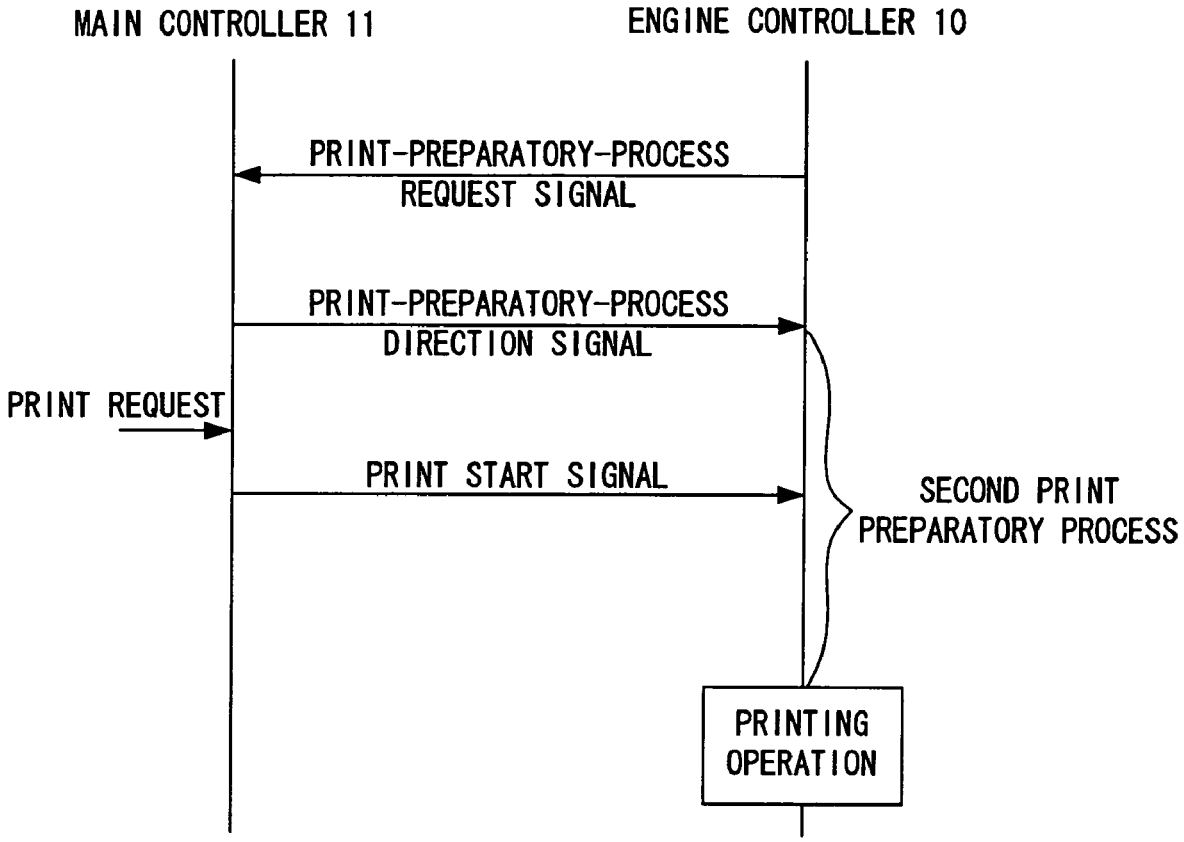
FIG. 11 is a chart which shows an example of the relation between the second print preparatory process and the timing of occurrence of a print request.

FIG. 11 is a chart which shows an example of the relation between the second print preparatory process and the timing of occurrence of a print request. Consider a case where a print request is applied to the main controller 10 while the engine controller 10 is carrying out the second print preparatory process, as shown in FIG. 11. In this case, the main controller 11 outputs to the engine controller 10 a print start signal directing to start the printing operation. However, the engine controller 10 does not start the printing operation at once but waits for the completion of the second print preparatory process before starting the printing operation. Accordingly, the start of the printing operation is somewhat delayed. As described above, however, the embodiment is designed to shorten the process time and hence, the delay is rather short. Furthermore, once the printing operation is started, a large number of images can be formed continuously and at a high throughput.

Furthermore, this embodiment may take the following approach to shorten the first print time. The CPU 101 disposed in the engine controller 10 permits the acceptance of an interrupt request from the main controller 11 at the time when at least one developer is brought into the print-ready state by performing the print preparatory process. In a case where the main controller receives the print request from external source during a time period between the output of the print-preparatory-process direction signal and the receipt of the print-preparatory-process end signal (during the execution of the second print preparatory process in the engine controller 10), the main controller outputs the print start signal to the engine controller 10. This print start signal functions as an interrupt request signal to the engine controller 10. In a case where the engine controller is able to accept the interrupt request and is applied with the print start signal from the main controller 11, the engine controller 10 performs an interruption process described as below.

Figure 12:
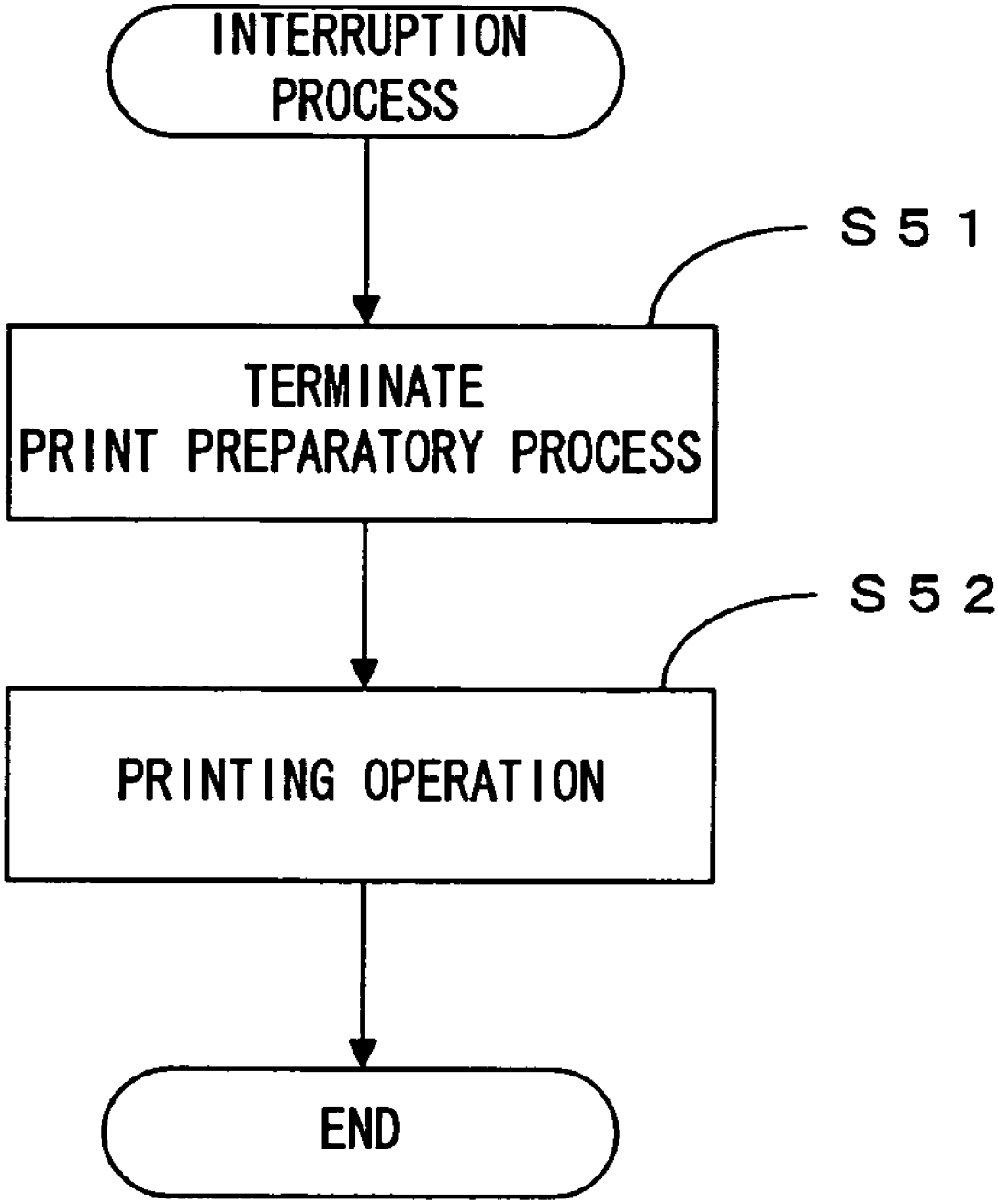
FIG. 12 is a flow chart which shows the steps of the interruption process of the second embodiment.

FIG. 12 is a flow chart which shows the steps of the interruption process of the embodiment. In this process, the ongoing print preparatory operation is first terminated (Step S51). Subsequently, the printing operation is performed (Step S52). In a state where the CPU 101 permits the acceptance of the interrupt request, the developing unit 4 should have at least one developer in the print-ready state. Hence, the printing operation in this case uses such a print-ready developer for forming an image corresponding to the print request. This permits the image to be formed without waiting for the completion of the print preparatory process on all the developers, so that the first print time may be shortened.

In a case where there is no print-ready developer at the time of output of the print start signal, the interruption process is not started until the ongoing print preparatory process has brought any one of the developers into the print-ready state and the acceptance of the interrupt request is started.

Third Embodiment

A print preparatory process according to the third embodiment (third print preparatory process) is conducted for shifting all the developers mounted to the apparatus to the print-ready state, similarly to the second embodiment. This embodiment resembles the second embodiment in that when the print request from external source is applied during the execution of the print preparatory process, the print preparatory process is terminated to perform the printing operation. That is, the third embodiment implements the same function as that of the second embodiment in a different processing mode.

Figure 13:
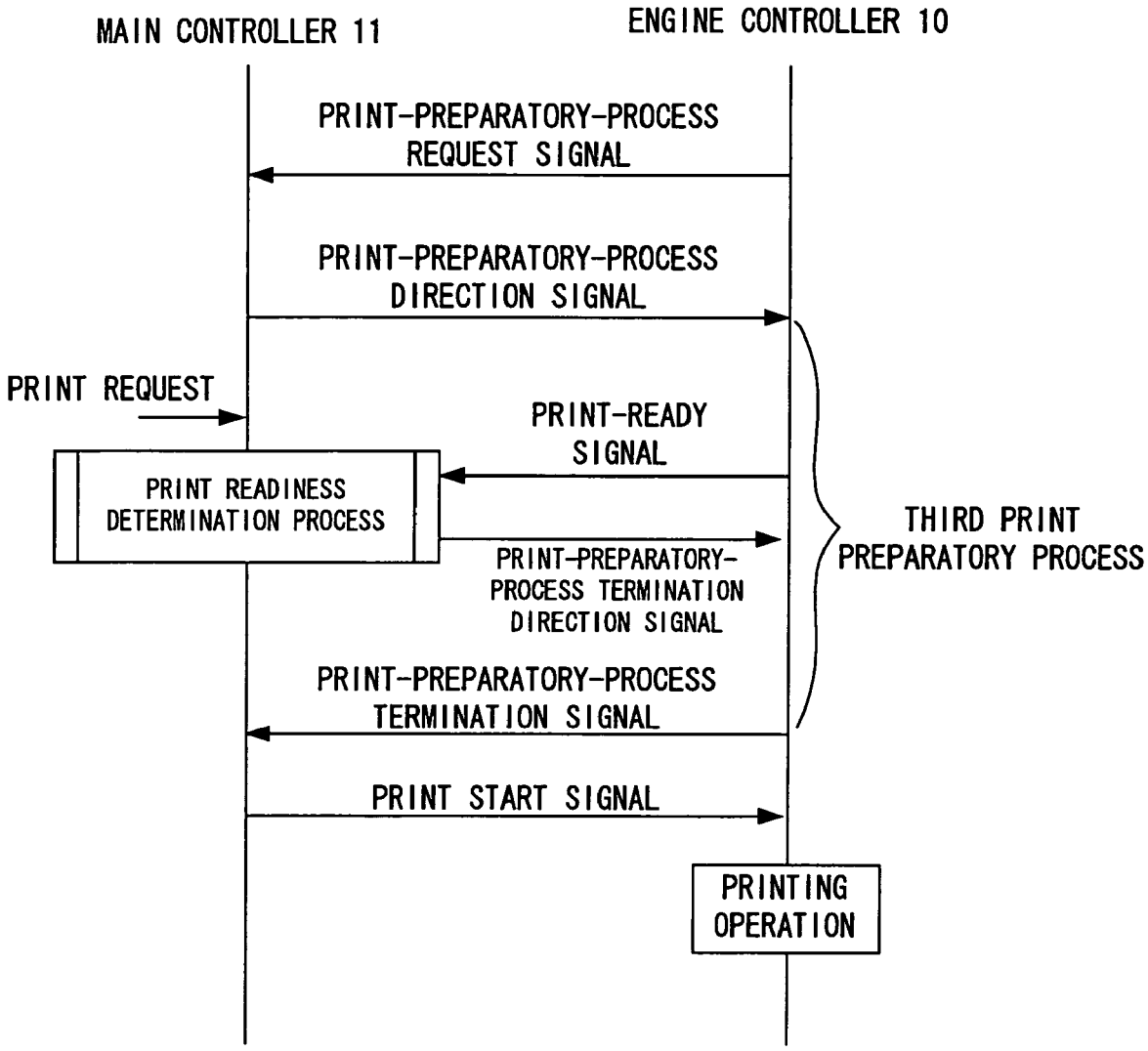
FIG. 13 is a chart which shows an example of timing of performing the third print preparatory process.

FIG.13 is a chart which shows an example of timing of performing the third print preparatory process. In this embodiment, when at least one of the agitation requiring flag and the density-control requiring flag is set with respect to all the developers mounted in the developing unit 4, the engine controller 10 outputs the print-preparatory-process request signal to the main controller 11. Receiving the signal, the main controller 11 outputs the print-preparatory-process direction signal to the engine controller 10, which, in turn, performs the third print preparatory process described as below.

Figure 14:
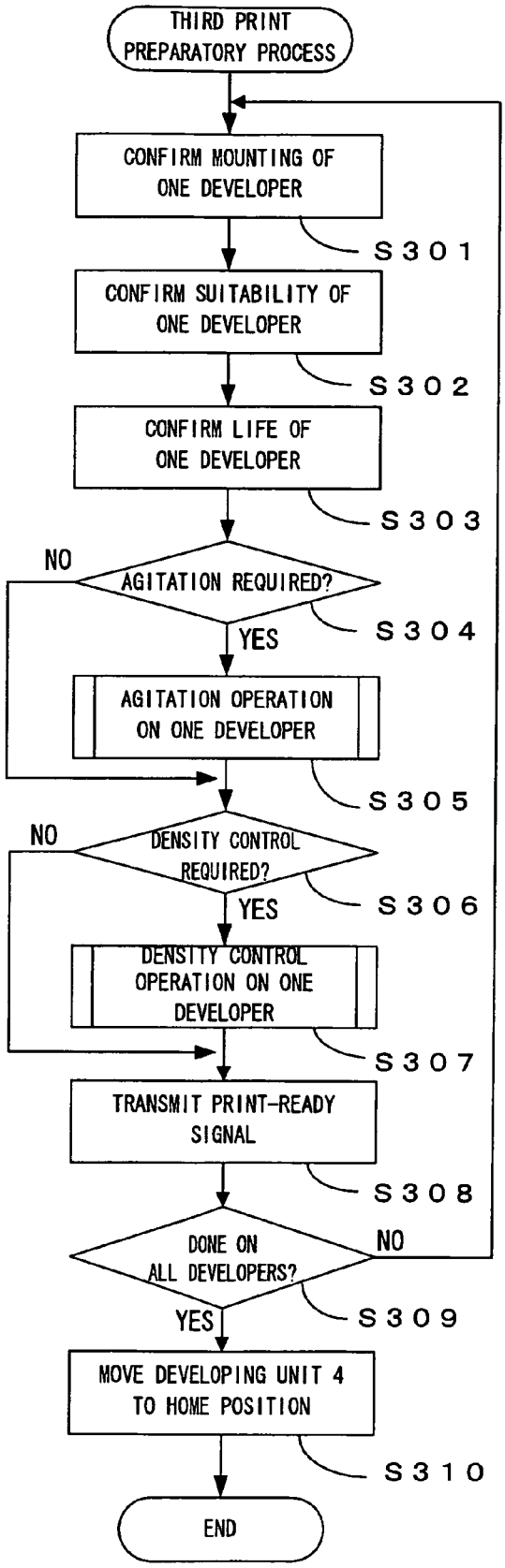
FIG. 14 is a flow chart which shows the steps of the third print preparatory process.

FIG. 14 is a flow chart which shows the steps of the third print preparatory process. In the third print preparatory process, when the process on one developer is completed, the next developer is subjected to the process. That is, the contents of the process performed on one developer (Steps S301 to S307) are the same as those of the process performed on the priority developer (Steps S101 to S107) according the first embodiment. Furthermore, the contents of the agitation operation (Step S305) and the density control operation (Step S307) are the same as those of the first embodiment.

When the process on one developer is completed, the engine controller 10 outputs to the main controller 11 a print-ready signal indicating that the developer of interest is ready to print (Step S308). When the process on one developer is completed, the developer is switched to the next one. The above steps are repeated in cycles until completion of the process on all the developers (Step S309). When all the developers are finished with the process, the developing unit 4 is returned to the home position to terminate the print preparatory process (Step S310). Although not shown in the figure, when the third print preparatory process is completed, the engine controller 10 outputs the print-preparatory-process end signal to the main controller 11 just as in the second embodiment.

On the other hand, the main controller 11 performs a print-readiness determination process to be described as below, when the print request from external source is applied thereto during the execution of the print preparatory process in the engine controller 10 (the time period between the output of the print-preparatory-process direction signal and the receipt of the print-preparatory-process end signal).

Figure 15:
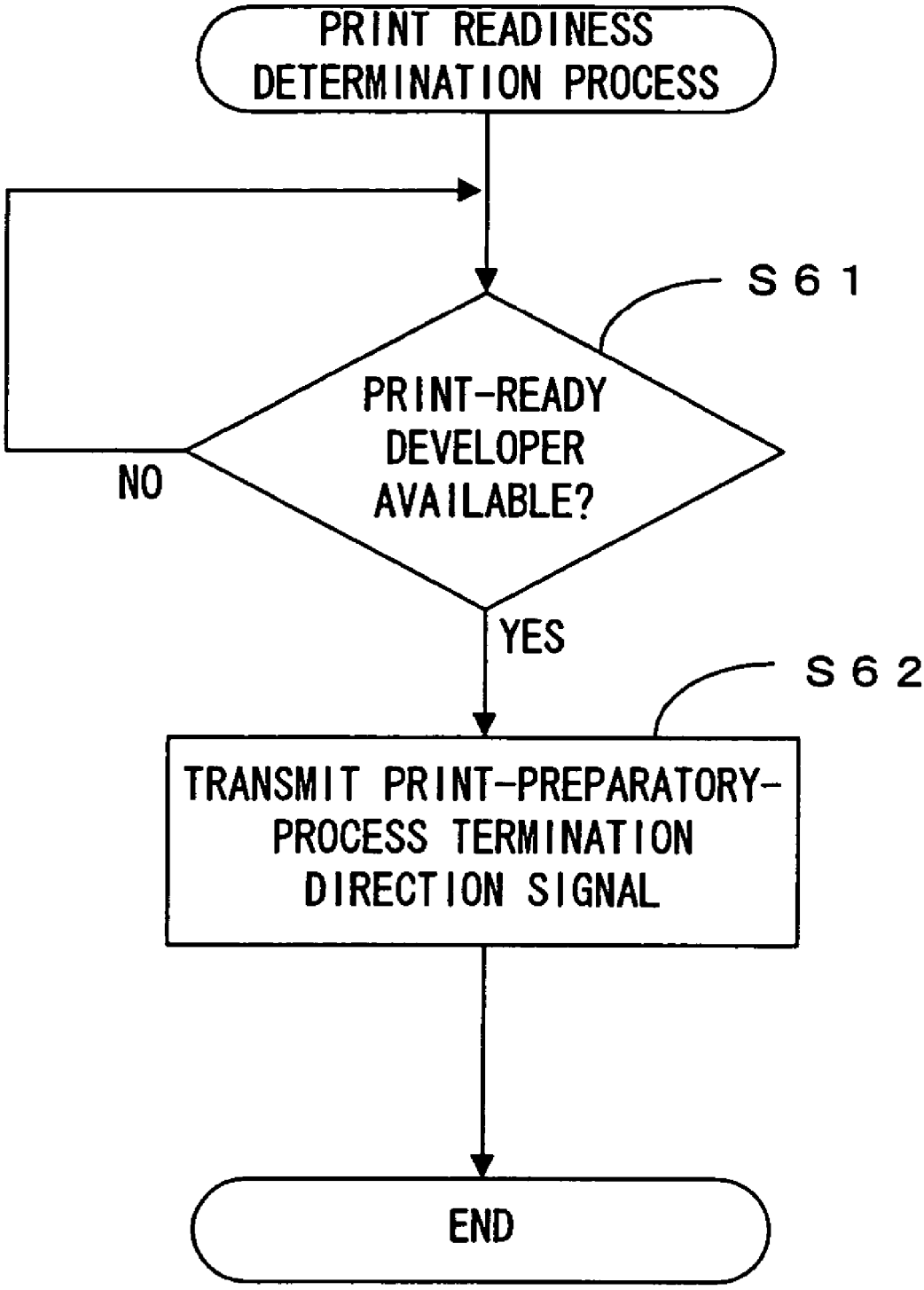
FIG. 15 is a flow chart which shows the steps of the print-readiness determination process of the third embodiment.

FIG.15 is a flow chart which shows the steps of the print-readiness determination process of this embodiment. In this print-readiness determination process, determination is first made as to whether the developers include a print-ready developer or not (Step S61). Specifically, if the print-ready signal from the engine controller 10 is already received, the main controller 11 determines that the print-ready developer is available. If the above signal is not received yet, the main controller 11 determines that there is no print-ready developer. In the case of absence of the print-ready developer, the main controller 11 is on standby until one of the developers becomes ready to print (or until the print-ready signal is transmitted from the engine controller 10). In a case where the print-ready developer is available, the main controller 11 transmits to the engine controller 10 a print-preparatory-process termination direction signal directing to terminate the third print preparatory process (Step S62).

Figure 16:
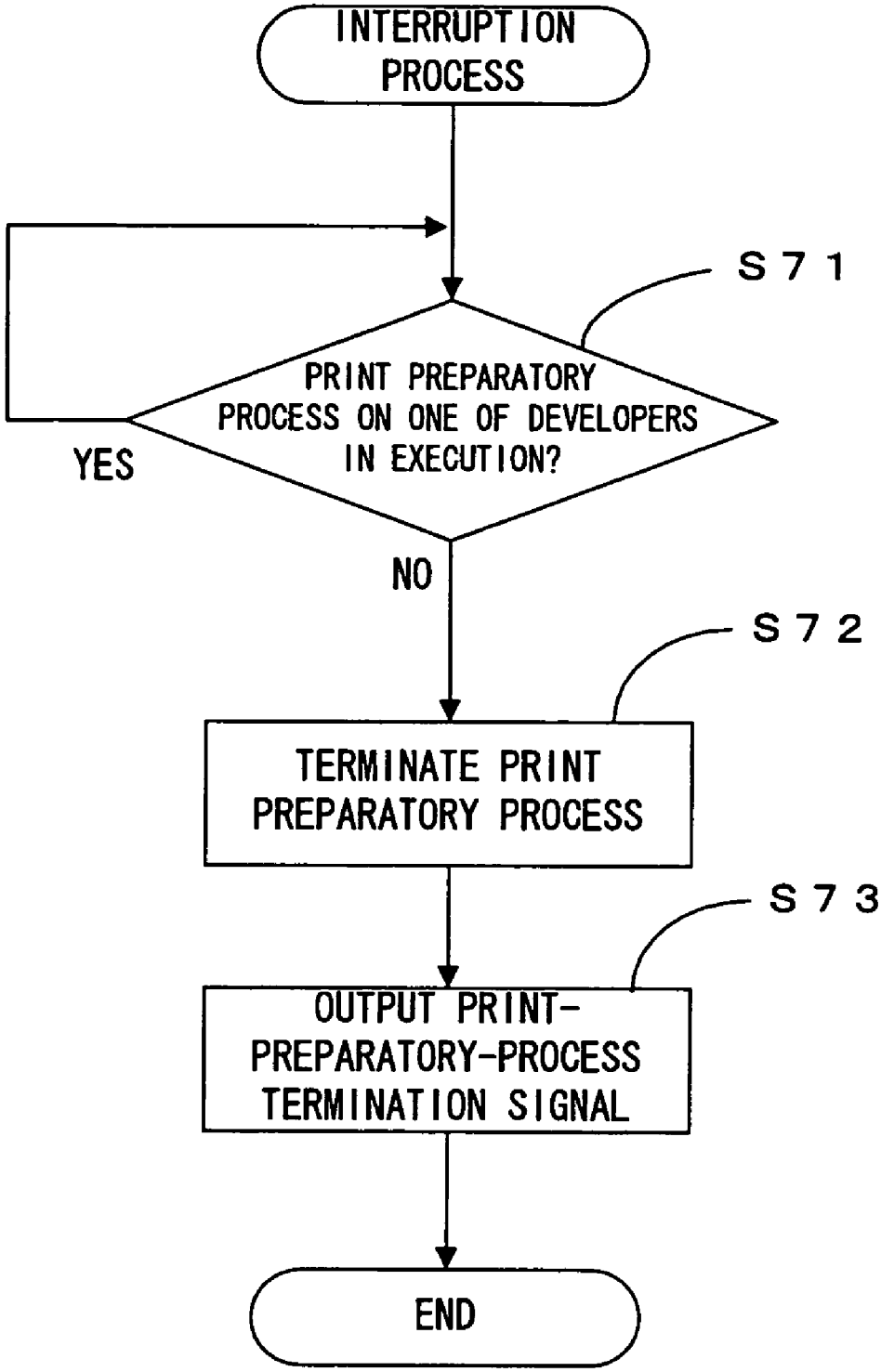
FIG. 16 is a flow chart which shows the steps of the interruption process performed by the engine controller according to the third embodiment.

FIG. 16 is a flow chart which shows the steps of the interruption process performed by the engine controller according to the embodiment. When receiving the print-preparatory-process termination direction signal from the main controller 11 during the execution of the third print preparatory process, the engine controller 10 performs the interruption process shown in FIG.16. In the interruption process, the engine controller 10 determines whether or not the process on any one of the developers is in execution at the time of receipt of the interrupt request (Step S71). If the process is in execution, the engine controller 10 allows the process on the developer to be completed and then, terminates the print preparatory process (Step S72). Subsequently, the engine controller 10 outputs the print-preparatory-process termination signal to the main controller 11 (Step S73).

When receiving the print-preparatory-process termination signal, the main controller 11 outputs the print start signal to the engine controller 10. In response to this, the engine controller 10 performs the printing operation using the developer now ready to print, thereby forming images according to the print request.

According to the embodiment as described above, the print preparatory process is performed on all the developers mounted in the developing unit 4 just as in the second embodiment. Therefore when a print request is applied thereafter, a large volume of monochromatic prints may be produced according to the request and in an efficient manner. Even in the execution of the print preparatory process, the process is terminated at receipt of the print request and the printing operation is carried out. Therefore, the first print time is shortened. In this case, the developer brought into the print-ready state by the predetermined process is used for the printing operation and hence, the resultant images have good quality.

Fourth Embodiment

A print preparatory process according to the fourth embodiment (fourth print preparatory process) implements the same functions as those of the above second and third embodiments. However, this embodiment differs from the second and third embodiments in that the print request applied during the execution of the print preparatory process is handled without using the interruption process.

Figure 17:
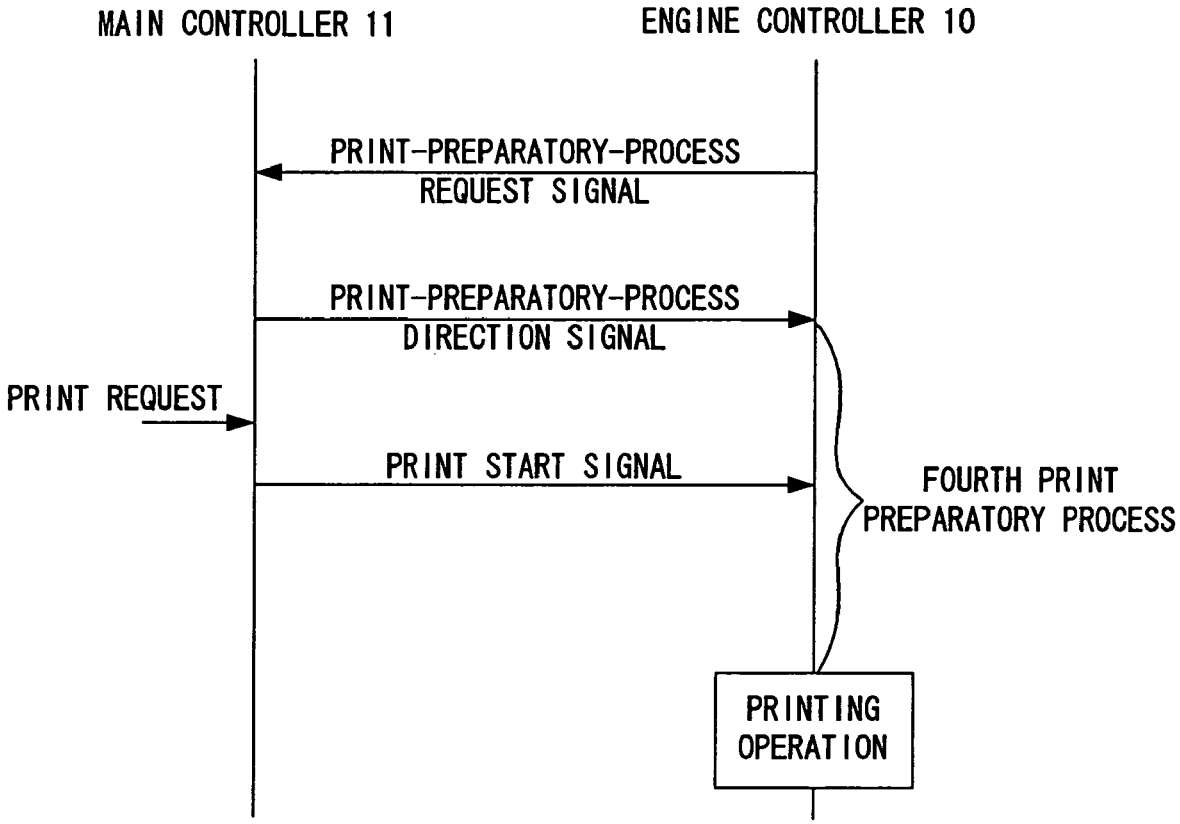
FIG. 17 is a chart which shows an example of timing of performing the fourth print preparatory process.

FIG. 17 is a chart which shows an example of timing of performing the fourth print preparatory process. In this embodiment, when at least one of the agitation requiring flag and the density-control requiring flag is set with respect to all the developers mounted in the developing unit 4, the engine controller 10 outputs the print-preparatory-process request signal to the main controller 11. Receiving the signal, the main controller 11 outputs the print-preparatory-process direction signal to the engine controller 10, which, in turn, performs the fourth print preparatory process described as below. In a case where the main controller 11 receives the print request from external source after outputting the print-preparatory-process direction signal, the main controller 11 according to the embodiment outputs the print start signal to the engine controller 10 irrespective of the execution status of the print preparatory process.

Figure 18:
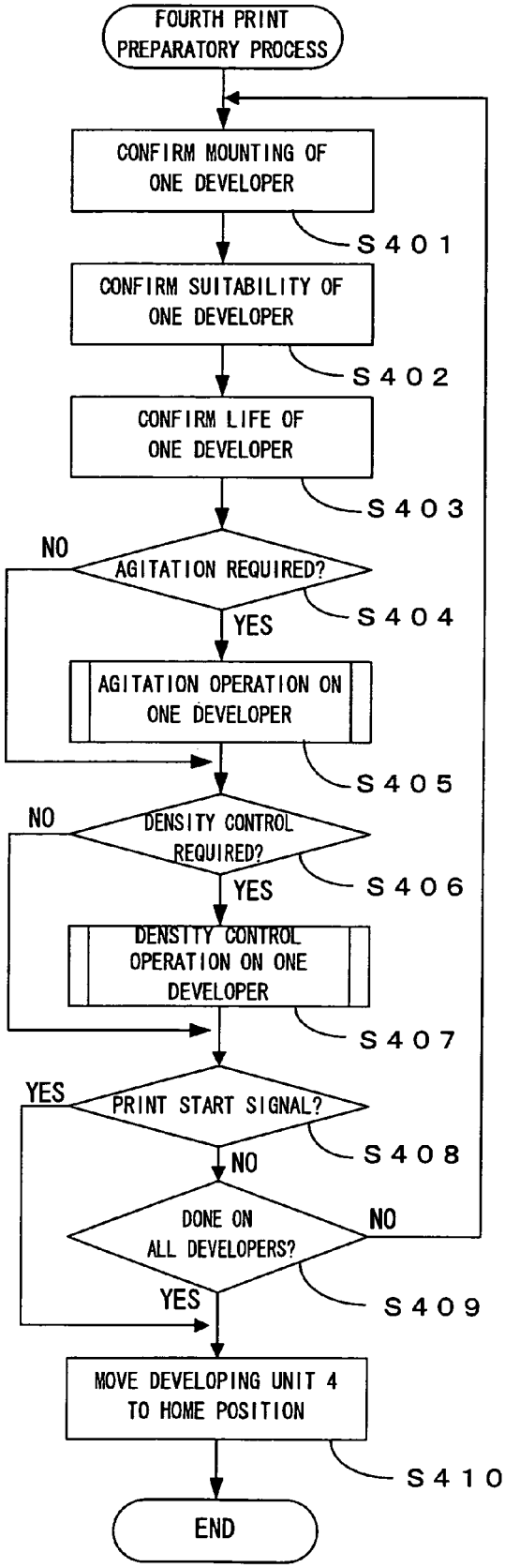
FIG. 18 is a flow chart which shows the steps of the fourth print preparatory process.

FIG. 18 is a flow chart which shows the steps of the fourth print preparatory process. In the fourth print preparatory process, when one developer is finished with the process (Steps S401 to S407), the next developer is subjected to the process (Step S409) just as in the third print preparatory process (FIG. 14). Prior to the changeover of the developers, however, determination is made as to whether the print start signal is transmitted from the main controller 11 or not (Step S408). If the print start signal is received at this point of time, the print preparatory process is terminated. If, on the other hand, the print start signal is not received, the print preparatory process is continued. If the print start signal is not received when the process on all the developers is completed, the developing unit 4 is returned to the home position to terminate the process (Step S410).

According to the fourth print preparatory process thus arranged, as well, the print preparatory process is performed on all the developers just as in the second and third embodiments. Therefore, when the print request is applied subsequently, a large volume of monochromatic prints may be produced according to the request and in an efficient manner. The print start signal is checked for each time the process on one developer is completed. Therefore, even when the print request from external source is applied during the execution of the print preparatory process, the printing operation may be carried out in quick response to the print request.

Fifth Embodiment

A print preparatory process according to the fifth embodiment is a modification of a part of the aforementioned second print preparatory process of the second embodiment. A difference between these embodiments depends upon whether after the print preparatory process is terminated by the interrupt request, the completion of the printing operation is followed by the restart of the print preparatory process or not. According to the fifth embodiment, when the print request from external source is applied during the execution of the print preparatory process, the print preparatory process is temporarily suspended to perform the printing operation in response the request. After completion of the printing operation, the temporarily suspended print preparatory process is resumed and the necessary process is performed on all the developers in the end.

Figure 19:
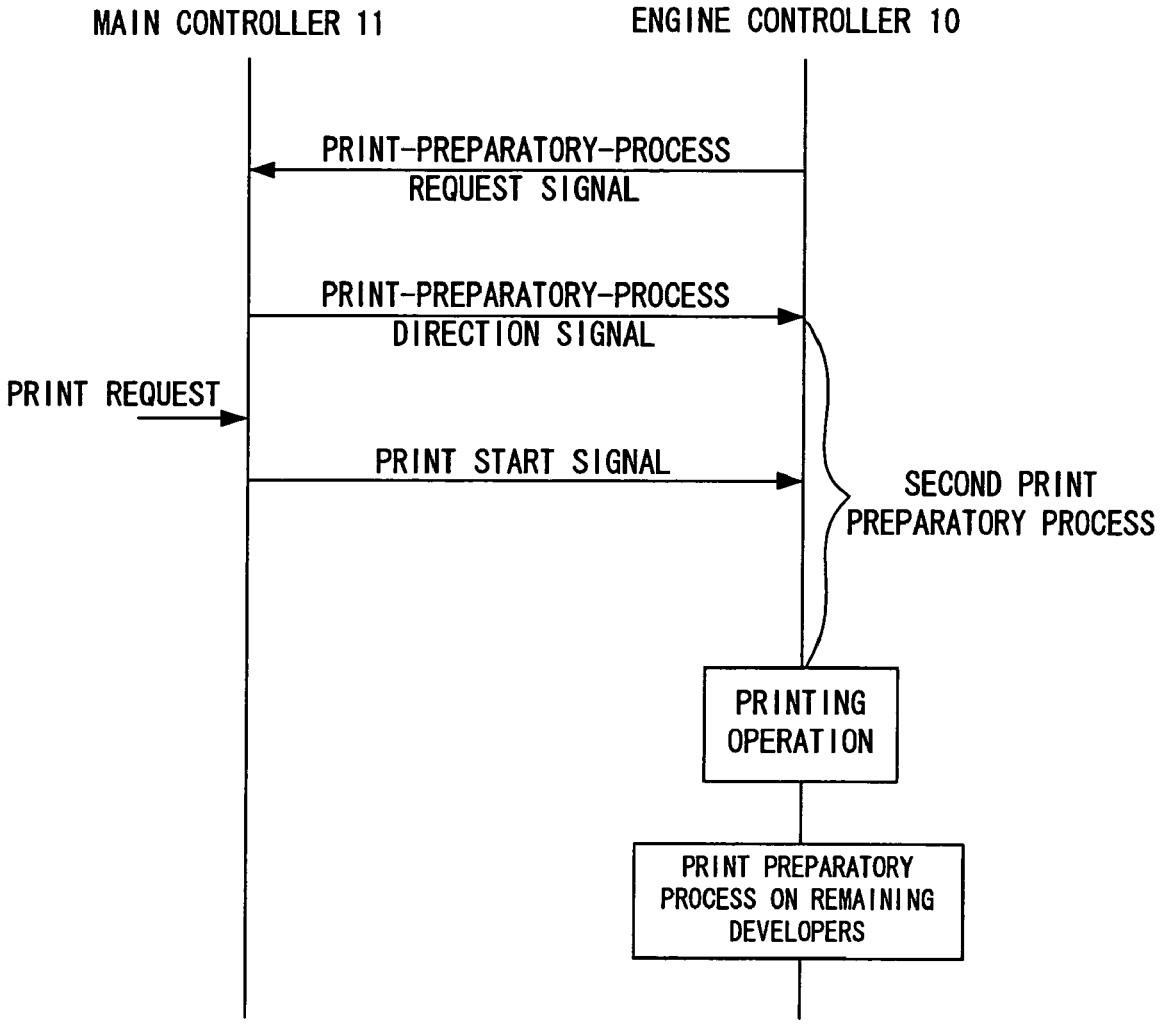
FIG. 19 is a chart showing an example of timing of performing the fifth print preparatory process.
Figure 20:
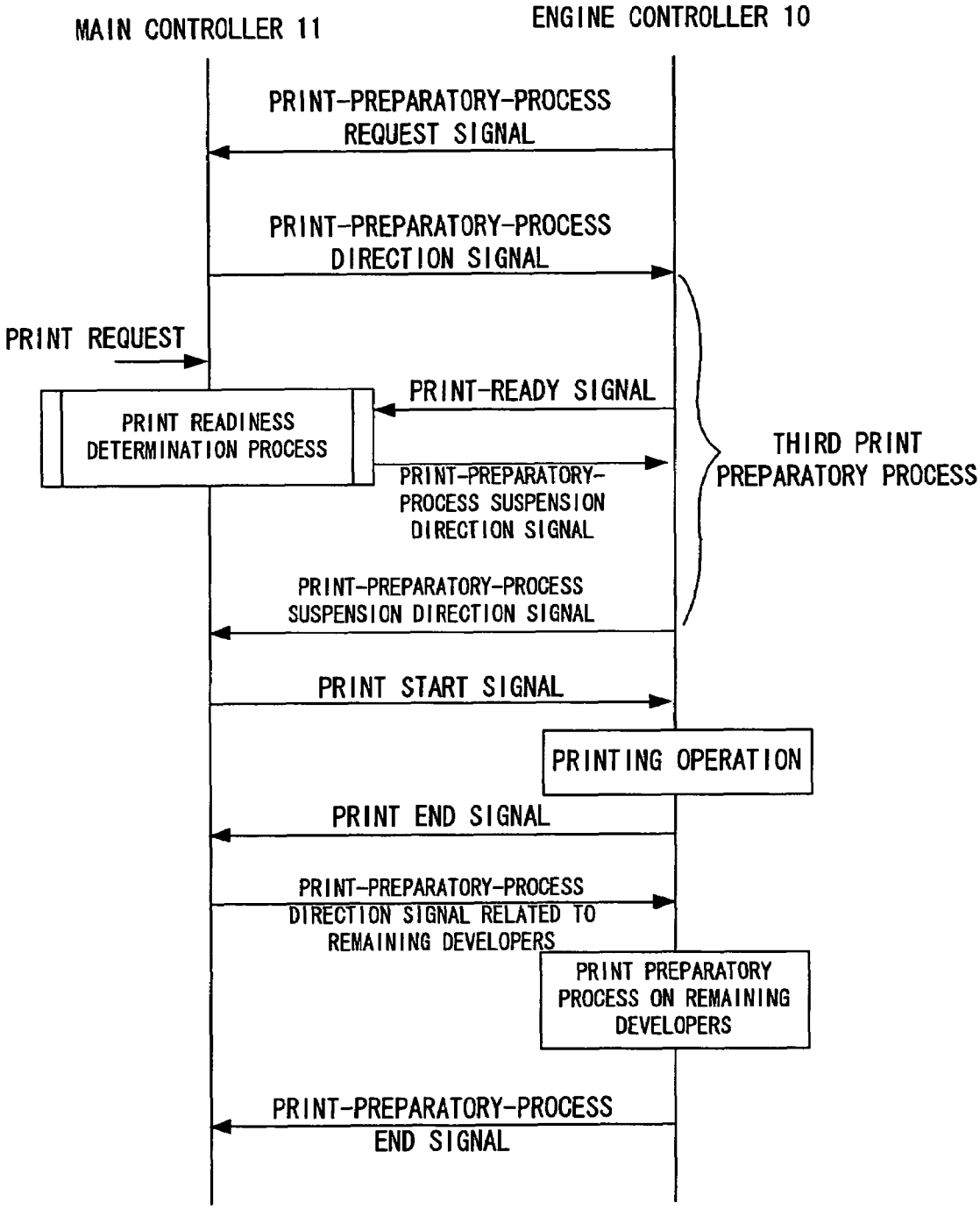
FIG. 20 is a chart which shows an exemplary modification of the third embodiment.

FIG. 19 is a chart showing an example of timing of performing the fifth print preparatory process. In this embodiment, when at least one of the agitation requiring flag and the density-control requiring flag is set with respect to all the developers mounted in the developing unit 4, the engine controller 10 outputs the print-preparatory-process request signal to the main controller 11 just as in the second embodiment. Receiving the signal, the main controller 11 outputs the print-preparatory-process direction signal to the engine controller 10. Receiving this print-preparatory-process direction signal, the engine controller 10 starts to perform the second print preparatory process described above (FIG. 8). If the print request from external source is applied to the main controller 11 at this point of time, the main controller 11 outputs to the engine controller 11 the print start signal corresponding to the request. Receiving this signal, the engine controller 10 suspends the print preparatory process to perform the printing operation, thereby forming images corresponding to the print request. After completion of the printing operation, the engine controller 10 resumes the suspended print preparatory process, so as to perform the necessary process on the remaining developers which are not finished with the process. This brings all the developers into the print-ready state, so that the apparatus is adapted for even large volume printing. The operation to resume the print preparatory process interrupted by the printing operation may also be applied to the aforementioned third and fourth embodiments. For instance, the third embodiment to carry out the third print preparatory process (FIG. 14) may be rearranged as follows. FIG. 20 is a chart which shows an exemplary modification of the third embodiment. A process flow in which the print request is applied during the execution of the third print preparatory process so that the print preparatory process is suspended and the printing operation is performed is basically the same as that of the third embodiment (FIG. 13). It is noted however that what the main controller 11 applies to the engine controller 10 in the print readiness determination process is not the print-preparatory-process termination signal for totally terminating the print preparatory process but a print-preparatory-process suspension direction signal for temporarily suspending the print preparatory process. In addition, the engine controller 10 returns to the main controller 11 a print-preparatory-process suspension signal indicating that the print preparatory process is temporarily suspended. After the printing operation is carried out, the engine controller 10 transmits a print end signal to the main controller 11. In response to this signal, the main controller 11 outputs to the engine controller 10 a print-preparatory-process direction signal directing to perform the print preparatory process on the remaining developers. The engine controller 10, in turn, performs the process on all the remaining developers and then, outputs the print-preparatory-process end signal to the main controller 11. On the other hand, the fourth embodiment may be rearranged as follows. As shown in FIG. 18, the fourth print preparatory process determines in Step S408 whether the print start signal is received or not. If the print start signal is received, the printing operation is continued. When the printing operation is completed, the operation flow may return to Step S409 to resume the process.

Summary of First to Fifth Embodiments

In the print preparatory processes of the first to fifth embodiments as described above, the contents of the process are determined according to the conditions of the respective developers mounted in the developing unit 4. Therefore, the print preparatory process, the contents of which are optimized according to the conditions of the apparatus, may be carried out. According to the invention, the print preparatory process may be carried out efficiently in the image forming apparatus equipped with the plural developers each storing the toner of the same color.

When the print request is applied from external source during the execution of the print preparatory process, the contents of the subsequent print preparatory process are changed properly according to the request. That is, the contents of the print preparatory process are optimized according to the case where the print request is made or where the request is not made. Specifically, the process is terminated or suspended at the time when at least one of the developers is brought into the print-ready state, and the printing operation is performed using the print-ready developer. Therefore, the print request may be responded by forming images in the short first print time.

In these embodiments, the photosensitive member 22 functions as "latent image carrier" of the invention. The main controller 11 and the engine controller 10 function as "first controller" and "second controller", respectively.

(Modifications)

According to the foregoing embodiments, the print preparatory process is performed when the individual developers require the print preparatory process but irrespective of the timing of performing the printing operation in response to the print request from external source. Instead of or in addition to this, an arrangement may be made such that the individual developers are checked for the conditions thereof after the end of the printing operation, and the print preparatory process may be performed in a required mode according to the check results. If this procedure is taken, all the developers are in the print-ready state after the execution of the print preparatory process. Hence, a large volume image formation may be carried out efficiently.

While the first embodiment selects the priority developer based on the ease of transfer to the development position and subjects the selected developer to the print preparatory process, another developer may also be selected as the priority developer. For instance, the individual developers may be checked for management information items, such as the residual quantity of toner or the degree of wear of the developing roller, while a developer to be subjected to the print preparatory process may be selected based on the check results.

Sixth Embodiment

Next, description is made on a print preparatory process according to a sixth embodiment of the invention. This embodiment defines the following mode of control operation of the engine controller 10 in the pursuit of the following objects:

(1) to form high quality images in a consistent manner;

(2) to shorten time period between receipt of print request and image formation (first print time);

(3) to increase throughput of image formation; and (4) to minimize frequencies of print preparatory process performed on developer for the sake of maintaining good image quality, and to perform necessary process efficiently.

Figure 22:
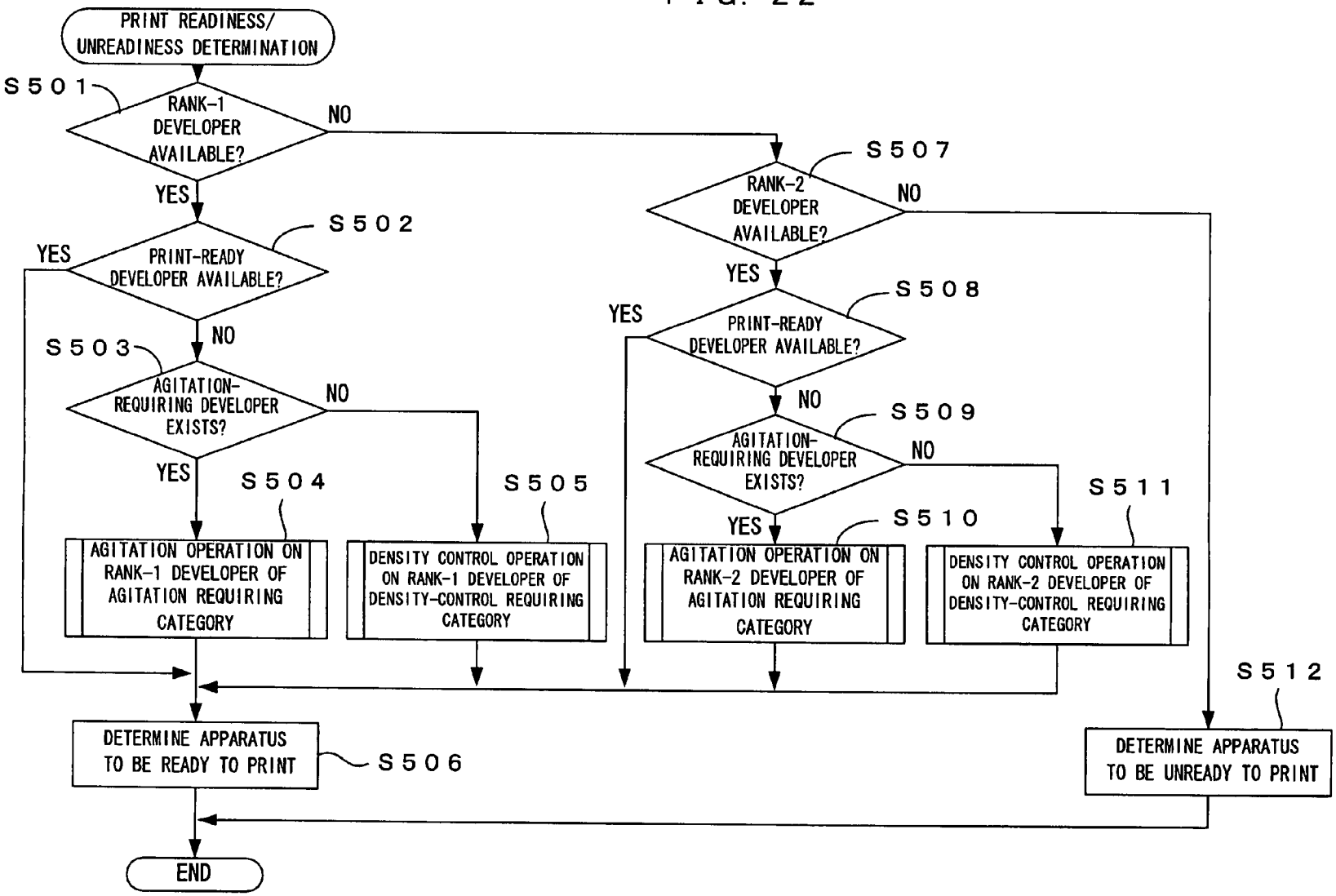
FIG. 22 is a flow chart which shows the steps of the print readiness/unreadiness determination process.

Specifically, the engine controller 10 performs a print readiness/unreadiness determination process shown in FIG. 22 whenever necessary, thus monitoring the conditions of the individual developers to determine whether the apparatus is adapted for immediate execution of the printing operation or not. When required, the engine controller 10 performs the predetermined print preparatory process on the individual developers, thereby holding the apparatus ready to carry out the printing operation in quick response to the print request applied. When the print request is applied, the engine controller 10 performs a printing operation shown in FIG. 23 and forms an image corresponding to the print request by selectively using an optimum one of the developers. The details of the operation are described as below.

In this embodiment, the respective developers are determined for life ranks based on the residual quantity of toner therein and the cumulative rotation time of the developing roller disposed therein. Based on the ranking results, print readiness/unreadiness of each developer is determined. Furthermore, the mode of the printing operation (described hereinlater) is varied according to the ranking results. The ranking of the developers is described before proceeding to the explanation of the print readiness/unreadiness determination process.

Figure 21:
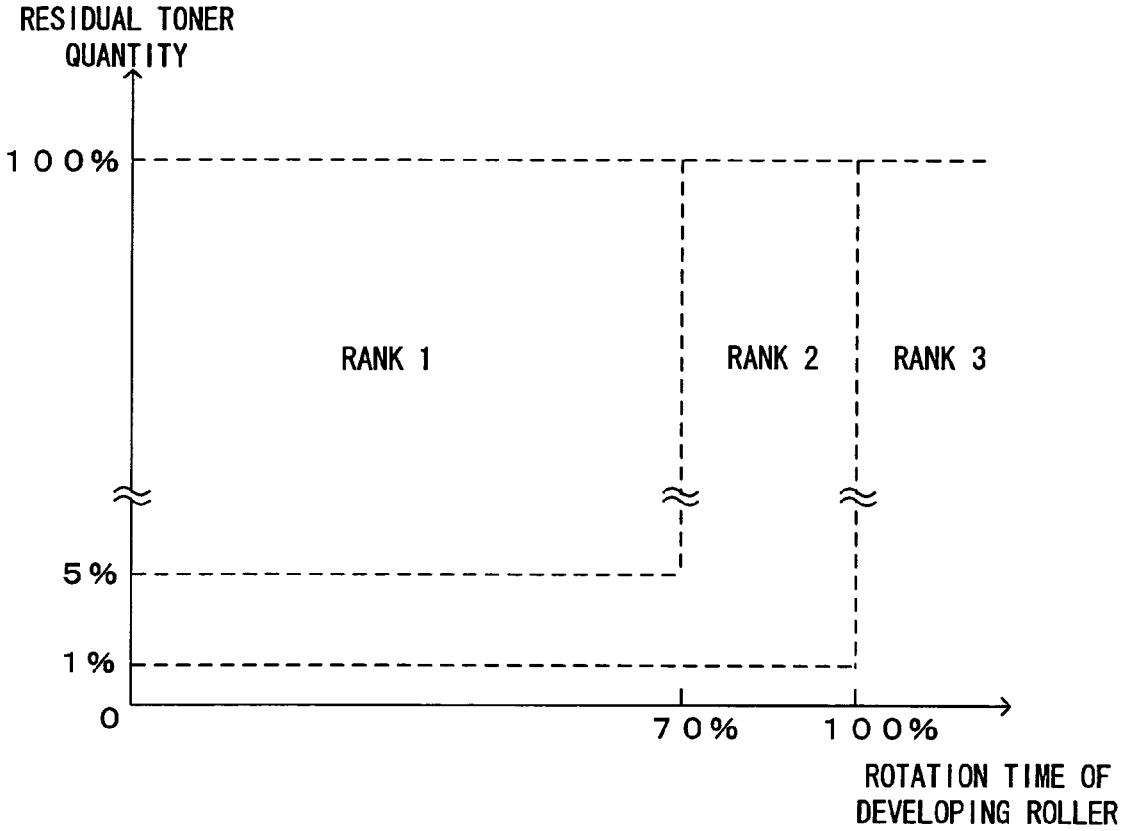
FIG. 21 is a chart which explains how the developers are ranked.

FIG. 21 is a chart which explains how the developers are ranked. The image quality degradation associated with the service life of the developer occurs not only when the residual toner runs low but also when the remaining toner is deteriorated in the properties. It is natural that the good image quality cannot be accomplished when the residual quantity of toner is very low. Even though a substantial quantity of toner remains in the developer, it is also impossible to accomplish the good image quality if the toner is deteriorated. The cumulative rotation time of the developing roller is a value indicative of the degree of deterioration of the toner. In a case where the value reaches a predetermined value (say, 10,000 seconds), it is most likely that the toner is deteriorated, even though the residual quantity of toner is substantial. Thus, the developer in question may be regarded as unfit for use.

This embodiment adopts a ranking scheme as shown in FIG. 21. If a residual toner quantity is 5% or more of the initial quantity and a cumulative rotation time of the developing roller is less than 70% of the aforesaid predetermined value, the developer in question is ranked as Rank 1. In a case where an image is formed using the Rank-1 developer, the resultant image is expected to suffer no poor image density, thin spots or the like and to have an image density as high as a required level, because a sufficient quantity of toner remains and the deterioration of the toner is of a minor degree. On the other hand, if a residual toner quantity is less than 1% of the initial quantity or a cumulative rotation time of the developing roller is above the aforesaid predetermined value, the developer in question is ranked as Rank 3. The Rank-3 developer is no longer fit for use in the printing operation. If a residual toner quantity is in the range of 1% or more and less than 5% of the initial quantity and a cumulative rotation time of the developing roller is less than the aforesaid predetermined value, or if a residual toner quantity is 1% or more of the initial value and a cumulative rotation time of the developing roller is in the range of 70% or more and less than 100% of the predetermined value, the developer in question is ranked as Rank 2, an intermediate rank of the above two ranks. In a case where an image is formed using the Rank-2 developer, the device is able to form an image but the resultant image is likely to suffer image defects such as poor image density and thin spots. The Rank-2 developer is in a state where the developer is able to accomplish the image formation but is likely to entail some kind of image quality degradation. It is desirable that the respective ranks of the developers may be shown on an unillustrated display unit as needed, so as to inform the user of such conditions of the developers.

The condition of the apparatus may be classified into the following three levels by classifying the service life of the respective developers into any of the three ranks: Rank-1 ensuring the formation of images of a given quality; Rank-3 indicating the unfitness for use; and Rank-2 of an intermediate level between the above two ranks:

(i) a state equipped with at least one Rank-1 developer. In this state, the apparatus is able to form images of an intended quality by using the Rank-1 developer;

(ii) a state equipped with no Rank-1 developer but with at least one Rank-2 developer. In this state, the apparatus is able to form images using the Rank-2 developer, but may possibly fail to achieve the intended image quality;

(iii) a state equipped only with Rank-3 developers. In this state, the apparatus is no longer able to achieve the intended image quality.

If the Rank-1 or Rank-2 developer is left standstill for long, even such a developer may form images suffering periodical density variations in an initial stage of the image forming operation performed after the standstill period. This problem has been described in the foregoing. As the developer is used longer, the deterioration thereof proceeds so that the image density varies. This dictates the need for changing the operating conditions of the individual parts of the apparatus when the developer in question is used for the image forming operation. This problem has also been described in the foregoing. Hence, the embodiment also sets the agitation requiring flag per developer if the rest time reaches the predetermined value, the rest time starting from the end of use of the developer in the last performed printing operation or print preparatory process. Furthermore, when the aforesaid information indicating the service life of the developer, or either one of the residual toner quantity and the developing-roller rotation time reaches the predetermined threshold value, the density-control requiring flag is set. The developer related to such a flag thus set is subjected to the agitation operation or the density control operation in a timing to be described hereinlater. Thus, the image density variations are suppressed.

The arrangement may be made such that the information indicating the conditions of the developer, such as the residual toner quantity and the developing-roller rotation time, is stored in the storage device (e.g. the non-volatile memory 91 in the developer 4Ka) disposed in the developer of interest, whereas the CPU 101 retrieves/writes the information items as needed. Thus, the information on each developer accompanies the developer itself. Therefore, the conditions of every one of the developers may be managed properly even though some developer once dismounted is re-mounted to the apparatus or some developer used in another apparatus is mounted to this apparatus.

According to the embodiment as described above, the individual developers are classified into any one of the Rank-1 to Rank-3 according to the residual toner quantity and the developing-roller rotation time. In addition, the Rank-1 and Rank-2 developers are classified into the following three categories: a developer directly usable in the image forming operation or not requiring any preparatory operation (print-ready); a developer requiring the agitation operation prior to the image forming operation (agitation requiring); and a developer requiring the density control operation prior to the image forming operation (density-control requiring). It is noted that a developer related to both the set agitation requiring flag and the set density-control requiring flag is classified into the density-control requiring category. The reason will be described hereinlater.

The print readiness/unreadiness determination process is performed based on these categories. The print readiness/unreadiness determination process and the printing operation to be described hereinlater are composed based on the following basic concept. For achieving the aforementioned object (1) to form high quality images in the consistent manner, the apparatus uses only the Rank-1 developer for image formation so long as at least one Rank-1 developer is available. This ensures that the high quality images are formed in the consistent manner free from the fear of entailing the poor image density or thin spots. Since the Rank-2 developer cannot exclude the fear of image defects, the Rank-2 developer is not employed unless the Rank-1 developer providing the higher image quality reaches the end of its usefulness.

In a case where there are plural Rank-1 developers, the first developer to be used is selected each time before the printing operation is started. During the operation, every one of the Rank-1 developers is used in turn by properly switching from one device to another. Any of the developers, classified as Rank 1, ensures the consistent image quality. Hence, the image quality is varied little by switchably using these devices. Furthermore, every one of the developers is used in turn, thereby preventing some of these developers from being left standstill for long. This obviates a problem that a developer classified into the print-ready category is ranked down to the agitation requiring category. Accordingly, the occurrence of the aforementioned shutdown-induced banding can be avoided. Furthermore, the frequencies of the print preparatory process to be performed may be reduced. As a result, a period during which the apparatus 1 is in the print-ready state may be maximized. Furthermore, the developing unit 4 is rotated at regular intervals so that an effect to homogenizing the toner in each developer is also provided.

In this case, so long as the Rank-1 developers at least include one belonging to the print-ready category, the agitation operation or the density control operation is not performed on the other developers. This is because the image of good quality can be formed so long as at least one print-ready developer is available. Hence, it is not always necessary to make the other developers usable. This approach also meets the aforesaid object (4) to perform the preparatory operation efficiently. On the other hand, when the Rank-1 developers no longer include a device of the print-ready category, the predetermined preparatory operation is performed to restore the developer to the print-ready state. Thus, the apparatus continues to be maintained in the state to be able to form images of good quality. Furthermore, the developer, left un-subjected to the required print preparatory process, is never used for the printing operation, so that images inferior in quality are never formed. In addition, the embodiment is so designed as to reduce time taken to carry out the print preparatory process.

In a case where no Rank-1 developer is available, the embodiment permits the printing operation to be continued by using a Rank-2 developer. In the Rank-2 developer, the remaining toner is low in quantity or the toner is rather deteriorated in the properties thereof Hence, the printing operation using this device involves a fear that the formed images may be degraded in quality depending upon the degree of the drop of residual toner quantity or of the toner deterioration. In the case of the full color image forming apparatus, image defects, such as poor density and this spots, related to just one of the color toners constituting the full color image appear as a different color tone of the overall image or color irregularities thereof. In contrast, the apparatus 1 is dedicated to the monochromatic image formation and hence, does not encounter a problem associated with such color irregularities. Considering the actual circumstances where the image forming apparatus exclusive to monochromatic image formation is used, the image forming apparatus of this type is mostly used for the purpose of forming character images. Where the apparatus is used for such a purpose, minor image defects are often allowed so long as the characters are legible enough. Therefore, the monochromatic image forming apparatus is thought to have a wider allowable range for image quality than the full color image forming apparatus. Accordingly, this embodiment does not inhibit the printing operation even when no Rank-1 developer is available, but carries on the printing operation using the Rank-2 developer. This provides for a more efficient use of the toner remaining in the developer.

In this case, however, the developers are not switchably used in the course of a series of printing operations. A manner in which the image defects appear varies depending upon the conditions of the individual developers. Therefore, if the image forming operation is performed as switching from one developer to another, there may be a case where the image quality variations are increased by some developer used. Particularly if there are images formed using the Rank-1 developer in combination with images formed using the Rank-2 developer, the image quality variations are increased so much that the user may be puzzled over how to maintain the image quality. In this sense, as well, it is undesirable to use the Rank-1 developer in combination with the Rank-2 developer. Whether the print preparatory process is to be performed on the Rank-2 developer or not may be determined the same way as the determination on the Rank-1 developer.

The print readiness/unreadiness determination process is not performed in a particular timing such as immediately after turn-on of the apparatus, or at receipt of the print request. It is rather desirable to perform the process as needed even when the apparatus is on standby for the print request from external source. This permits the apparatus to be adapted to ever changing conditions thereof even in a standby time. The required print preparatory process may be performed during the standby time. Therefore, when the print request is applied subsequently, the apparatus can start the printing operation without delay. Thus, the aforesaid object (2) may be achieved. Furthermore, when a large number of images are successively formed, as well, it is less likely that the necessity of print preparatory process occurs in the course of the printing operation so as to interrupt the operation. This leads to the prevention of decreased throughput and hence, the aforementioned object (3) may be achieved.

FIG. 22 is a flow chart which shows the steps of the print readiness/unreadiness determination process. In this process, it is first determined whether the four developers 4Ka to 4Kd include the aforesaid Rank-1 developer or not (Step S501). If there is at least one Rank-1 developer available, the process proceeds to Step S502 to determine whether or not the Rank-1 developer(s) include one belonging to the print-ready category. If there is at least one developer of the print-ready category, the image forming apparatus 1 has at least one developer which contains a sufficient quantity of toner less deteriorated and which may be directly used in the operation. Therefore, if the print request is applied at this point of time, the apparatus can immediately carrying out the printing operation using the developer of interest. In this case, therefore, the process proceeds to Step S506 to determine that the apparatus is ready to perform the printing operation. Thus, the print readiness/unreadiness determination process is terminated.

If it is determined in Step S502 that there is no developer of the print-ready category, the process proceeds to step S503 to determine whether the Rank-1 developers include one belonging to the agitation requiring category or not. If there is at least one developer of the agitation requiring category, the agitation operation is performed on the developer of interest (Step S504). The contents of the agitation operation are basically the same as those of the second embodiment (FIG. 9), except that this embodiment performs the agitation operation on all the Rank-1 developers of the agitation requiring category.

If it is determined in Step S503 that there is no developer of the agitation requiring category, the apparatus is determined to have at least one Rank-1 developer(s), all of which belong to the density-control requiring category. In this case, therefore, these developers are subjected to the density control operation (Step S505). The contents of the density control operation are basically the same as those of the second embodiment (FIG.10), except that this embodiment performs the density control operation on all the Rank-1 developers of the agitation requiring category, just as in the above agitation operation.

On the other hand, if it is determined in Step S501 that there is no Rank-1 developer, then determination is made as to whether there is a Rank-2 developer or not (Step S507). If there is no Rank-2 developer, the four developers are all ranked as Rank-3. In this case, the apparatus is not equipped with any developer usable for the printing operation and hence, it is determined that the apparatus is unready for the printing operation (Step S512).

If there is at least one Rank-2 developer, the same process as that of the above case where the Rank-1 developer is available. That is, if the Rank-2 developers include one belonging to the print-ready category, the apparatus is determined to be able to perform the printing operation immediately (Steps S508, S506). If the Rank-2 developers do not include one belonging to the print-ready category but include one belonging to the agitation requiring category, the agitation operation is performed on the developer of interest (Steps S509, S510). If there is only a developer of the density-control requiring category, the density control operation is performed on the developers of interest (Step S511) and then, the apparatus is determined to be able to perform the printing operation (Step S506).

In this embodiment, a series of agitation operations are performed on the developers of the same rank, out of the developers included in the agitation requiring category. In Step S506 of FIG. 22, the agitation operation is performed only on the Rank-1 developer(s) of the agitation requiring category. Even if there is the Rank-2 developer of the agitation requiring category, such a developer is not subjected to the agitation operation at this point of time. As described above, the embodiment forms images using the Rank-1 developer if it is available. Therefore, it is unnecessary to perform the agitation operation on the Rank-2 developer at this point of time. Thus, the process time taken to shift the apparatus to the print-ready state is shortened by omitting the unnecessary print preparatory process. This contributes to the achievement of the aforementioned objects (2) through (4).

The developer related to both the set agitation requiring flag and the set density-control requiring flag is classified into the density-control requiring category. This developer is not subjected to the agitation operation at this point of time. The reason is as follows. Since the developing roller 44 is driven into rotation to form the patch images, the agitation operation is automatically performed when the density control operation is performed. Therefore, these operations need not be discretely performed on the developer requiring both the agitation operation and the density control operation. Such a developer may be subjected to only the density control operation. Conversely, if the developer requiring the density control operation is subjected to only the agitation operation, the developer is not directly brought into the print-ready state. The density control operation takes a longer process time than the agitation operation. In this situation where there is the developer which can be shifted to the print-ready category by only performing the agitation operation, it is preferred to perform the agitation operation only on such a developer in the light of achieving the aforementioned objects (2) and (3).

In this embodiment, the print readiness/unreadiness determination process thus arranged is performed to determine whether the apparatus is in the print-ready state or not. As needed, the predetermined process is performed on the developer requiring the print preparatory process. Hence, so long as the apparatus is equipped with at least one Rank-1 or Rank-2 developer, the apparatus is maintained in the print-ready state. When the print request is applied from the external apparatus, the apparatus is able to immediately start the printing operation in response to the command. In a case where all the developers are ranked as Rank 3, the apparatus is determined to be unready to print. Thus, the formation of images of inferior quality is obviated. When the apparatus is unready to form images, the apparatus informs the user of the print unreadiness and inhibits the receipt of the print request from external source.

Figure 23:
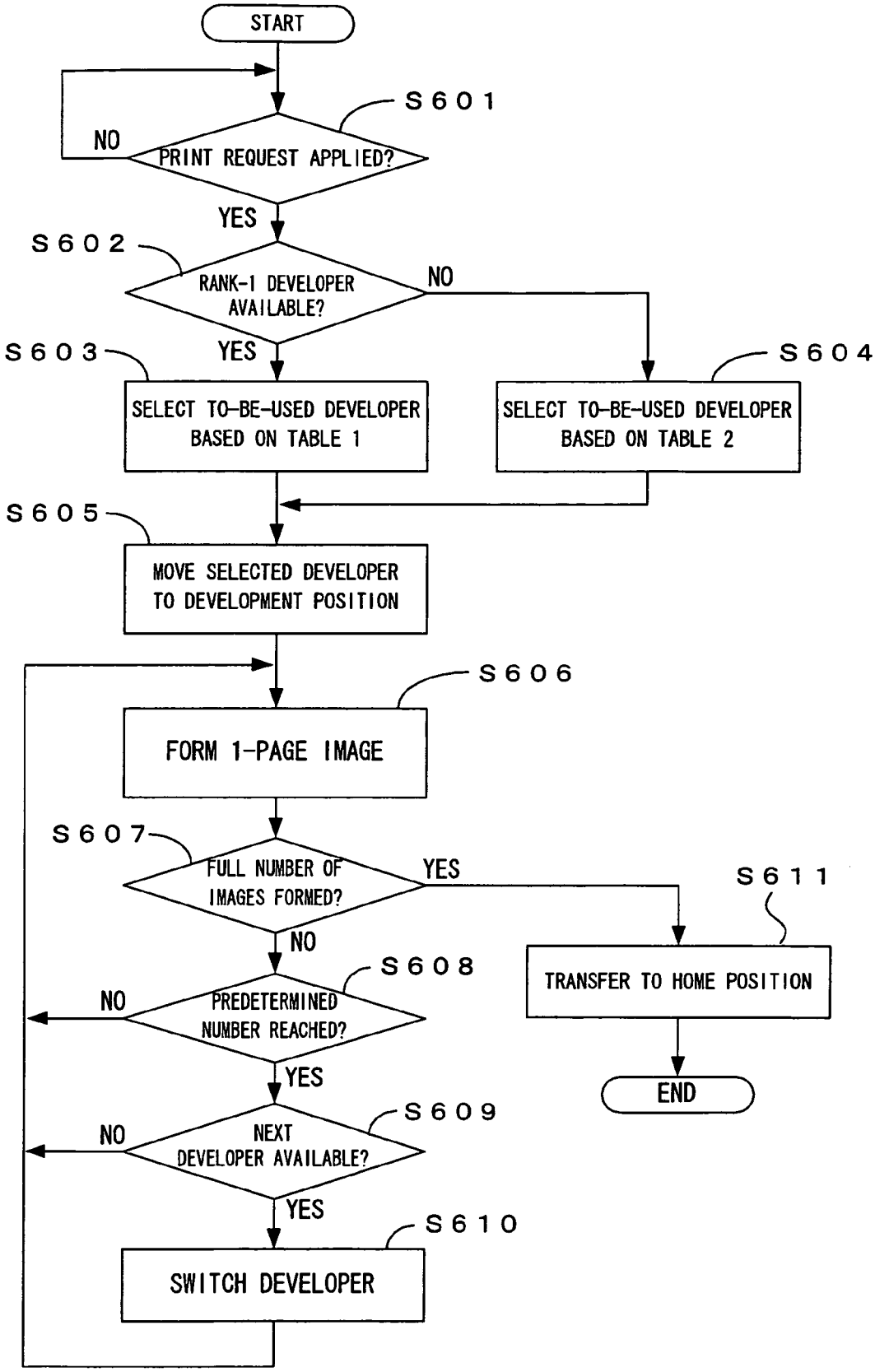
FIG. 23 is a flow chart which shows the steps of the printing operation according to the sixth embodiment.

FIG. 23 is a flow chart which shows the steps of the printing operation according to the embodiment. If the print readiness/unreadiness determination process determines the apparatus to be able to perform the printing operation, the apparatus is on standby to receive the print request from external source (Step S601). When the print request is applied, determination is first made as to whether there is any Rank-1 developer or not (Step S602). If there is at least one Rank-1 developer, a first table (FIG. 24) to be described hereinlater is referred to for selecting a developer to be used (Step S603). If there is no Rank-1 developer, a second table (FIG. 25) is referred to for selecting a developer to be used (Step S604). This embodiment selects the next developer to be used based on the current conditions of the respective developers (ranks and categories) in combination with which of the developers is the one last used in the previous printing operation or print preparatory process (hereinafter, simply referred to as "the last developer").

FIG. 24 is a diagram which shows the first table for selection of the developer. In a case where the Rank-1 developer is available and the apparatus is able to perform the printing operation, there should be at least one Rank-1 developer of the print-ready category. Such a developer is used in the printing operation. In a case where there is only one usable developer, this developer is used. In a case where there are a plural number of such developers, the developer to be used is selected based on the last developer. More specifically, out of the plural pertinent developers which are usable, a developer closest to the last developer as located upstream from the last developer with respect to the rotational direction of the rotary developing unit 4 is used in the next printing operation.

In a case where the four developers are all ranked as Rank 1 and fall under the print-ready category (Case No. 1 in FIG. 24), for example, if the last developer is the developer 4Ka, the developer 4Kb located one step upstream therefrom is used in the next printing operation. If the developer 4Kb, 4Kc or 4Kd is the last developer, the next upstream developer 4Kc, 4Kd or 4Ka relative to each last developer is used. In a case where only the developer 4Kb of the four developers does not satisfy the above requirements (Rank 1 and the print-ready category) (Case No. 5 in FIG. 23), any one of the developers 4Ka, 4Kc and 4Kd satisfying the requirements is selected. If, in this case, the last developer is the developer 4Ka or 4Kb, the developer 4Kc closest to the developer in question as located upstream therefrom is used in the next operation. Each of the other cases may be addressed the same way.

In a case where there are a plural number of Rank-1 developers, the developer used for image formation is changed at each image forming process by selecting the developer in this manner. This prevents any one of the developers from being left standstill for long.

FIG. 25 is a diagram which shows the second table for selection of the developer. In the second table used when there is no Rank-1 developer, as well, a developer to be used is selected based on the current conditions of the respective developers and the last developer, just as in the case where the first table is used. It is noted however that the next developer to be used is selected from the Rank-2 developers of the print-ready category.

Returning to FIG. 23, the description of the image forming operation is continued. After the developer is selected in the aforementioned manner, the selected developer is moved and positioned at the development position opposite the photosensitive member 22 (Step S605). Then selected the developer is used to form the first-page image of the images corresponding to the print request (Step S606). If this image is all of what to be formed (Step S607), the developing unit 4 is transferred to the home position (Step S611) to terminate the printing operation.

On the other hand, if there is another image to be formed, the operation is continued to form the image. Prior to the formation of the image, however, determination is made as to whether the number of images successively formed using the current developer reaches a predetermined number or not (Step S608). If the number of formed images does not reach the predetermined number (defined as 8 in this example), the operation returns to Step S606 to form the next image. If the predetermined number is reached, determination is made as to whether or not there is the next developer to be switchably used (Step S609). If the next developer is available, the rotary developing unit 4 is rotated through 90° to position the next developer at the development position (Step S610). If the next developer is unavailable, the developer in current use is held at the developing position while the operation returns to Step S606 to form the next image.

Determination criteria used in Step S609 are as follows. If the next upstream developer relative to the currently used developer with respect to the rotational direction of the developing unit 4 is classified as Rank 1 and into the print-ready category, this developer may be used as the next developer. The determination result in this case is "YES". In the other cases than the above, the result is "NO". For instance, if the currently used developer is the device 4Ka while the next upstream developer 4Kb therefrom is classified as Rank 1 and into the print-ready category, the determination result in step S609 is "YES". On the other hand, if the next upstream developer 4Kb relative to the currently used developer 4Ka is not a Rank-1 device of the print-ready category, the determination result in Step S609 is "NO" even though there is another developer classified as Rank 1 and into the print-ready category.

If a developer classified as Rank 1 and into the print-ready category is present at the next upstream place from the currently used developer, the alternative Rank-1 developer of the print-ready category may be moved to the development position by merely rotating the developing unit 4 through 90°. Therefore, the changeover of developers may be accomplished without decreasing the throughput of the image forming operation. Furthermore, the developer used next is classified as Rank 1 and into the print-ready category, so that the image quality may preferably be maintained.

The following working effects may be obtained by making changeover of the developers during a series of printing operations. If the use of one developer is continued, some toner present in the neighborhood of the developing roller in the developer is increased in the proportion of the older toner particles so that the image quality is progressively degraded. In the other developers, the toner is left carried on the surfaces of the developing rollers 44 during this period. Accordingly, the other developers are prone to the shutdown-induced banding. Conversely if the developing unit 4 is rotated for the changeover of developers, the toner in the developers is homogenized by agitation so that the certain image quality may be maintained. Furthermore, the use of the developer is not biased toward some particular developer, thereby preventing the respective developers from encountering the shutdown-induced banding.

On the other hand, in a case where the next upstream developer relative to the currently used developer belongs to any other life rank than Rank 1 or to any other category than the print-ready category, the image forming operation using such a developer involves a fear of significant variations of image quality after the changeover of the developers. If a Rank-1 developer of the print-ready category is present at place other than the next upstream place from the currently used developer, the developing unit 4 need be rotated through 180° or more to switch to the developer of interest. Hence, the changeover of the developers takes much time, resulting in the decrease of throughput. In these cases, therefore, the changeover of developers is not performed while the use of the current developer is continued.

When the printing operation is performed in response to an alternative print request after completion of the series of image forming operations, the selection of a developer is performed again. There may be a case where the print preparatory process is performed during the standby period up to the receipt of an alternative print request, thereby shifting any one of the developers to the print-ready category. Therefore, it is also possible that a developer not used in the previous printing operation is selected and used in the subsequent printing operation.

In the printing operation according to the embodiment as described above, the next developer to be used is decided based on the current conditions of the respective developers and the developer last used in the previous printing operation. Furthermore, in a case where a plural number of developers are usable, these developers are used as switched from one to another. Therefore, all the usable developers are used in turn, thereby preventing one of developers from being exclusively used.

The developer to be used in the image forming operation is selected based on the aforementioned criteria. When the printing operation is performed, therefore, a developer left standstill for the longest time period between the end of its use in the preceding printing operation or print preparatory process and the current point of time is selected from the developers of the print-ready category. As described above, the possibility of occurrence of the shutdown-induced banding becomes higher as the rest time lasts longer. However, one of the developers usable in the printing operation, that has the longest rest time, may be used in the subsequent printing operation, as suggested by the embodiment, whereby the developer in question may be prevented from being left standstill further longer to encounter the shutdown-induced banding.

Let us consider a case, for example, where all the developers are classified as Rank 1 and into the print-ready category while image data equivalent to 20-page images is applied as the first print request. If the printing operation is started using the developer 4Ka, for example, the developer 4Ka is switched to the developer 4Kb at the time when 8-page images are formed by the developer 4Ka. Then, the developer is switched to the developer 4Kc at the time when 8-page images are further formed. Thus, the remaining 4-page images are formed by the developer 4Kc and a series of printing operations are terminated. When an alternative print request is applied subsequently, the first table (FIG. 24) is referred to and it is decided to use the developer 4Kd in the next printing operation. The developer 4Kd has the longest un-operated period (rest time) of the four developers.

It is assumed that at this point of time, the developer 4Ka is decreased in the residual toner quantity due to the previous printing operation, so as to be ranked down to Rank 2. In this case, neither the changeover from the developer 4Kd to the developer 4Ka nor the changeover from the developer 4Kd to the developer 4Kb is conducted. The series of printing operations continue to use the developer 4Kd. When still another print request is applied, the first table (FIG. 24) is referred to. Since this case is applied to Case No. 9 and the developer 4Kd is the last one that was used, the developer 4Kb, out of the Rank-1, print-ready developers 4Kb, 4Kc, 4Kd, is used in the next image forming operation. Of these usable developers, this developer 4Kb has the longest rest time from the last use.

According to the embodiment as described above, the individual developers are basically operated as switched from one to another along the rotational direction of the developing unit 4. Furthermore, the next developer to be used is selected based on the positional relation between the usable developers mounted in the developing unit 4 and the developer last used in the previous printing operation or print preparatory process. In other words, the first and second tables are arranged such that one of the usable developers, that has the longest rest time, may be selected based on the conditions of the respective developers and the information on the developer last used. This method permits the selection of the developer having the longest rest time without taking measurement on the respective rest times of the developers.

According to the embodiment as described above, the monochromatic image forming apparatus equipped with the four developers each storing the black toner performs the print readiness/unreadiness determination process (FIG. 22) whenever necessary, thereby monitoring the conditions of the respective developers. Based on the process results, determination is made as to whether the apparatus is in the print-ready state or not. As needed, the predetermined print preparatory process is performed, thereby maintaining the apparatus in the print-ready state as long as possible. Specifically, the apparatus is determined to be able to perform the printing operation if there is at least one developer which is relatively new to be ranked as Rank 1 of the life ranking and can be directly used in the printing operation without undergoing the print preparatory process. In this state, the apparatus can immediately start the printing operation without delay when the print request is applied thereto.

In a case where there is a Rank-1 developer, which goes into a state requiring the agitation operation or the density control operation, the required operation is performed to shift the developer in question to the usable state. If, in this case, there are both of the developer to be returned to the usable state by the agitation operation completed in a relatively short time, and the developer requiring the density control operation taking the longer process time, the agitation operation is performed only on the developer requiring the agitation operation. This results in the reduction of the process time, so that the apparatus may be promptly returned to the print-ready state. Even if there occurs need for performing the print preparatory process on some developer, the print preparatory process is not performed at this point of time so long as there is at least one other usable developer. When there is no usable developer, only the minimum required operation is performed. Accordingly, the print readiness/unreadiness determination process of the embodiment permits the apparatus to be maintained in the print-ready state as long as possible and also permits the print preparatory process to be performed efficiently by omitting the unnecessary operations.

The print preparatory process includes the agitation operation and the density control operation, each of which may be performed on an as-needed basis. The agitation operation is performed on the developer, the rest time of which from the last use exceeds the predetermined value. The agitation operation rotates the developing roller 44 of the developer of interest by the predetermined quantity thereby obviating the shutdown-induced banding. The density control operation is performed on the developer, the residual toner quantity or the developing-roller rotation time of which reaches the predetermined value. The density control operation defines the operating conditions of the apparatus which uses the developer of interest. In a case where there are both of the developer requiring the agitation operation and the developer requiring the density control operation, only the agitation operation taking the shorter process time is performed. This results in the reduction of time period during which the printing operation is disabled for permitting the execution of the print preparatory process.

In a case where there is no Rank-1 developer but the Rank-2 developer deteriorated to a degree is available, as well, the apparatus is determined to be ready to perform the printing operation if there is a print-ready developer. If there is a developer requiring the print preparatory process, the required process is performed on such a developer and thereafter, the apparatus is determined to be able to perform the printing operation. Therefore, the images may be formed by efficiently using the toner in the developers.

In the printing operation according to the embodiment, a developer to be used is selected based on the conditions of the respective developers and the developer last used in the previous operation. The developer thus selected is used to form the images. Therefore, the best developer is always selectively used for the image formation, so that the embodiment ensures the stable formation of images of good quality. Specifically, the embodiment is adapted to select one of the usable developers, that has the longest rest time from the last use. In a case where there are a plural number of Rank-1 developers of the print-ready category, these developers are used for forming images as switched from one to another. Therefore, the use of the developer is not biased toward some particular developer, whereas some other particular developer is not left standstill for long. As a result, the embodiment prevents the occurrence of the density variations (shutdown-induced banding) encountered when the developer left standstill for long is used. Thus, the image quality variations are suppressed while the frequencies of the agitation operations for eliminating the above phenomenon may be minimized.

The changeover of developers is not performed when the Rank-2 developer is used to form images. This obviates the image quality variations resulting from the difference of the conditions of the developers.

The embodiment maintains the apparatus in the print-ready state by performing the print readiness/unreadiness determination process. Therefore, when the print request is actually applied, the apparatus can immediately perform the printing operation without delay. Thus, the printing operation of the embodiment is adapted for image formation with short first print time. Since the frequencies of the print preparatory processes is decreased, the decrease of the throughput of the image forming operation may be minimized, the throughput decreased by performing the print preparatory process during the execution of the printing operation.

According to the embodiment as described above, the engine controller 10 functions as "controller" of the invention, whereas the developing roller 44 disposed in each developer functions as "toner carrier" hereof. Of the two types of preparatory operations, the agitation operation is equivalent to "first preparatory operation" of the invention, whereas the density control operation is equivalent to "second preparatory operation" hereof. A correspondence between each of "first to third states" of the invention, and each of the life ranks and each of the categories according to the embodiment is as follows.

FIG. 26 is a chart which shows the correspondence between the terms used in the claims of the invention and the terms used in the embodiment. As shown in FIG. 26, the developer classified as Life Rank 1 or 2 and into the print-ready category according to the embodiment is equivalent to a developer in "the first state" according to the invention. The developer classified as Life Rank 1 or 2 and into the agitation requiring category or the density-control requiring category according to the embodiment is equivalent to a developer in "the second stage" according to the invention. The developer classified as Life Rank 3 according to the embodiment is equivalent to a developer in "the third state" according to the invention.

It is noted that the invention is not limited to the above embodiment and various changes and modifications other than the above may be made thereto so long as such changes and modifications do not deviate from the scope of the invention. According to the above embodiment, for example, the four developers in maximum are mountable in the support frame 40 of the developing unit 4 and the developers 4Ka to 4Kd are mounted at all the mount positions. However, the invention is also applicable to an apparatus wherein the number of developers mountable in the developing unit 4 is different from this, or to an apparatus wherein only some of the mountable developers are mounted.

According to the print readiness/unreadiness determination process of the above embodiment, in a case where there are plural developers of the same rank and requiring the same operation as the print preparatory process, the print preparatory processes are successively performed on these developers. However, the mode of performing the print preparatory process is not limited to this. For instance, the print preparatory process may be performed only one of these developers. This is because what is necessary is to provide at least one usable developer, as described above. In an alternative approach, for example, the print preparatory process may be performed on these developers in turn, whereas the apparatus may be determined to be able to perform the printing operation at the time when the process on the first developer is completed. The print preparatory process on the un-subjected developers may be restarted after completion of the printing operation. If there is another usable developer, the process at this point of time may be omitted.

While the foregoing embodiment determines the conditions of the respective developers based on the two parameters including the residual toner quantity and the developing-roller rotation time, the information used for determining the conditions of the developer are not limited to these. Alternatively, the conditions of the developer may be determined based only on either one of these information items or on a combination of either one of the information items and another information item.

While the above embodiment permits the image forming operation using the Rank-2 developer, an arrangement may be made such that the user can opt to permit or to inhibit the image forming operation using the Rank-2 developer according to the user's taste or necessity.

Seventh Embodiment

According to the print preparatory process according to the first to sixth embodiments, the apparatus determines the conditions of the respective developers regardless of the existence or absence of the print request from external source, and decides the contents of the print preparatory process based on the determination results. In contrast, a print preparatory process according to a seventh embodiment, to be described as below, starts the process when the print request from external source is applied and defines the contents of the process according to the contents of the print request.

Figure 27:
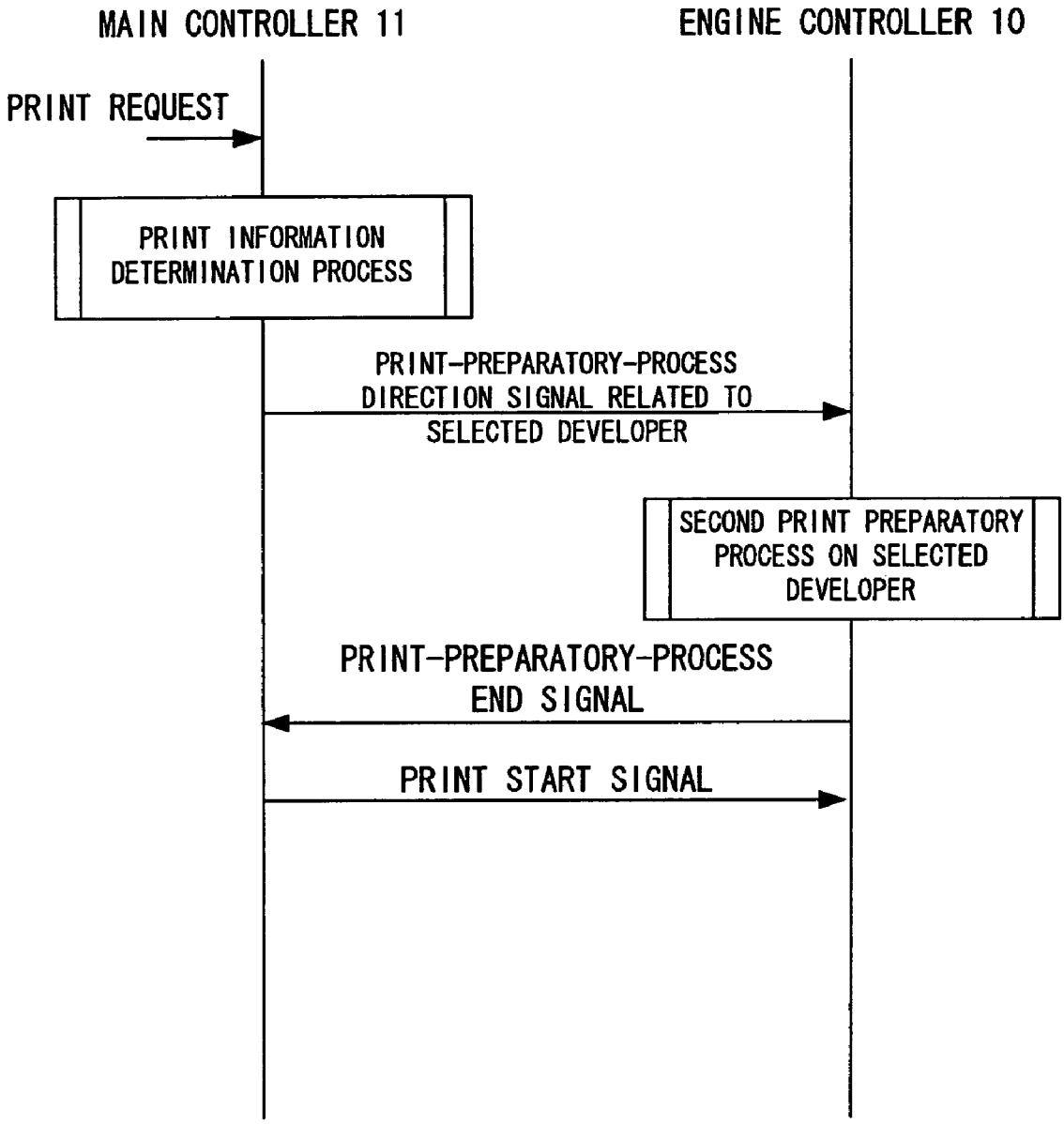
FIG. 27 is a chart which shows a timing of performing the print preparatory process of the seventh embodiment.

FIG. 27 is a chart which shows a timing of performing the print preparatory process of the seventh embodiment. In the seventh embodiment, when the print request from external source is applied, the main controller 11 performs a print information determination process described as below, and selects a developer used for forming an image corresponding to the print request based on the contents of the print request. The main controller 11 outputs to the engine controller 10 a print-preparatory-process direction signal directing to perform a print preparatory process on the selected developer. Receiving the signal, the engine controller 10 performs the print preparatory process. At completion of the print preparatory process, the engine controller outputs to the main controller 11 a signal indicative of the completion of the process. Confirming the completion of the print preparatory process, the main controller 11 outputs a print start signal for effecting a printing operation corresponding to the print request. In response to this signal, the engine controller 10 performs the printing operation to form the image corresponding to the print request.

Figure 28:
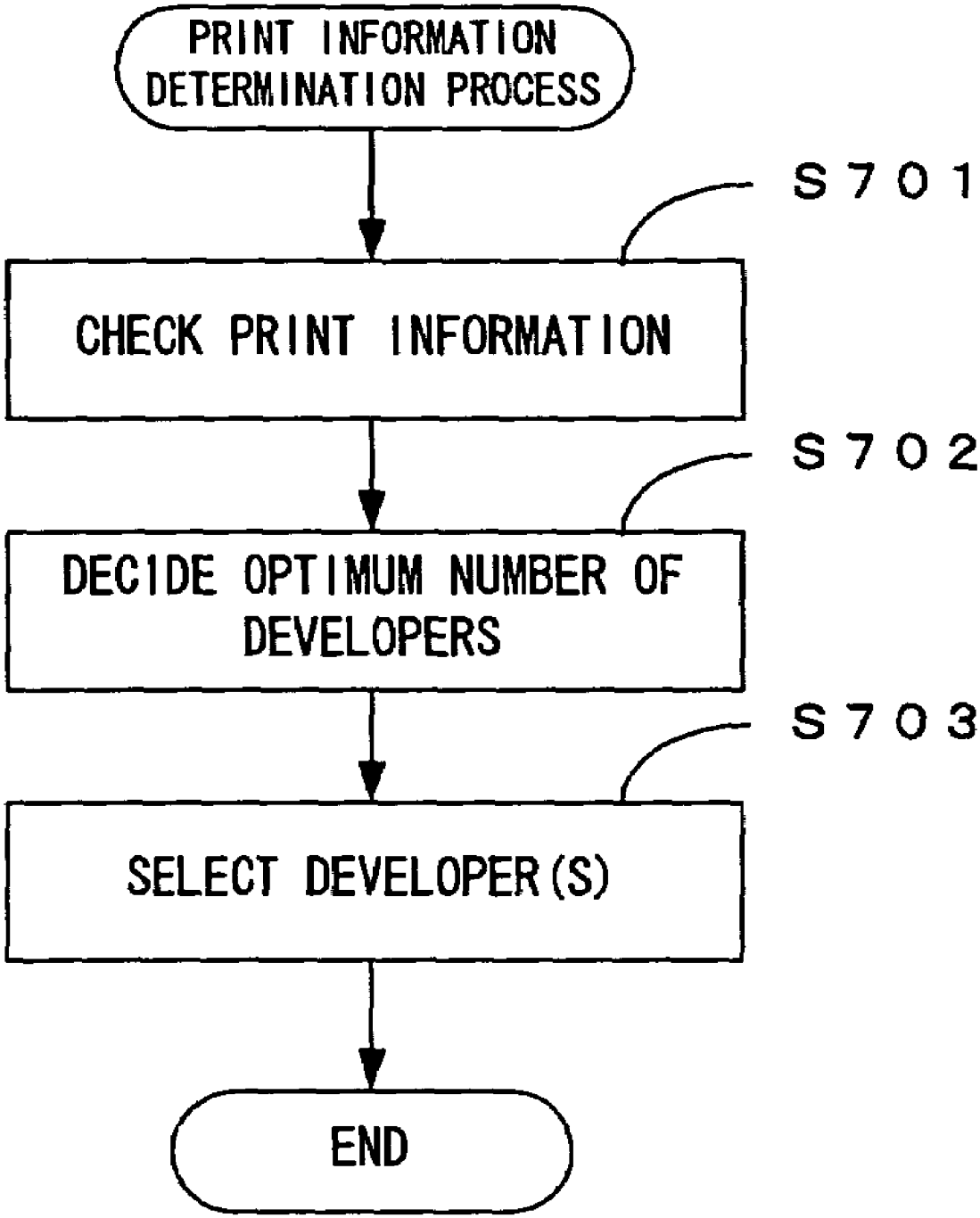
FIG. 28 is a flow chart which shows the steps of the print information determination process of the sixth embodiment.

FIG. 28 is a flow chart which shows the steps of the print information determination process of this embodiment. In this print information determination process, print information contained in the print request inputted to the main controller 11 is first checked (Step S701). The print information means here to include, for example, the number of images to be formed, the level of image quality desired by the user and the like. Then, an optimum number of developers to be brought into the print-ready state by performing the print preparatory process is decided based on the print information thus determined in Step S701 (Step S702). If the number of images to be formed is small, for example, these images may be formed by one developer and hence, the optimum number is 1. On the other hand, if the number of images to be formed is great, it is desirable to form these images as switching from one developer to another. Hence, the optimum number of developers is increased with the increase of the number of images to be formed.

Next, the optimum number of developer(s) are selected from the developers mounted in the developing unit 4 (Step S703). The developer(s) thus selected are subjected to the print preparatory process and are used in the subsequent printing operation. A rule for the selection is so defined as to provide the selection of developer(s) according to the number of images to be formed and the level of image quality. The rule may be defined as follows, for example. In a case where the optimum number of developer is 1, one that can be moved to the development position in the shortest time or one that has the greatest residual toner quantity is selected. In a case where the optimum number of developers is 2, a pair of developers in adjoining relation are selected. In a case where a high image quality is not demanded, those having low residual toner quantities are selected. Those are the contents of the print information determination process.

The engine controller 10 performs the print preparatory process on the developer(s) thus selected. Subsequently, the engine controller carries out the printing operation using these developers. While the contents of the print preparatory process are the same as those of the second print preparatory process, the print preparatory process is not suspended by interruption.

According to the embodiment as described above, some of the developers mounted in the developing unit 4 are selected based on the print request, and the print preparatory process is performed only on the selected developers. In the case of a request for a large volume print, therefore, a corresponding number of developers to the print volume may be selected, and the print preparatory process may be performed on the selected developers thereby establishing a state where the printing operation by way of the selected developers can be performed. Thus, the number of developer to be subjected to the print preparatory process is not fixed, but the optimum number of developers for the execution of the printing operation, as decided based on the print request, are subjected to the print preparatory process. Therefore, the large volume printing may be performed efficiently while the print preparatory process is prevented from compelling the user to wait needlessly long.

It is noted that some of the foregoing embodiments may be practiced as combined properly. That is, the apparatus may be adapted to perform two or more different print preparatory processes. The apparatus may select one of these print preparatory processes based on the input print request, so as to perform the selected print preparatory process. Description is made here by way of example where the aforementioned first and second print preparatory processes are combined.

Figure 29:
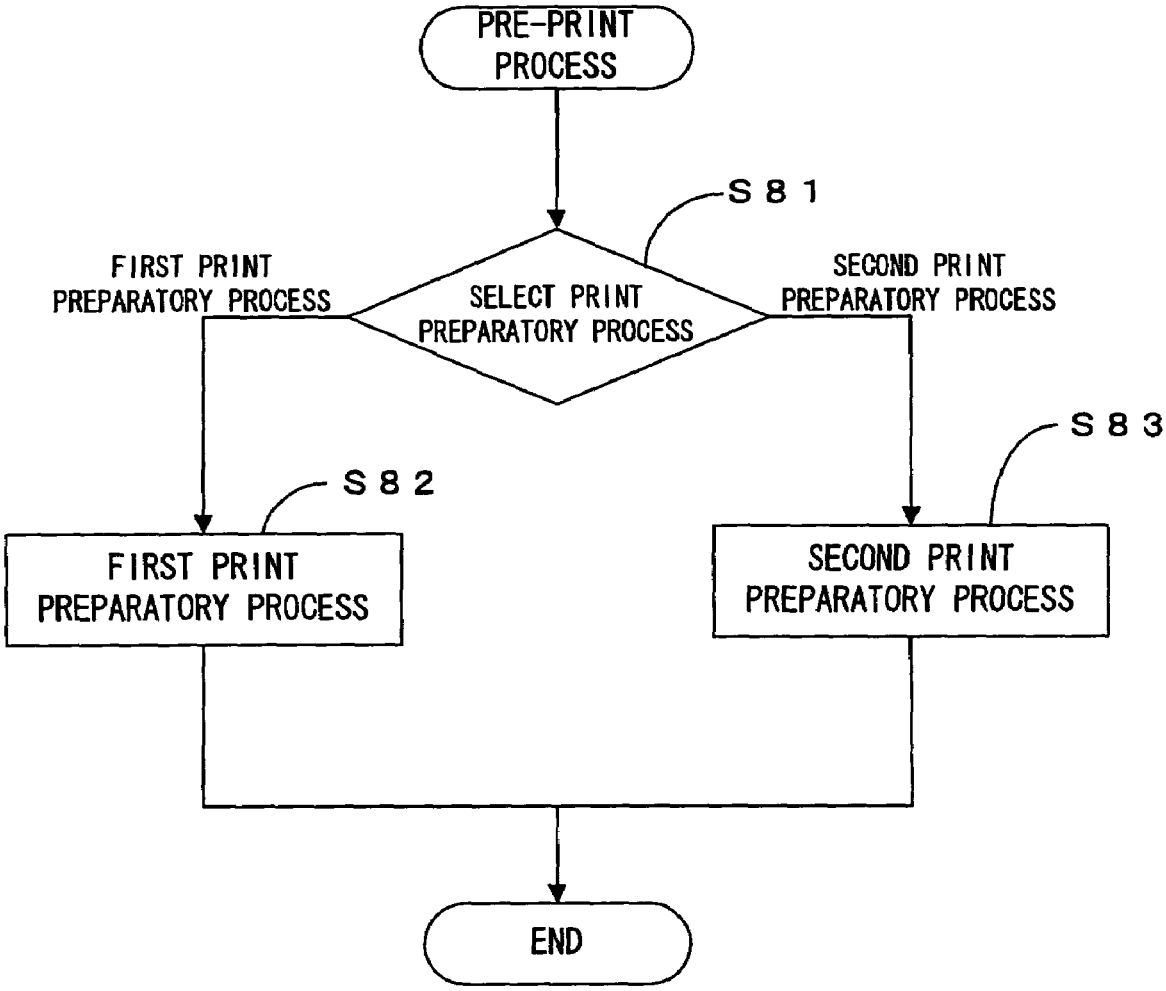
FIG. 29 is a flow chart which shows exemplary operations in the case where the two print preparatory processes are combined.

FIG. 29 is a flow chart which shows exemplary operations in the case where the two print preparatory processes are combined. The main controller 11 may select either the first print preparatory process or the second print preparatory process based on the print request. At a proper time before the execution of the printing operation, like when the developers 4Ka to 4Kd in the engine EG require the print preparatory process, a print preparatory process to be performed is selected (Step S81). More specifically, in a case where the print request from the host computer or the like is already inputted to the main controller 11 at the time when the engine controller 10 determines that the print preparatory process is required, the first print preparatory process is selected and performed (Step S82). If the print request is not inputted at this point of time, the second print preparatory process is selected and performed (Step S83). It is noted here that the contents of the first and second print preparatory processes are the same as those shown in FIG. 5 and FIG. 10.

Prior to the printing operation, the main controller 11 may selectively effect one of the two different print preparatory processes, so that the print preparatory process in the mode according to the print request may be carried out in the engine EG, thereby enabling the printing operation by way of the developer. This permits the monochromatic printing to be performed according to the print request an in an efficient manner. It is noted that the contents of the print preparatory processes as selection options are not limited to those of the first and second print preparatory processes. Alternatively, one of three or more print preparatory processes may be selected and performed.

Eighth Embodiment

In the image forming apparatus 1 arranged as described above, a warm-up operation for raising the temperature of the fixing unit 9 to a predetermined fixing temperature need be performed prior to the execution of the printing operation. By performing the "warm-up operation", the fixing unit 9 is permitted to fix the toner image formed on the sheet S onto the sheet S at the predetermined fixing temperature. This embodiment performs the print preparatory process on the respective developers 4Ka to 4Kd and the warm-up operation on the fixing unit 9 in parallel when needed. Furthermore, the embodiment permits the execution of the printing operation based on information on the temperature of the fixing unit 9 and the execution status of the print preparatory process on the developers 4Ka to 4Kd mounted in the developing unit 4.

The apparatus 1 confirms the temperature information related to the fixing unit 9 based on detection results given by the temperature sensor 91 disposed at the fixing unit 9, thereby determining that the fixing unit 9 is already finished with the warm-up operation so as to be able to fix the toner image formed on the sheet S. If the warm-up operation is not completed yet, the apparatus can figure out how long it will take before the fixing unit 9 is heated to the predetermined fixing temperature. Furthermore, apparatus 1 checks the execution status of the print preparatory process on the developers 4Ka to 4Kd mounted in the developing unit 4, thereby acquiring information on how many developers are already in the print-ready state as subjected to the required process, which of the developers are in the print-ready state, or how long it will take before the print preparatory process is completed. That is, whether the apparatus is already ready to perform the printing operation or not can be known from these information items. If the printing operation is executable, the apparatus can start the printing operation by permitting the execution of the printing operation.

In this embodiment, whether the respective developers 4Ka to 4Kd are print-ready or not can be known from the statuses of the flags provided in the CPU 101, RAM 107 of the engine controller 10 and/or the RAM 117 of the main controller 11. The developers 4Ka to 4Kd become print-ready developers by being subjected to the print preparatory process. As soon as the developers become print-ready or at a suitable time thereafter, the statuses of the flags in the RAM 107 and the like are so updated as to indicate the latest conditions of the developers after the print preparatory process. On the other hand, the information on the developer now undergoing the print preparatory process may be acquired by checking what the CPU 101 in the execution of the print preparatory process is doing.

The flag indicating whether the developer is print-ready or not (hereinafter, referred to as "print-ready/unready flag") may be composed of a flag indicating an inverted value of a logical sum of a value of the aforesaid agitation requiring flag and a value of the density-control requiring flag, for example. If both of the agitation requiring flag and the density-control requiring flag are reset (neither of the operations is required), the print-ready/unready flag is set, thus indicating a state where the developer of interest is print-ready. On the other hand, if at least one of the agitation requiring flag and the density-control requiring flag is set, the print-ready/unready flag is reset, thus indicating a state where the developer of interest is not print-ready.

On the other hand, the fixing unit 9 is drivably controlled by the CPU 101 of the engine controller 10. As needed, the CPU 101 confirms the detection results given by the temperature sensor 91 disposed at the fixing unit 9, thereby confirming the temperature information related to the fixing unit 9. In this manner, the CPU determines whether the apparatus is already ready to perform the printing operation or not by confirming the temperature information related to the fixing unit 9 and the execution status of the print preparatory process on the developers 4Ka to 4Kd mounted in the developing unit 4. If the apparatus is able to perform the printing operation, the CPU can start the printing operation by permitting the execution of the printing operation.

Next, referring to FIG. 30 to FIG. 33, a detailed description is made on an example of a printing-operation executability determination based on the temperature information related to the fixing unit 9 and the execution status of the print preparatory process on the developers 4Ka to 4Kd mounted in the developing unit 4. Of the symbols used in FIG. 30 to FIG. 33, those beginning with a capital T represent the temperature of the fixing unit 9, whereas those beginning with a lowercase letter t represent time.

Figure 30:
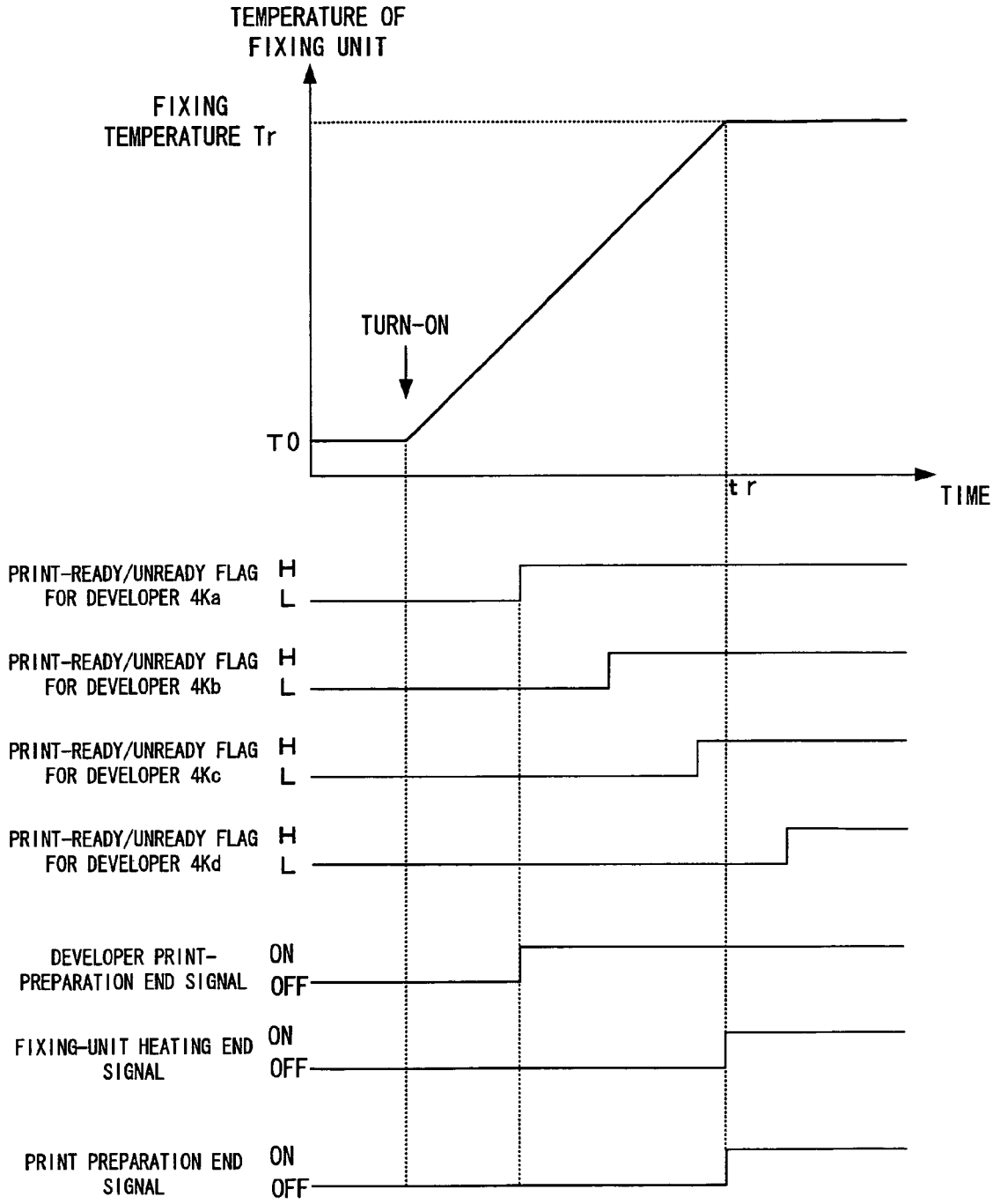
FIG. 30 is a chart which shows the relation between the temperature change of the fixing unit at turn-on and the execution status of the print preparatory process.

(1) Where Warm-Up of Fixing Unit Is Conducted Immediately after Turn-On and in Parallel with Print preparatory Process on Developers FIG. 30 is a chart which shows the relation between the temperature change of the fixing unit at turn-on and the execution status of the print preparatory process. Prior to the turn-on of the apparatus, the temperature of the fixing unit 9 is at T0 near room temperature at place where the apparatus is installed. When the apparatus is turned on, the engine controller 10 starts the warm-up operation on the fixing unit 9 and continues the operation till the temperature of the fixing unit reaches a predetermined fixing temperature Tr. In parallel with the warm-up operation on the fixing unit 9, the engine controller 10 also performs the print preparatory process on the developers 4Ka to 4Kd mounted in the developing unit 4.

When the print preparatory process on the developers 4Ka to 4Kd is completed and the developers become print-ready, the engine controller 10 updates the print-ready/unready flags for the respective developers. In this example, the engine controller 10 outputs a developer print-preparatory-process end signal when the first one of the developers 4Ka to 4Kd becomes print-ready (at time when the developer 4Ka becomes print-ready, in FIG. 30). When the temperature of the fixing unit 9 reaches the predetermined fixing temperature Tr, the engine controller 10 outputs a fixing-unit heating end signal and terminates the warm-up operation on the fixing unit 9. According to the example shown in FIG. 30, the developer 4Kd is not yet become print-ready at the time (tr) of completion of the warm-up operation, but the other developers 4Ka to 4Kc already become print-ready. Therefore, it is possible to start the image forming operation at this point of time. Hence, the engine controller 10 outputs the print preparation end signal to the main controller 11, so as to permit the execution of the printing operation.

(2) Where Warm-Up Operation Is Conducted in Parallel with Print Preparatory Process at Reversion from Sleep Mode (Print Standby)

Figure 31:
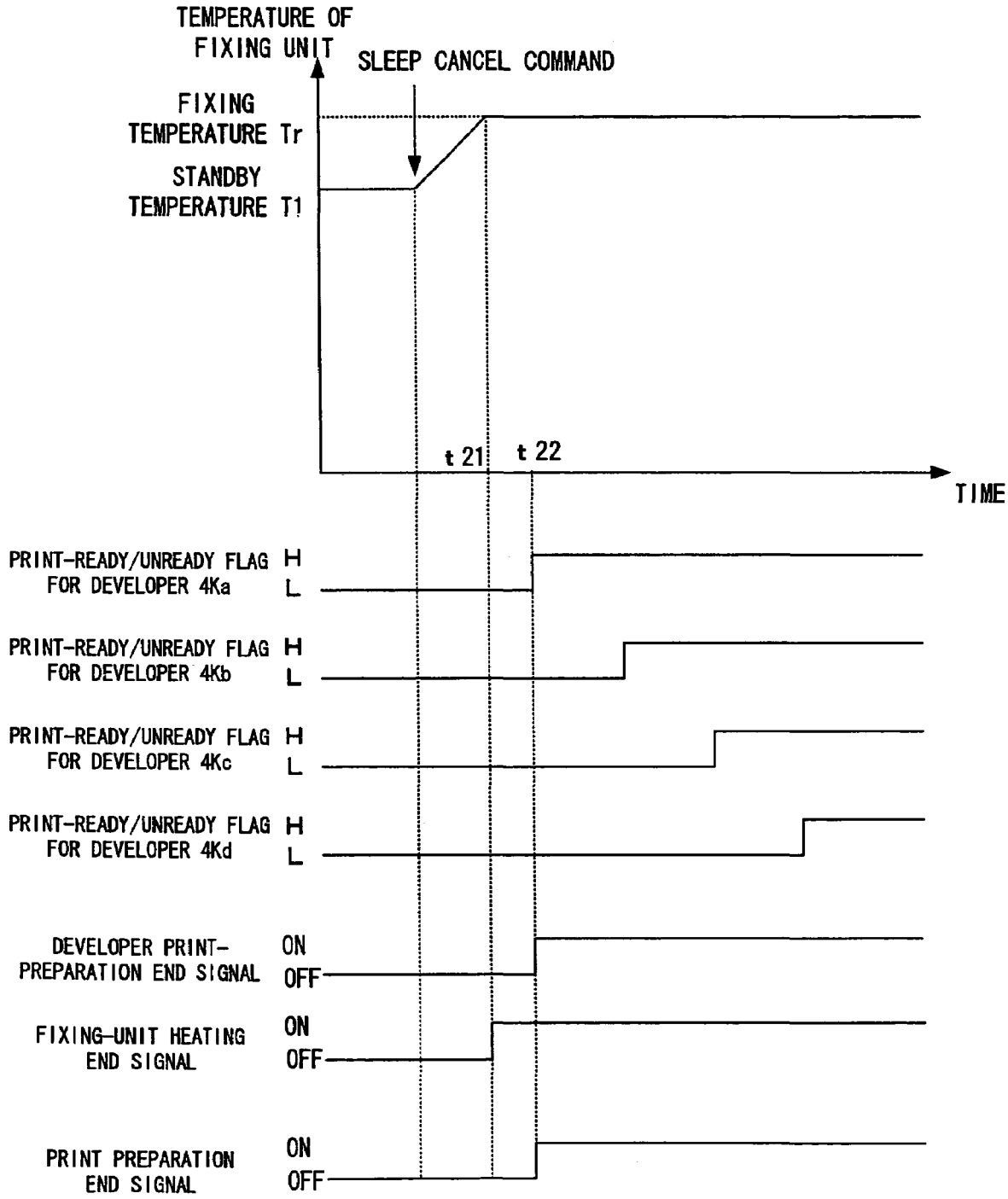
FIG. 31 is a chart which shows the relation between the temperature change of the fixing unit and the execution status of the print preparatory process at reversion from a sleep mode.

FIG. 31 is a chart which shows the relation between the temperature change of the fixing unit and the execution status of the print preparatory process at reversion from a sleep mode. In the sleep mode, the temperature of the fixing unit 9 is at a standby temperature T1 which is lower than the fixing temperature Tr but higher than the room temperature. In response to a cancel command directing to cancel the sleep mode, the engine controller 10 starts the warm-up operation on the fixing unit 9 and continues the warm-up operation until the temperature of the fixing unit 9 reaches the predetermined fixing temperature Tr. In parallel with the warm-up operation on the fixing unit 9, the engine controller 10 also performs the print preparatory process on the developers 4Ka to 4Kd.

When the temperature of the fixing unit 9 reaches the predetermined fixing temperature Tr, the engine controller 10 outputs the fixing-unit heating end signal and terminates the warm-up operation on the fixing unit 9 (time t21). Since the temperature of the fixing unit 9 at the receipt of the cancel command is near the fixing temperature Tr, the warm-up operation takes a short time. At the time of completion of the warm-up operation (time t21), therefore, none of the developers 4Ka to 4Kd is finished with the print preparatory process. When the developers 4Ka to 4Kd become print-ready, the engine controller 10 sets print-ready flags for the respective developers. When the first one of the developers 4Ka to 4Kd becomes able to print (time t22), the engine controller outputs the developer print-preparatory-process end signal (at the time when the developer 4Ka becomes print-ready, in FIG. 31). The fixing unit 9 is already heated to the fixing temperature Tr at the time t22 of output of the print preparation end signal and hence, the engine controller 10 outputs the print preparation end signal for permitting the apparatus to perform the printing operation.

(3) Where One or More Developers Are Print-Ready at Reversion from Sleep Mode

Figure 32:
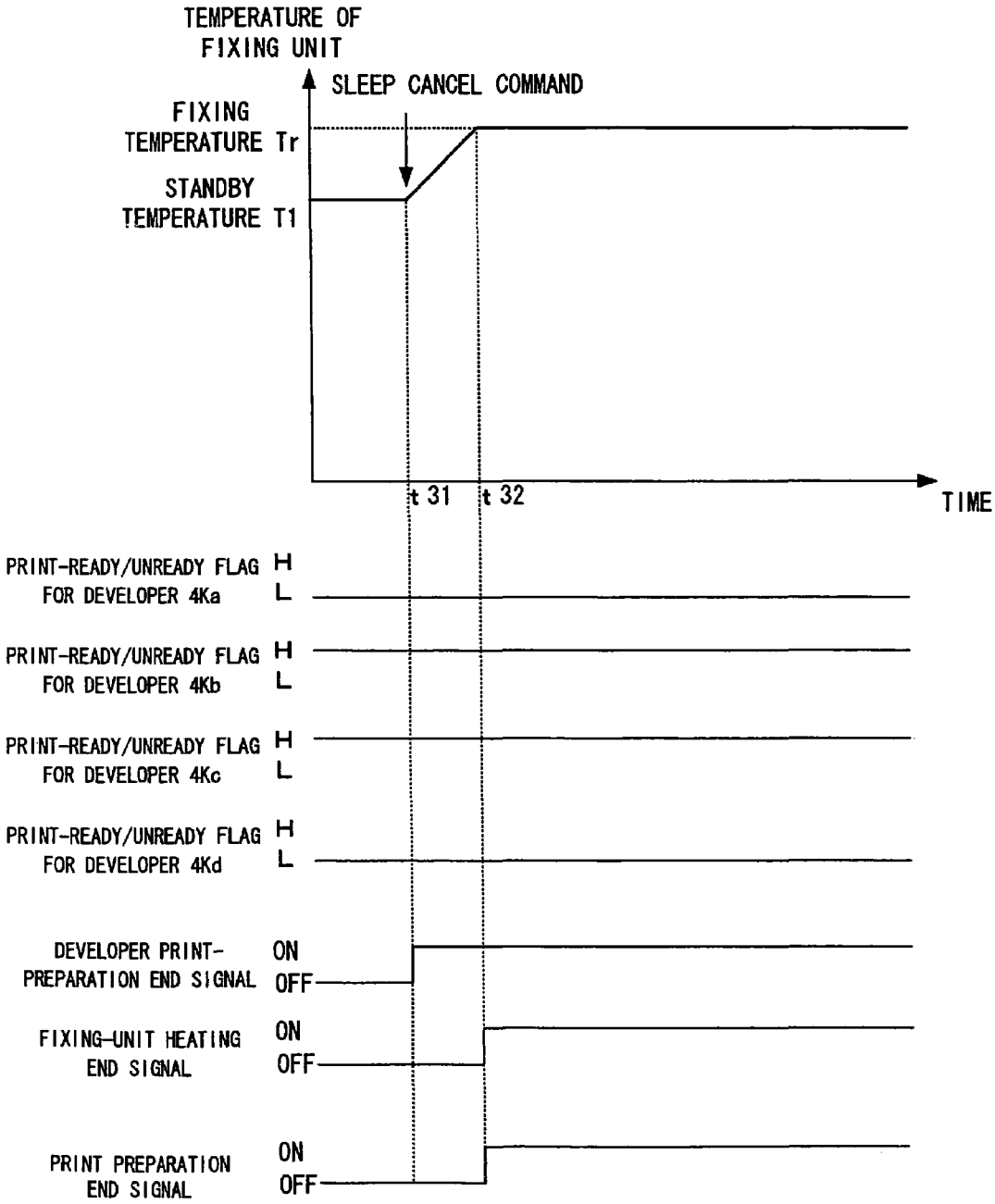
FIG. 32 is a chart which shows the relation between the temperature change of the fixing unit and the execution status of the print preparatory process at reversion from the sleep mode.

FIG. 32 is a chart which shows the relation between the temperature change of the fixing unit and the execution status of the print preparatory process at reversion from the sleep mode. This example differs from the above two cases in that at least one of the developers 4Ka to 4Kd mounted in the developing unit 4 is in the print-ready state at the time of receipt of the cancel command (time t31). In a case where the sleep mode is cancelled shortly after the transfer of the apparatus to the sleep mode, for example, the developer may sometimes maintain the print-ready state. In such a case, the engine controller 10 does not carry out the print preparatory process.

In the sleep mode, on the other hand, the temperature of the fixing unit 9 is at the standby temperature Ti which is lower than the fixing temperature Tr. Hence, in response to the cancel command outputted for reversion from the sleep mode, the engine controller 10 starts to warm up the fixing unit 9 and continues the warm-up operation until the temperature of the fixing unit reaches the predetermined fixing temperature Tr.

When the temperature of the fixing unit reaches the predetermined fixing temperature Tr, the engine controller 10 outputs the fixing-unit heating end signal and terminates the warm-up operation on the fixing unit 9 (time t32). Thus are satisfied the conditions that the fixing unit 9 is at the fixing temperature Tr and that at least one of the developers is print-ready. Hence, the engine controller 10 outputs the print preparation end signal and permits the apparatus to perform the printing operation.

(4) Where All the Developers Are Replaced

Figure 33:
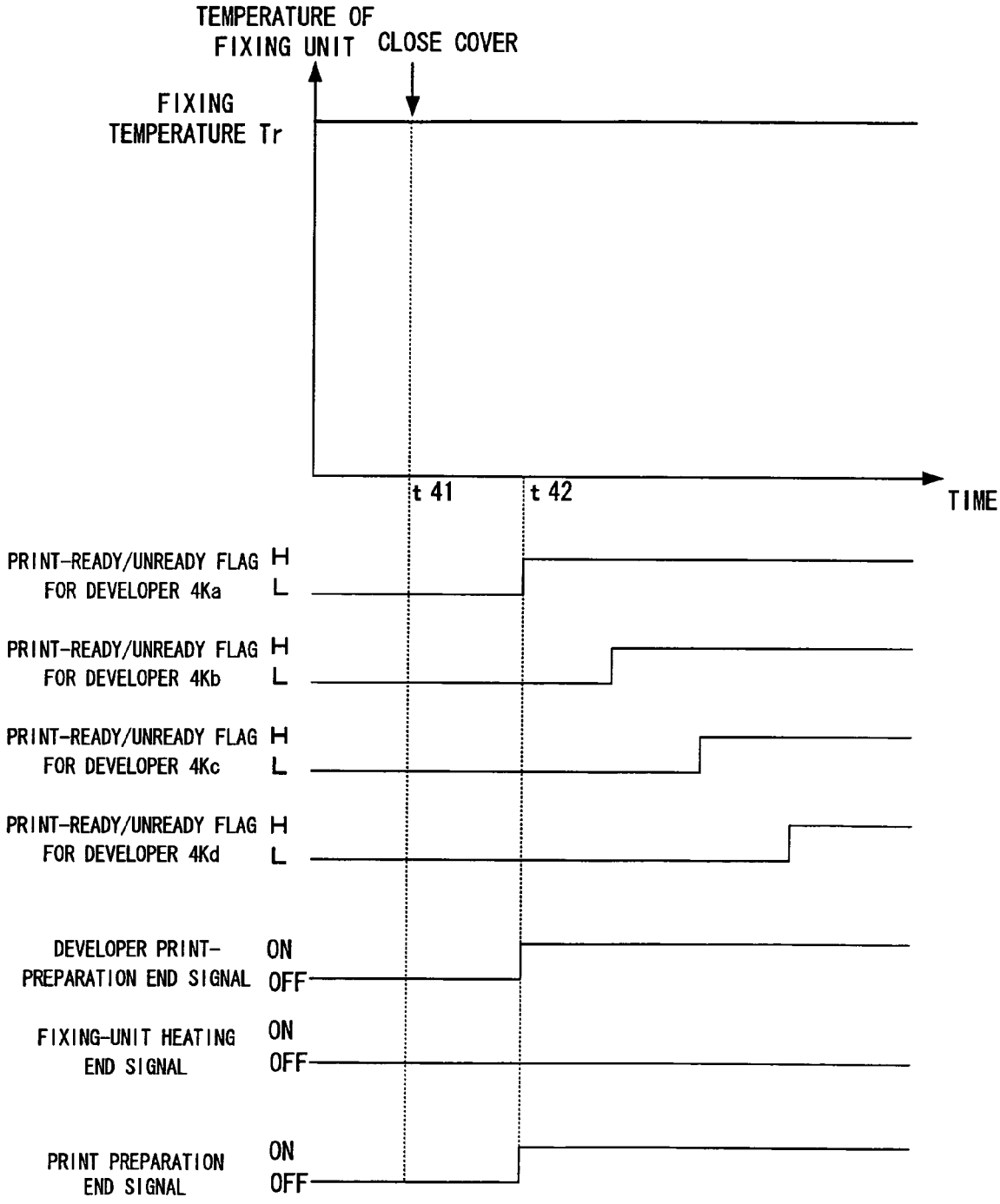
FIG. 33 is a chart which shows the relation between the temperature of the fixing unit and the execution status of the print preparatory process at replacement of the developers.

FIG. 33 is a chart which shows the relation between the temperature of the fixing unit 9 and the execution status of the print preparatory process at replacement of the developers. Immediately after the replacement of the developers, all the developers 4Ka to 4Kd are in a print-unready state. In a case where the replacement of all the developers 4Ka to 4Kd is completed in a short time, the temperature drop of the fixing unit 9 is little so that the fixing unit 9 is maintained at the fixing temperature Tr. In such a case, the engine controller 10 performs the print preparatory process on the developers 4Ka to 4Kd at time t41 when the replacement of the developers is completed and the cover is closed. However, the engine controller does not perform the warm-up operation on the fixing unit 9 because the fixing unit 9 is maintained at the fixing temperature Tr.

When the first one of the developers 4Ka to 4Kd becomes print-ready time t42), the engine controller 10 outputs the developer print-preparatory-process end signal (at the time when the developer 4Ka becomes print-ready, in FIG. 33). At time t42, the fixing unit 9 is already at the predetermined temperature Tr, whereas one 4Ka of the developers mounted in the developing unit 4 is in the print-ready state. Grasping this fact, the engine controller 10 outputs the print preparation end signal for permitting the apparatus to perform the printing operation.

Figure 34:
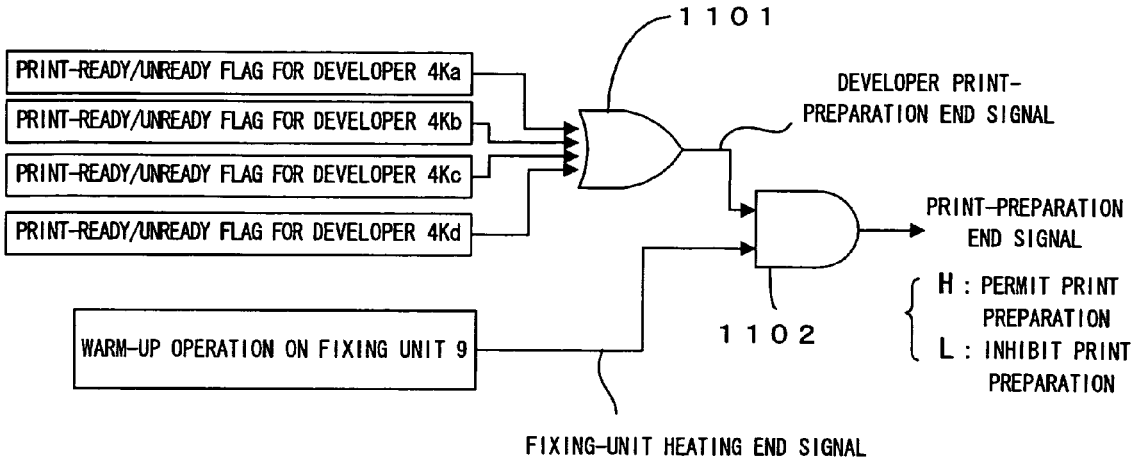
FIG. 34 is a diagram which shows an exemplary arrangement for implementation of a permission process for printing operation according to the eighth embodiment.

FIG. 34 is a diagram which shows an exemplary arrangement for implementation of a permission process for printing operation according to the embodiment. The respective values of the print-ready/unready flags corresponding to the developers 4Ka to 4Kd are inputted to a logical sum circuit 1101, an output from which is equivalent to the aforesaid "developer print-preparation end signal". This output signal and a signal indicative of the completion of the warm-up operation on the fixing unit 9 (the aforesaid "fixing-unit heating end signal") are inputted to an AND circuit 1102, an output from which is equivalent to the aforesaid "print preparation end signal". If print preparation end signal is at H-level, the apparatus is permitted to perform the printing operation. When the signal is at L-level, the execution of the printing operation is inhibited.

While the contents of the print preparatory process may be those of any one of the above first to fifth embodiments, it is desirable to permit the acceptance of the interruption based on the print request after the warm-up operation is completed.

According to the embodiment as described above, the following working effects may be obtained because the printing operation is permitted based on the temperature information related to the fixing unit 9 and the execution status of the print preparatory process. Immediately after turn-on or at reversion from the sleep mode (print standby state), the print preparatory process is performed in parallel with the warm-up operation. It is noted here that the warm-up operation immediately after turn-on takes a different length of time from that taken by the warm-up operation at reversion from the sleep mode. Particularly in the sleep mode, the fixing unit 9 is maintained at a higher temperature than the room temperature, so that the warm-up operation at reversion from the sleep mode takes a shorter length of time. Nonetheless, if the printing operation is not permitted until completion of the print preparatory process on all the developers, it is actually possible to start printing using some developer already finished with the print preparatory process but the printing operation cannot be started until the process on the remaining developer is completed. If, on the other hand, the printing operation is permitted at completion of the print preparatory process on one developer but irrespective of the progress of the warm-up operation, a fear exists that the temperature of the fixing unit 9 may not be raised sufficiently, resulting in fix failure.

In contrast, the embodiment permits the printing operation based on the temperature information related to the fixing unit 9 and the execution status of the print preparatory process. Although all the developers are not finished with the print preparatory operation, the printing operation can be performed using some developer already finished with the print preparatory operation and able to print. Thus, the embodiment provides an efficient image formation with short first print time. If at least one of the developers is in the print-ready state at completion of the heating of the fixing unit 9, the printing operation may be performed even though the other developers are unready to print.

Ninth Embodiment

Figure 35:
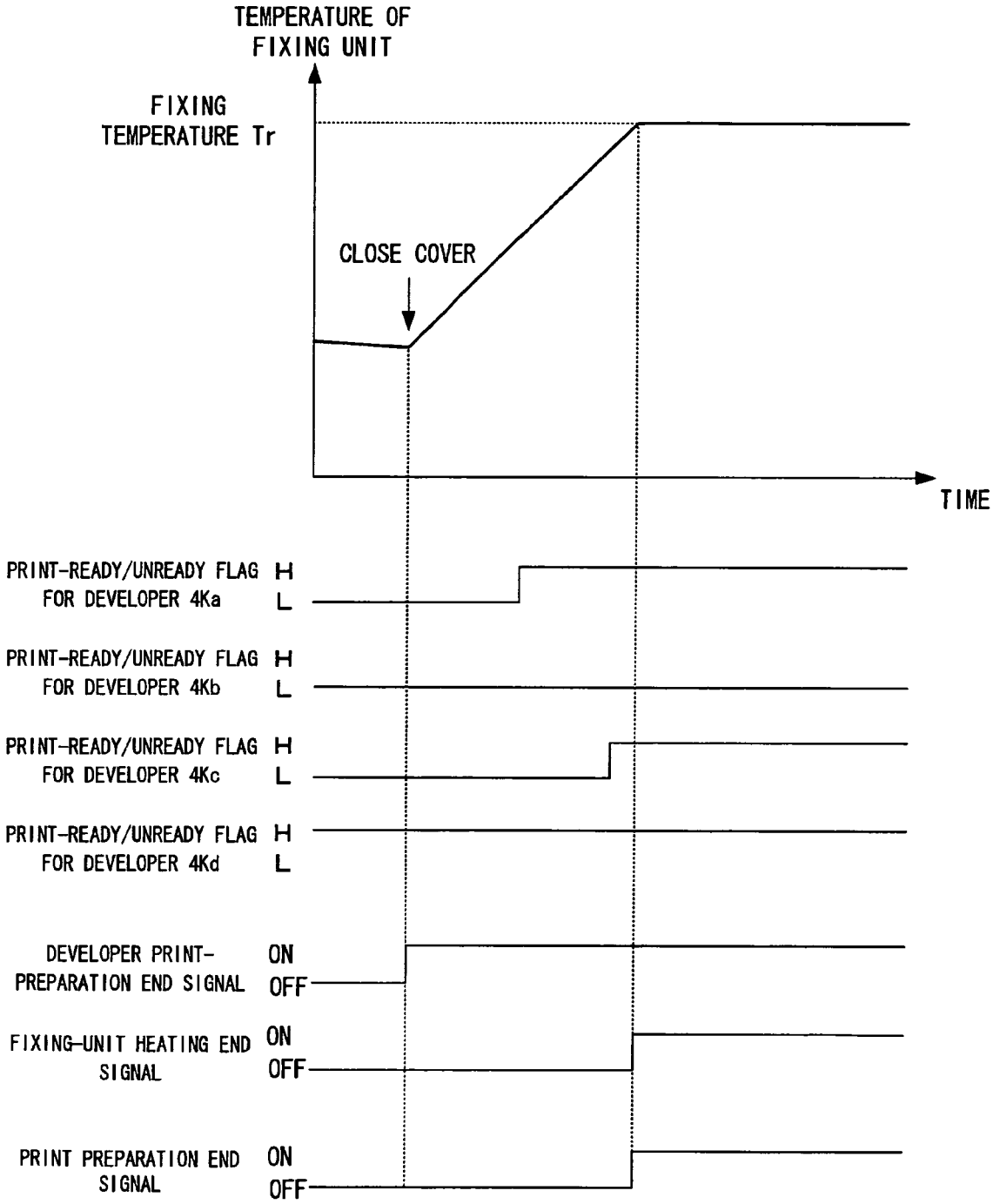
FIG. 35 is a chart which shows an example of operations of the image forming apparatus according to a ninth embodiment of the invention.

FIG. 35 is a chart which shows an example of operations of the image forming apparatus according to a ninth embodiment of the invention. The ninth embodiment principally differs from the eighth embodiment in that a developer to be subjected to the print preparatory process is selected based on the temperature information related to the fixing unit 9 and the execution status of the print preparatory process on the developers 4Ka to 4Kd mounted in the developing unit 4, and that the print preparatory operation is performed only on the selected developer. Specifically, when the warm-up operation and the print preparatory process are to be started, the embodiment estimates, from the temperature information related to the fixing unit 9 at the current point of time, the number of developers which can finish with the print preparatory process in a time period up to the completion of the warm-up operation. Furthermore, the embodiment determines whether each of the developers requires the print preparatory process or not. If the number of developers requiring the print preparatory process is greater than the estimated number of developers, the print preparatory process is performed only on the estimated number of developers.

FIG. 35 illustrates a case where at closure of the opened cover of the apparatus, only the developer 4Kd is in the print-ready state, whereas the temperature of the fixing unit 9 is at Tx which is lower than the fixing temperature Tr. It is assumed here that two developers can be subjected to the print preparatory process during a time period in which the temperature of the fixing unit 9 is raised from Tx to Tr. The print preparatory process is performed on two developers 4Ka, 4Kc out of the print-unready developers 4Ka to 4Kc mounted in the developing unit 4. The various information items temporarily stored in the RAM 107 and the like, such as the statuses of the various flags related to the developers and the management of consumable article, may be used for the selection of the developers to be subjected to the print preparatory process. After the developers to be subjected to the print preparatory process are thus selected, the print preparatory operation is performed on the selected developers, whereby an efficient print preparatory operation may be accomplished without wasting time till the completion of the warm-up operation.

According to the eighth embodiment, after one of the developers mounted in the developing unit 4 is made print-ready, the print preparatory operation on the other developers is continued till the output of the heating end signal after completion of the warm-up operation on the fixing unit 9. However, no consideration is given to the progress of the print preparatory operation on the other developers. Hence, an alternative arrangement may be made such that the fixing unit 9 is checked for the completion of the warm-up operation each time each of the developers mounted in the developing unit 4 is made print-ready by the print preparatory operation.

Other Modifications

It is to be noted that the invention is not limited to the foregoing embodiments and various changes and modifications other than the above may be made thereto unless such changes and modifications depart from the scope of the invention. In the foregoing embodiments, for instance, the four developers in maximum are mountable in the support frame 40 of the developing unit 4 and the developers 4Ka to 4Kd are mounted at all the mount positions. However, the invention is also applicable to an apparatus wherein the mountable developers are mounted at only some of the mount positions. That is, in an apparatus having a smaller number M ($M \geqq 2$) of developers than the mountable number mounted in the developing unit 4, as well, it is also possible to obtain the same effects as the aforementioned working effects by determining whether the developers mounted in the developing unit are print-ready or not, and performing the print preparatory process according to the determination results. While the foregoing embodiments define the mountable number as four, the mountable number is optional. Furthermore, the M value is also optional so long as the M value is 2 or more and not more than the mountable number. Therefore, the invention is also applicable to an image forming apparatus, for example, wherein the developing unit 4 is so designed as to mount five or more developers in the support frame 40, and wherein the yellow, cyan and magenta developers are mounted at three mount positions, respectively, whereas the black developers are mounted at the remaining mount positions.

According to the foregoing embodiments, the toner image on the photosensitive member 22 is transferred onto the sheet S via the intermediate transfer belt 71. However, an alternative arrangement may also be made such that the toner image on the photosensitive member 22 is directly transferred on to the sheet S, without using the intermediate transfer belt 71.

While the foregoing embodiments apply the invention to the image forming apparatus equipped with the developers containing the black toner, the toner color is not limited to this.

Since the foregoing embodiments adopt the rotary development system wherein the plural developers are mounted in the developing unit 4, the toner stored in the individual developers is agitated therein in conjunction with the revolving movement of the developing unit 4 whereby the toner is homogenized. Furthermore, the toner in the developers may be agitated and homogenized prior to the printing operation, thereby achieving the improvement and stabilization of image quality. As the print preparatory process, therefore, the developing unit 4 may be rotated for the purpose of agitating the toner in the developers. In some practice of the art, a conventional technique is adopted, wherein a member such as agitator or auger rod is disposed in the developer for agitating the toner therein or for actively supplying the toner to the developing roller. Hence, the apparatus equipped with the member, such as agitator or auger rod, may operate the member to perform an operation, such as toner agitation or toner supply, as the print preparatory process.

The foregoing embodiments adopt the arrangement wherein only the toner contained in the developers is used. However, in an apparatus employing a replenishable developer which is replenished with toner from a separate toner tank as required, an operation of replenishing the developer with the toner from the toner tank may also be performed as the print preparatory process.

While the foregoing embodiments employ the four developers 4Ka to 4Kd of the same configuration, developers of different configurations are also usable. The foregoing embodiments apply the invention to the so-called rotary-type image forming apparatus wherein a single photosensitive member 22 is provided with the rotary developing unit 4. However, the invention is also applicable to an elevator-type image forming apparatus wherein plural developers are each adapted to move up/down relative to a single photosensitive member 22 for performing the developing operation, and a so-called tandem-type image forming apparatus.

Furthermore, the invention is not limited to the arrangements of the foregoing embodiments. The invention is also applicable to, for example, an apparatus which includes a developing unit equipped with plural toner cartridges containing a toner of a specific color and which forms an image of the specific color; apparatuses including the other transfer media (transfer drum, transfer sheet and such) than the intermediate transfer belt; and other image forming apparatuses such as copiers and facsimiles.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a plurality of developers each storing a toner of the same color; and a controller responding a print request from external source to perform a printing operation using the developer, wherein the controller monitors the respective states of the plural developers for determining whether the developer is in a first state where the developer can be directly used in the printing operation, or in a second state where the developer can be shifted to the first state by subjecting the developer to a predetermined print preparatory process before the developer is used in the printing operation, and wherein the controller performs the print preparatory process on a developer in the second state when determining that none of the plural developers is in the first state.

2. An image forming apparatus according to claim 1, wherein if at least one of the plural developers is in the first state, the controller accepts the print request and performs the printing operation using the developer in the first state without performing the print preparatory process.

3. An image forming apparatus according to claim 1, wherein each of the developers comprises a toner carrier designed to rotate as carrying the toner on its surface, and wherein the controller performs the print preparatory process including an agitation operation of rotating the toner carrier mounted in the developer by a predetermined quantity.

4. An image forming apparatus according to claim 3, wherein the controller checks each developer and determines the developer to be in the second state when a rest time of the developer reaches a predetermined length as measured from the end of its use in the last performed one of the preceding printing operation and print preparatory process.

5. An image forming apparatus according to claim 1, wherein the controller performs the print preparatory process including a density control operation for adjusting operating conditions of individual parts of the apparatus thereby controlling a density of an image to a predetermined target density, the image formed by the printing operation using the developer.

6. An image forming apparatus according to claim 5, wherein the controller checks each developer and determines the developer to be in the second state when a residual quantity of toner in the developer is decreased to a predetermined threshold value.

7. An image forming apparatus according to claim 5, wherein each of the developers comprises a toner carrier designed to rotate as carrying the toner on its surface, and wherein the controller checks each developer and determines the developer to be in the second state when a quantity of rotation or a cumulative rotation time of the toner carrier disposed in the developer reaches a predetermined threshold value.

8. An image forming apparatus according to claim 6, wherein the threshold value is changed when the preparatory operation is performed.

9. An image forming apparatus according to claim 1, wherein in a case where the plural developers are in the second state and include one which can be shifted to the first state by performing a predetermined first print preparatory process thereon and one which can be shifted to the first state by performing a second print preparatory process thereon, the second preparatory process requiring a longer process time than the first print preparatory process, the controller performs the first print preparatory process, as the print preparatory process, on the developer which are included in those in the second state and which can be shifted to the first state by performing the first print preparatory process thereon.

10. An image forming apparatus according to claim 9, wherein in a case where all the developers in the second state require the second print preparatory process to be shifted to the first state, the controller performs the second print preparatory process, as the print preparatory process, on these developers.

11. An image forming apparatus according to claim 9, wherein each of the developers comprises a toner carrier designed to rotate as carrying the toner on its surface, and wherein the controller rotates the toner carrier mounted in the developer by a predetermined quantity, as the first print preparatory process, whereas the controller performs a density control operation, as the second print preparatory process, for adjusting operating conditions of individual parts of the apparatus thereby controlling a density of an image to a predetermined target density, the image formed by the printing operation using the developer.

12. An image forming apparatus according to claim 1, wherein the controller stops accepting the print request when all the developers are in a third state where determining the developer cannot be shifted to the first state.

13. An image forming apparatus comprising:

a latent image carrier capable of carrying an electrostatic latent image;

a developing unit removably provided with a plurality of developers each having a toner of the same color; and a controller for performing a printing operation in response to a print request by selectively using any one of the developers mounted in the developing unit, the printing operation developing the electrostatic latent image on the latent image carrier using the toner in the developer, wherein the controller optimizes a print preparatory process based on the print request, the print preparatory process performed prior to the execution of the printing operation in order to enable the printing operation by the developer.

14. An image forming apparatus according to claim 13, wherein the controller comprises:

a first controller section for receiving the print request; and a second controller section for performing the print preparatory process or the printing operation in response to a control command from the first controller section, wherein the first controller section optimizes the print preparatory process based on the print request and applies to the second controller section a control command directing the second controller section to perform the optimized print preparatory process.

15. An image forming apparatus according to claim 14, wherein the first controller section selects, as a priority developer, one developer mounted in the developing unit when the print request is inputted, and then applies to the second controller section a control command directing to perform the print preparatory process only on the priority developer.

16. An image forming apparatus according to claim 14, wherein the second controller section outputs to the first controller section a print-preparatory-process request signal for requesting permission to perform the print preparatory process, and wherein in a case where the print request is inputted when the print-preparatory-process request signal is inputted from the second controller section, the first controller section selects, as a priority developer, one developer mounted in the developing unit, and then applies to the second controller section a control command directing to perform the print preparatory process only on the priority developer.

17. An image forming apparatus according to claim 14, wherein the second controller section outputs to the first controller section a print-preparatory-process request signal for requesting permission to perform the print preparatory process, and wherein in a case where the print request is not inputted when the print-preparatory-process request signal is inputted from the second controller section, the first controller section applies to the second controller section a control command directing to perform the print preparatory process on all the developers mounted in the developing unit.

18. An image forming apparatus according to claim 17, wherein in a case where the print request is inputted during the execution of the print preparatory process, the first controller section applies to the second controller section a control command directing to interrupt the print preparatory process, confirms the interruption of the print preparatory process and then, applies to the second controller section a control command directing to start the printing operation using a developer which is already finished with the print preparatory process to become print-ready.

19. An image forming apparatus according to claim 18, wherein after confirming the termination of the printing operation, the first controller section applies to the second controller section a control command directing to perform the print preparatory process on the remaining developers which are to be subjected to the print preparatory process but are not yet subjected to the process.

20. An image forming apparatus according to claim 17, wherein in a case where there is at least one print-ready developer when the print request is inputted during the execution of the print preparatory process, the first controller section applies to the second controller section a control command directing to interrupt the print preparatory process, confirms the interruption of the print preparatory process and then, applies to the second controller section a control command directing to start the printing operation using the print-ready developer.

21. An image forming apparatus according to claim 20, wherein after confirming the termination of the printing operation, the first controller section applies to the second controller section a control command directing to perform the print preparatory process on the remaining developers which are to be subjected to the print preparatory process but are not yet subjected to the process.

22. An image forming apparatus according to claim 14, wherein the first controller section selects, as selected developer(s), some of the developers mounted in the developing unit based on the print request, and applies to the second controller section a control command directing to perform the print preparatory process on the selected developer(s).

23. An image forming apparatus according to claim 14, wherein the first controller section is designed to be able to select one print preparatory process from the plural different print preparatory processes, the first controller section selecting one of the plural print preparatory processes based on the print request, and applying to the second controller section a control command directing to perform the one print preparatory process.

24. An image forming apparatus according to claim 14, wherein the second controller section performs the print preparatory process including a mounting confirmation operation for confirming the mounting of the developer in the developing unit.

25. An image forming apparatus according to claim 14, wherein the second controller section performs the print preparatory process including a suitability confirmation operation for confirming that the developer mounted in the developing unit has a toner of a specific color.

26. An image forming apparatus according to claim 14, wherein the second controller section performs the print preparatory process including a life confirmation operation for confirming that a required amount of toner for performing the printing operation remains in the developer mounted in the developing unit.

27. An image forming apparatus according to claim 14, wherein each of the plural developers comprises a toner carrier rotating in a predetermined direction as carrying the toner on its surface, thereby transporting the toner to an opposed position to the latent image carrier, and wherein the second controller section performs the print preparatory process including an agitation operation of rotating the toner carrier through at least one revolution.

28. An image forming apparatus according to claim 14, wherein the second controller section performs the print preparatory process including a condition control operation for adjusting a printing operation condition to an optimum condition, the printing operation condition under which the printing operation is performed by the developer mounted in the developing unit.

29. An image forming apparatus according to claim 13, wherein the developing unit has M (M denoting an integer of 2 or more) developers mounted therein.

30. An image forming apparatus comprising:

a latent image carrier capable of carrying an electrostatic latent image;

a developing unit removably provided with a plurality of developers each having a toner of the same color; and a controller for performing a printing operation wherein the developer mounted in the developing unit is selectively used for developing the electrostatic latent image on the latent image carrier by using the toner in the developer, wherein the controller determines whether each of the developers mounted in the developing unit is in a print-ready state or not, and performs a print preparatory process in a mode according to the determination results prior to the execution of the printing operation, the print preparatory process performed to enable the printing operation by the developer.

31. An image forming apparatus according to claim 30, wherein the controller permits the execution of the printing operation if at least one of the developers mounted in the developing unit is print-ready.

32. An image forming apparatus according to claim 30, wherein the controller comprises:

a first controller section for receiving a print request; and a second controller section for performing the print preparatory process or the printing operation in response to a control command from the first controller section.

33. An image forming apparatus according to claim 32, wherein if at least one of the developers mounted in the developing unit is print-ready when the print request is inputted, the first controller section applies to the second control section a control command directing to start the printing operation by the print-ready developer.

34. An image forming apparatus according to claim 32, wherein if all the developers mounted in the developing unit are unready to print when the print request is inputted, the first controller section selects, as a priority developer, one of the developers mounted in the developing unit and applies to the second controller section a control command directing to perform the print preparatory process only on the priority developer.

35. An image forming apparatus according to claim 32, wherein if all the developers mounted in the developing unit are unready to print when the control command directing to start the printing operation is inputted from the first controller section, the second controller section selects, as a priority developer, one of the developers mounted in the developing unit and outputs to the first controller section a print-preparatory-process request signal for requesting permission to perform the print preparatory process only on the priority developer.

36. An image forming apparatus according to claim 32, wherein if all the developers mounted in the developing unit are unready to print, the second controller section outputs to the first controller section a print-preparatory-process request signal for requesting permission to perform the print preparatory process on all the developers mounted in the developing unit.

37. An image forming apparatus according to claim 36, wherein if at least one of the developers mounted in the developing unit is print-ready when the control command directing to start the printing operation is inputted from the first controller section during the execution of the print preparatory process, or if at least one of the developers mounted in the developing unit becomes print-ready after the control command is inputted from the first controller section, the second controller section interrupts the print preparatory process and starts the printing operation using the print-ready developer.

38. An image forming apparatus according to claim 36, wherein if at least one of the developers mounted in the developing unit is print-ready when the print request is inputted during the execution of the print preparatory process, or if at least one of the developers mounted in the developing unit becomes print-ready after the print request is inputted to the first controller section, the first controller section applies to the second controller section the control command directing to interrupt the print preparatory process, confirms the interruption of the print preparatory process, and then applies to the second controller the control command directing to start the printing operation by the print-ready developer.

39. An image forming apparatus according to claim 36, wherein the second controller section checks for the input of the control command from the first controller section directing to start the printing operation each time the developer is brought into the print-ready state by performing the print preparatory process thereon, the second controller section interrupting the print preparatory process and starting the printing operation, if the control command is inputted.

40. An image forming apparatus according to claim 32, wherein the first controller section selects developer(s) to be made print-ready from the developers mounted in the developing unit on the basis of the determination results as to whether the developer is print-ready or not and of the print request and then, applies to the second controller section a control command directing to perform the print preparatory process on the selected developer(s).

41. An image forming method for forming an image by using a plurality of developers each storing therein a toner of the same color, comprising:

determining, by monitoring the respective conditions of the plural developers, whether the developer is in a first state where the developer can be directly used in a printing operation, or in a second state where the developer can be shifted to the first state by subjecting the developer to a predetermined print preparatory process before the developer is used in the printing operation, accepting a print request from an external source and performing the image formation using the developer in the first state, if at least one of the plural developers is in the first state, and performing the print preparatory process on the developer in the second state, if it is determined that any of the plural developers is not in the first state.

42. In an image forming apparatus comprising a developing unit removably provided with a plurality of developers each having a toner of the same color, an image forming method taking the following steps when a print request from external source is applied, the steps comprising:

a step of performing a print preparatory process in a mode optimized based on the print request, the print preparatory process performed on a developer in order to enable a printing operation by the developer; and a printing step of selectively using the developer mounted in the developing unit thereby forming an image corresponding to the print request by using the toner in the developer.

43. In an image forming apparatus comprising a developing unit removably provided with a plurality of developers each having a toner of the same color, an image forming method comprising the steps of:

checking each of the developers mounted in the developing unit to determine whether the developer is in a state usable for the printing operation or not;

performing a print preparatory process in a mode according to the determination results, the print preparatory process performed to bring the developer into the state usable for the printing operation; and forming an image corresponding to a print request by using the developer subjected to the print preparatory process.

* * * * *